US012178287B2

(12) United States Patent
Case et al.

(10) Patent No.: US 12,178,287 B2
(45) Date of Patent: Dec. 31, 2024

(54) BLADDERS, FOOTWEAR UPPERS INCLUDING BLADDERS, AND ARTICLES OF FOOTWEAR INCLUDING BLADDERS PROVIDING ARCH SUPPORT OR OTHER FOOT SUPPORT

(71) Applicant: NIKE, Inc., Beaverton, OR (US)

(72) Inventors: Patrick R. Case, Portland, OR (US); Yoon Jeong Choi, Portland, OR (US); James Molyneux, Portland, OR (US); Colin Runkle, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 8 days.

(21) Appl. No.: 18/162,795

(22) Filed: Feb. 1, 2023

(65) Prior Publication Data

US 2023/0240412 A1 Aug. 3, 2023

Related U.S. Application Data

(60) Provisional application No. 63/306,327, filed on Feb. 3, 2022, provisional application No. 63/306,366, filed on Feb. 3, 2022.

(51) Int. Cl.

| | |
|---|---|
| ***A43B 23/02*** | (2006.01) |
| ***A43B 7/14*** | (2022.01) |
| ***A43B 13/20*** | (2006.01) |

(52) U.S. Cl.

CPC ..... *A43B 23/029* (2013.01); *A43B 7/14* (2013.01); *A43B 7/1495* (2013.01); *A43B 13/20* (2013.01)

(58) Field of Classification Search

None

See application file for complete search history.

(56) References Cited

U.S. PATENT DOCUMENTS 3,685,176 A * 8/1972 Rudy ..... A43B 5/0407 36/71

5,113,599 A * 5/1992 Cohen ..... A43B 23/029 36/114

(Continued)

FOREIGN PATENT DOCUMENTS

WO 90/09115 A1 8/1990

OTHER PUBLICATIONS

Apr. 14, 2023 (WO) International Search Report and Written Opinion—App PCT/US2023/061720, 10 pages.

(Continued)

*Primary Examiner* — Jameson D Collier

(74) *Attorney, Agent, or Firm* — Banner & Witcoff, Ltd.

(57) ABSTRACT

Bladders for footwear uppers, footwear uppers including the bladders, articles of footwear including the bladders, and/or methods of making and using such bladders are described. At least one bladder chamber is provided in the instep and/or tongue area of the upper/article of footwear. In some examples, force applied to the instep based bladder chamber(s) moves fluid to one or more additional bladder chambers located in the arch and/or midfoot areas of the upper/article of footwear, and/or other areas of the wearer's foot. This movement of fluid increases fluid pressure and/or volume in the arch, midfoot, and/or other areas of the wearer's foot to provide additional support.

20 Claims, 16 Drawing Sheets

(56) References Cited

U.S. PATENT DOCUMENTS

| | | | | |
|---|---|---|---|---|
| 5,343,638 | A * | 9/1994 | Legassie | A43B 23/0255 36/71 |
| 5,784,807 | A * | 7/1998 | Pagel | A43B 17/03 36/43 |
| 6,195,914 | B1 * | 3/2001 | Otis | A43B 3/26 36/11.5 |
| 7,478,488 | B1 | 1/2009 | Davis et al. | |
| 2001/0032399 | A1 * | 10/2001 | Litchfield | A43B 23/029 36/114 |
| 2005/0028404 | A1 * | 2/2005 | Marvin | A43B 19/00 36/55 |
| 2006/0162186 | A1 | 7/2006 | Marvin et al. | |
| 2012/0167413 | A1 | 7/2012 | Marvin et al. | |
| 2013/0227857 | A1 | 9/2013 | Schindler et al. | |
| 2016/0270479 | A1 * | 9/2016 | Suzuki | A43B 7/146 |
| 2017/0360155 | A1 | 12/2017 | Leary et al. | |
| 2022/0104582 | A1 * | 4/2022 | Christensen | A43B 23/029 |
| 2023/0141164 | A1 | 5/2023 | Case et al. | |
| 2023/0141325 | A1 | 5/2023 | Case et al. | |
| 2023/0146597 | A1 * | 5/2023 | Case | A43B 1/04 36/45 |
| 2023/0147306 | A1 * | 5/2023 | Case | A43B 23/025 36/45 |
| 2023/0172315 | A1 | 6/2023 | Case et al. | |
| 2023/0172316 | A1 | 6/2023 | Case et al. | |
| 2023/0413940 | A1 * | 12/2023 | Case | A43B 1/14 |

OTHER PUBLICATIONS

May 15, 2023 (WO)—International Search Report and Written Opinion—App PCT/US2023/061724, 10 pages.

* cited by examiner

BLADDERS, FOOTWEAR UPPERS INCLUDING BLADDERS, AND ARTICLES OF FOOTWEAR INCLUDING BLADDERS PROVIDING ARCH SUPPORT OR OTHER FOOT SUPPORT

RELATED APPLICATION DATA

This application is a U.S. Non-Provisional Application based on and claiming priority to (a) U.S. Provisional patent Appln. No. 63/306,327 filed Feb. 3, 2022 and entitled "Bladders, Footwear Uppers Including Bladders, and Articles of Footwear Including Bladders Providing Arch Support or Other Foot Support" and (b) U.S. Provisional Patent Appln. No. 63/306,366 filed Feb. 3, 2022 and entitled "Bladders, Footwear Uppers Including Bladders, and Articles of Footwear Including Bladders Providing Arch Support or Other Foot Support." Each of U.S. Provisional Patent Appln. No. 63/306,327 and U.S. Provisional Patent Appln. No. 63/306,366 is entirely incorporated herein by reference.

FIELD OF THE INVENTION

The present invention relates to bladders for footwear uppers, footwear uppers including the bladders, articles of footwear including the bladders, and/or methods of making and using such bladders, uppers, and/or articles of footwear. In some aspects of this technology, the bladders will include bladder chambers and/or fluid lines configured to move fluid to locations to provide support for a wearer's foot, e.g., an arch support or other foot support.

Aspects of this technology may be used with features of the technology described in any one or more of: (a) U.S. Provisional Patent Appln. No. 63/277,903 filed Nov. 10, 2021; (b) U.S. Provisional Patent Appln. No. 63/277,916 filed Nov. 10, 2021; (c) U.S. Provisional Patent Appln. No. 63/277,932 filed Nov. 10, 2021; (d) U.S. Provisional Patent Appln. No. 63/277,941 filed Nov. 10, 2021; (e) U.S. Provisional Patent Appln. No. 63/286,763 filed Dec. 7, 2021; and (f) U.S. Provisional Patent Appln. No. 63/286,793, filed Dec. 7, 2021. Each of U.S. Provisional Patent Appln. No. 63/277,903, U.S. Provisional Patent Appln. No. 63/277,916, U.S. Provisional Patent Appln. No. 63/277,932, U.S. Provisional Patent Appln. No. 63/277,941, U.S. Provisional Patent Appln. No. 63/286,763, and U.S. Provisional Patent Appln. No. 63/286,793 is entirely incorporated herein by reference.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY

This Summary is provided to introduce some general concepts relating to this technology in a simplified form that are further described below in the Detailed Description. This Summary is not intended to identify key features or essential features of the invention.

Aspects of this technology relate to bladders for footwear uppers, footwear uppers including the bladders, articles of footwear including the bladders, and/or methods of making and using such bladders, uppers, and/or articles of footwear, e.g., of the types described and/or claimed below and/or of the types illustrated in the appended drawings. In some aspects of this technology, the bladders will include bladder chambers and/or fluid lines configured to move fluid (e.g., when the footwear is secured to a wearer's foot) to locations to provide support for a wearer's foot, e.g., arch support or other foot support. Such bladders, uppers, and/or articles of footwear may include any one or more structures, parts, features, properties, and/or combination(s) of structures, parts, features, and/or properties of the examples described and/or claimed below and/or of the examples illustrated in the appended drawings.

More specific aspects of this technology relate to bladders, e.g., for inclusion in footwear uppers, that include: (a) a first thermoplastic sheet; (b) a second thermoplastic sheet facing the first thermoplastic sheet; and (c) a continuous outer perimeter seam sealing the first thermoplastic sheet to the second thermoplastic sheet. The first and second thermoplastic sheets may constitute portions of a single sheet of thermoplastic material, e.g., folded over on at least one edge. The continuous outer perimeter seam defines a sealed interior volume between the first thermoplastic sheet and the second thermoplastic sheet. In some examples of this technology, this continuous outer perimeter seam extends continuously to form the sealed interior volume to include: (a) at least one instep chamber located at an instep area of the footwear upper; (b) at least one arch or other foot support chamber; and (c) at least one fluid line connecting the instep chamber(s) with the arch or other foot support chamber(s). Bladders of the types described herein and used in accordance with aspects of this technology may be formed from readily flexible materials (e.g., thermoplastic materials). These bladders can readily change shape under applied forces.

Additionally or alternatively, in some examples of this technology, the continuous outer perimeter seam of the bladder may extend to form the sealed interior volume to include: (i) one or more fluid supply chambers having at least a first major surface formed by the first thermoplastic sheet, (ii) one or more arch or other foot support chambers, and (iii) one or more fluid lines connecting the fluid supply chamber(s) and the one or more arch or other foot support chambers through the sealed interior volume. In use, fluid may move from the fluid supply chamber(s) to at least one arch or other foot support chamber (via at least one fluid line) to increase fluid volume and/or pressure in the arch or other foot support chamber(s). A footwear securing strap or strap system, a shoelace, a pressure plate, etc., may apply force to the fluid supply chamber(s) to induce fluid movement to the arch and/or other foot support chamber(s). The movement of fluid, increased fluid volume, and/or increased fluid pressure provides additional support for the arch or other area(s) of a wearer's foot. The sealed interior volume may contain a fixed mass of fluid. In some examples, the fluid may move in the sealed interior volume without the need of a pump (e.g., without a manual, mechanical, and/or electronic pump device) ("pump-free") and/or without the need for valves to control fluid flow ("valve-free").

Additional aspects of this technology relate to footwear uppers incorporating bladders, e.g., of the types described above, to moderate the feel of the footwear securing system and/or to provide arch support and/or other foot support. The footwear upper may include a strap system that applies force to the first major surface of the fluid supply chamber(s) and moves fluid from the fluid supply chamber(s) (e.g., located at an instep area of the footwear upper) to the one or more arch support and/or other foot support chambers. Such bladders, footwear uppers, and articles of footwear may operate to move fluid in a pump-free manner and/or in a valve-free manner.

While aspects of this technology are described in terms of bladders, footwear uppers including such bladders, and articles of footwear including such bladders, additional aspects of this technology relate to methods of making such bladders, footwear uppers, and/or articles of footwear and/or methods of using such bladders, footwear uppers, and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
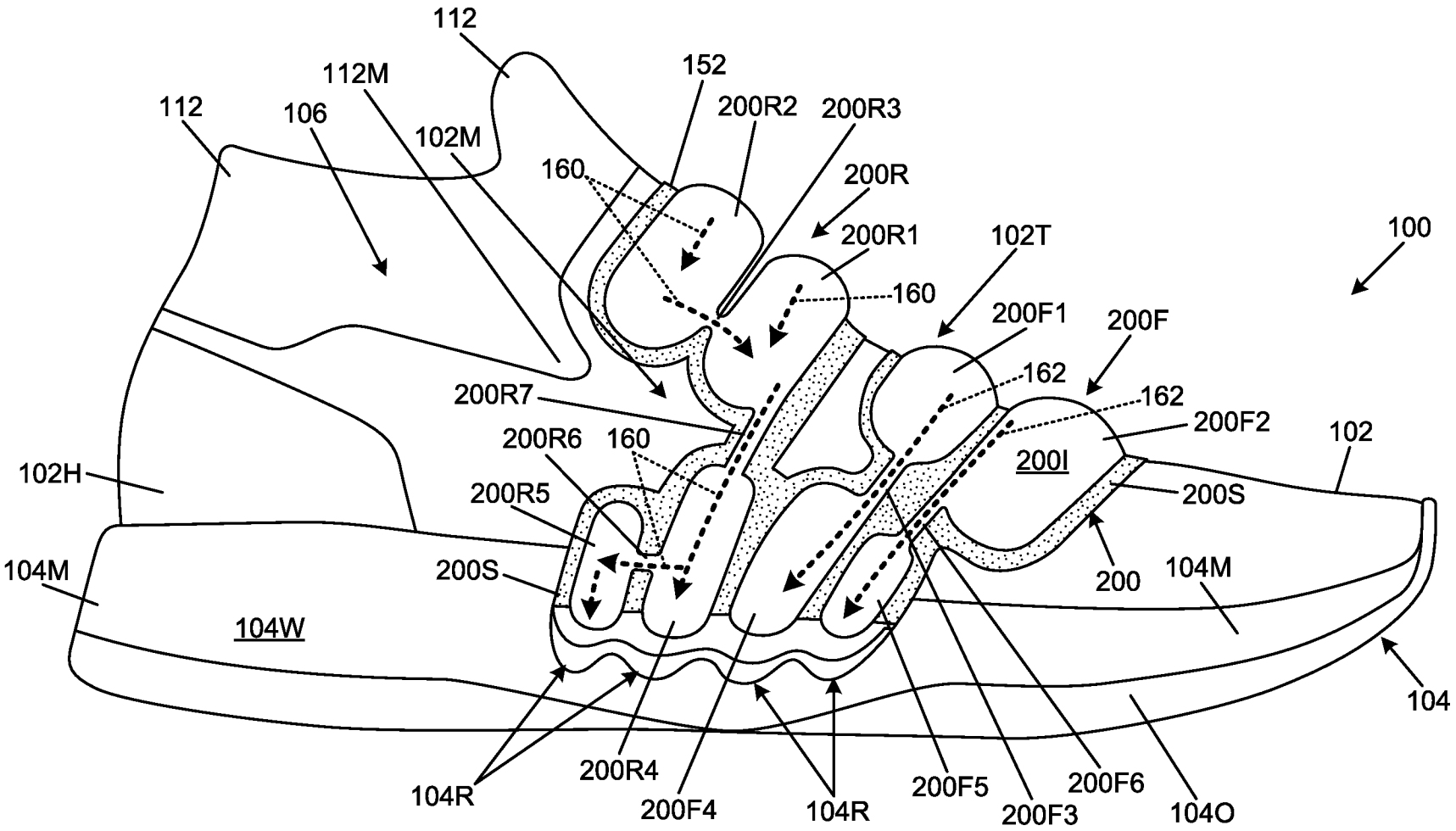
FIGS. 1A-1C provide medial side, lateral side, and upper bottom surface views, respectively, of articles of footwear and components thereof in accordance with some aspects of this technology.

In the following description of various examples of bladders, footwear uppers, and/or articles of footwear according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

I. GENERAL DESCRIPTION OF ASPECTS OF THIS TECHNOLOGY

As noted above, aspects of this technology relate to bladders, footwear uppers including such bladders, and articles of footwear including such bladders, e.g., of the types described and/or claimed below and/or of the types illustrated in the appended drawings. Such bladders, footwear uppers including such bladders, and articles of footwear including such bladders may include any one or more structures, parts, features, properties, and/or combination(s) of structures, parts, features, and/or properties of the examples described and/or claimed below and/or of the examples illustrated in the appended drawings.

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

This application describes footwear components (e.g., upper components (including fabric components), bladder components, sole structures, etc.) that are "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include: bonds formed by fusing or melting components together (e.g., if the components include compositions that are compatible to mix and join together to form a bond, such as two components including thermoplastic polyurethane components); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden at the bonded location with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt bonded joints are adhesive free and may be seamless. The term "engaged with" is used herein as a generic term and includes both adhesive based bonds and adhesive free bonds within its scope as well as other potential types of engagement that fix (permanently or releasably) two (or more) components together in a "non-bonded" manner (including through the use of mechanical connectors or fasteners, through the use of sewing or stitching, etc.). The term "engage" (and variations thereof) also includes within its scope connecting two (or more) parts together in a releasable or relatively movable manner (such as a lace connected or otherwise interacting with one or more lace-engaging components in an article of footwear).

Some more specific aspects or examples of this technology relate to footwear uppers and articles of footwear that include:

(a) a footwear upper base formed from one or more component parts and including: (i) an instep region including at least one of a tongue base region or an instep base region and (ii) a first midfoot side region; and (b) an arch supporting bladder system including: (i) a first instep chamber engaged with the instep region of the footwear upper base, (ii) a first arch support chamber located at the first midfoot side region of the footwear upper base, and (iii) a first fluid line connecting the first instep chamber and the first arch support chamber and placing the first instep chamber in fluid communication with the first arch support chamber.

When incorporated into a footwear structure, the footwear upper base may be engaged with a sole structure. The sole structure may include a first recess, wherein a first portion of at least one of the first arch support chamber and/or the first fluid line is received in the first recess such that the first portion extends from a first side surface of the footwear upper base to a bottom surface (e.g., a plantar support surface) of the footwear upper base. The first portion remains in open fluid communication through the first recess (so fluid can move between the first instep chamber and the first arch support chamber). The arch supporting bladder system further may include one or more additional instep chambers, one or more additional arch support chambers, and/or one or more additional fluid lines connecting instep chambers and arch support chambers. The sole structure also may include one or more additional recesses that allow portions of the additional fluid line(s) and/or additional arch support chamber(s) to extend to the plantar support surface of the footwear upper base.

Other aspects of this technology relate to footwear uppers that include:

(a) a footwear upper base formed from one or more component parts and including: (i) an instep region including at least one of a tongue base region or an instep base region, (ii) a lateral side region, and (iii) a medial side region; and (b) a foot supporting bladder system including: (i) a first instep chamber engaged with the instep region of the footwear upper base, (ii) one or more lateral elongated foot support chambers extending from the first instep chamber down and/or along the lateral side region of the footwear upper base, wherein the one or more lateral elongated foot support chambers is/are in fluid communication with the first instep chamber, and (iii) one or more medial elongated foot support chambers extending from the first instep chamber down and/or along the medial side region of the footwear upper base, wherein the one or more medial elongated foot support chambers is/are in fluid communication with the first instep chamber.

When incorporated into a footwear structure, the footwear upper base may be engaged with a sole structure. The sole structure may include one or more recesses, wherein one or more of the lateral elongated foot support chambers extend through the recess(es), e.g., to a plantar support surface of the footwear upper base and/or one or more of the medial elongated foot support chambers extend through the recess(es), e.g., to the plantar support surface of the footwear upper base. The foot supporting bladder system further may include one or more fluid chambers to provide heel and/or ankle support.

Still other aspects of this technology relate to footwear uppers that include:

(a) a footwear upper base formed from one or more component parts, the footwear upper base including: (i) an instep region, (ii) a first side region extending from the instep region, and (iii) a second side region extending from the instep region;

(b) one or more "first side" elongated bladder chambers, at least one (and optionally some or even all) of these first side elongated bladder chambers having a first end located in the first side region and a second end located in the instep region or the second side region, wherein the first side elongated bladder chamber(s) extend across a front-to-rear centerline of the footwear upper base in the instep region (e.g., extend from the lateral side (i.e., the "little toe" side) to the medial side (i.e., the "big toe" side) of the footwear upper base across the instep region); and (c) one or more "second side" elongated bladder chambers, at least one (and optionally some or even all) of these second side elongated bladder chambers having a first end located in the second side region and a second end located in the instep region or the second side region, wherein the second side elongated bladder chamber(s) do not extend across the front-to-rear centerline of the footwear upper base (e.g., all portions of the second side elongated bladder chamber(s) are located only on the medial side or only on the lateral side of the footwear upper base in the instep region).

The first side elongated bladder chambers and the second side elongated bladder chambers may be in a staggered arrangement on the footwear upper base. In such an arrangement, the second ends of the second side elongated bladder chambers may be located between the second ends of two adjacent first side elongated bladder chambers. When incorporated into a footwear structure, the footwear upper base may be engaged with a sole structure. The sole structure may include one or more recesses, wherein one or more of the first side elongated foot support chambers extend through the recess(es), e.g., to a plantar support surface of the footwear upper base and/or one or more of the second side elongated foot support chambers extend through the recess(es), e.g., to the plantar support surface of the footwear upper base. Such footwear uppers and/or articles of footwear further may include one or more fluid chambers to provide heel and/or ankle support.

When tightened, laces, straps, and/or strap systems provided with footwear uppers according to the above aspects or examples of this technology may apply force to portions of the bladder(s) located in the instep region to move fluid from the instep region to the sides, arch, heel, and/or ankle regions of the footwear. Additionally or alternatively, such movement of fluid may be induced when a wearer bends his/her foot at the instep area, e.g., when taking a step, initiating a jump, landing a jump, etc. Movement of fluid in these manners increases the fluid pressure and/or volume in the sides, arch, heel, and/or ankle regions of the bladder chamber(s) to provide additional support to the wearer's foot. In at least some examples of this technology, the fluid may move within the interconnected bladder chambers without the use of and/or need for a pump (manually operated or powered) to move the fluid and/or without the use of and/or need for valving to control fluid flow.

Additional aspects and examples of this technology include bladders, e.g., for inclusion in footwear uppers, that include the instep chamber(s), arch support or other foot support chamber(s), and/or fluid line(s) of the types described above, those described in more detail below, and/or those illustrated in the figures. Such bladders may be formed from two thermoplastic sheet layers (formed from one or more thermoplastic sheets) that are selectively bonded together (e.g., using heat and pressure) to form a seam defining a sealed interior volume forming the instep chamber(s), arch support or other foot support chamber(s), and/or fluid line(s) as described above and/or described in more detail below.

Further aspects of this technology relate to articles of footwear including bladders and/or footwear uppers of the various types described above and/or described in more detail below. Still additional aspects of this technology relate to methods of making the bladders, footwear uppers, and/or articles of footwear described above and/or described in more detail below.

The term "fluid line" as used herein means any type of connection that will allow fluid to flow from one point to another point. In some more specific examples, a "fluid line" may constitute a tubular type structure, optionally integrally formed with and as part of a bladder structure (e.g., formed from thermoplastic material). Any of the "fluid lines" described herein may have: (a) an axial length (e.g., a length in the direction of fluid flow) within the range of 3 mm to 250 mm (and in some examples, within a range of 4 mm to 200 mm, within a range of 5 mm to 160 mm, or even within a range of 6 mm to 120 mm) and/or (b) a cross sectional area (e.g., transverse to the direction of fluid flow) within the range of 7 $mm^2$ to 320 $mm^2$ (and in some examples within the range of 8 $mm^2$ to 280 $mm^2$, within the range of 9 $mm^2$ to 250 $mm^2$, or even within the range of 10 $mm^2$ to 200 $mm^2$). "Fluid lines" may be linear or curved.

The term "elongated" as used herein in the content of "elongated" bladder chambers and/or "elongated" fluid lines means the component has one dimension (e.g., a length dimension) that is at least 1.5 times greater than its other dimensions (e.g., its width dimension and height dimension). "Elongated" bladder chambers of the types described herein may have a length dimension (e.g., an axial length dimension) that is at least 2 times greater (and in some examples, at least 3 times greater, at least 5 times greater, or even at least 8 times greater) than its other dimensions perpendicular to its length dimension (e.g., its width dimension, its height dimension, its diameter dimension, etc.). "Elongated" bladder chambers and/or fluid lines may have a generally tubular or cylindrical shape (at least within the interior of the chamber and/or within the interior of the fluid line that contains the fluid).

Given the general description of features, examples, aspects, structures, and methods according to examples of this technology provided above, a more detailed description of specific example footwear uppers, bladders, articles of footwear, and methods in accordance with this technology follows.

II. DETAILED DESCRIPTION OF EXAMPLE BLADDERS, FOOTWEAR UPPERS, ARTICLES OF FOOTWEAR, ARCH SUPPORT OR OTHER FOOT SUPPORT SYSTEMS, AND OTHER FOOTWEAR COMPONENTS/FEATURES ACCORDING TO THIS TECHNOLOGY

Figure 1B:
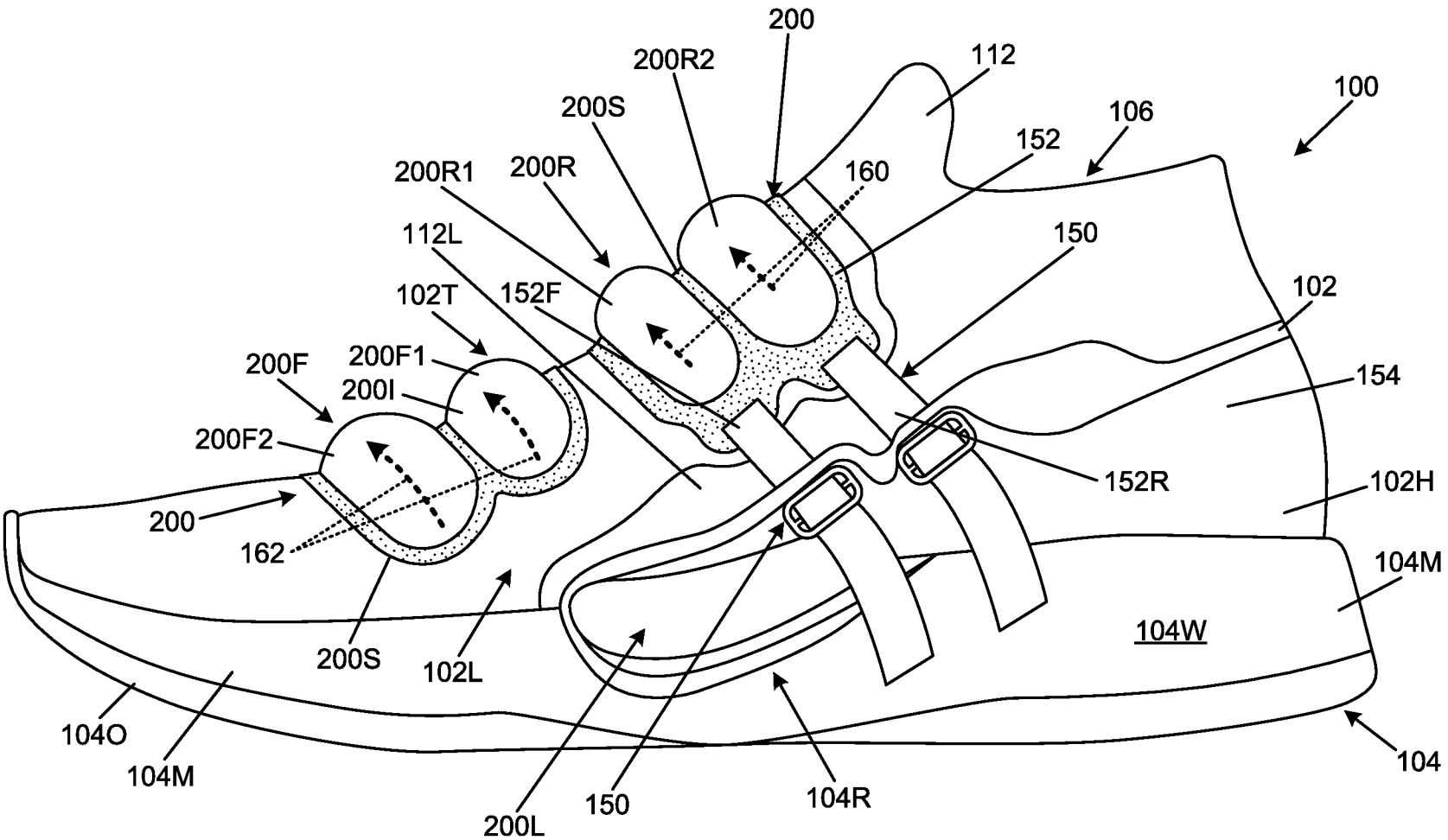
Figure 1C:
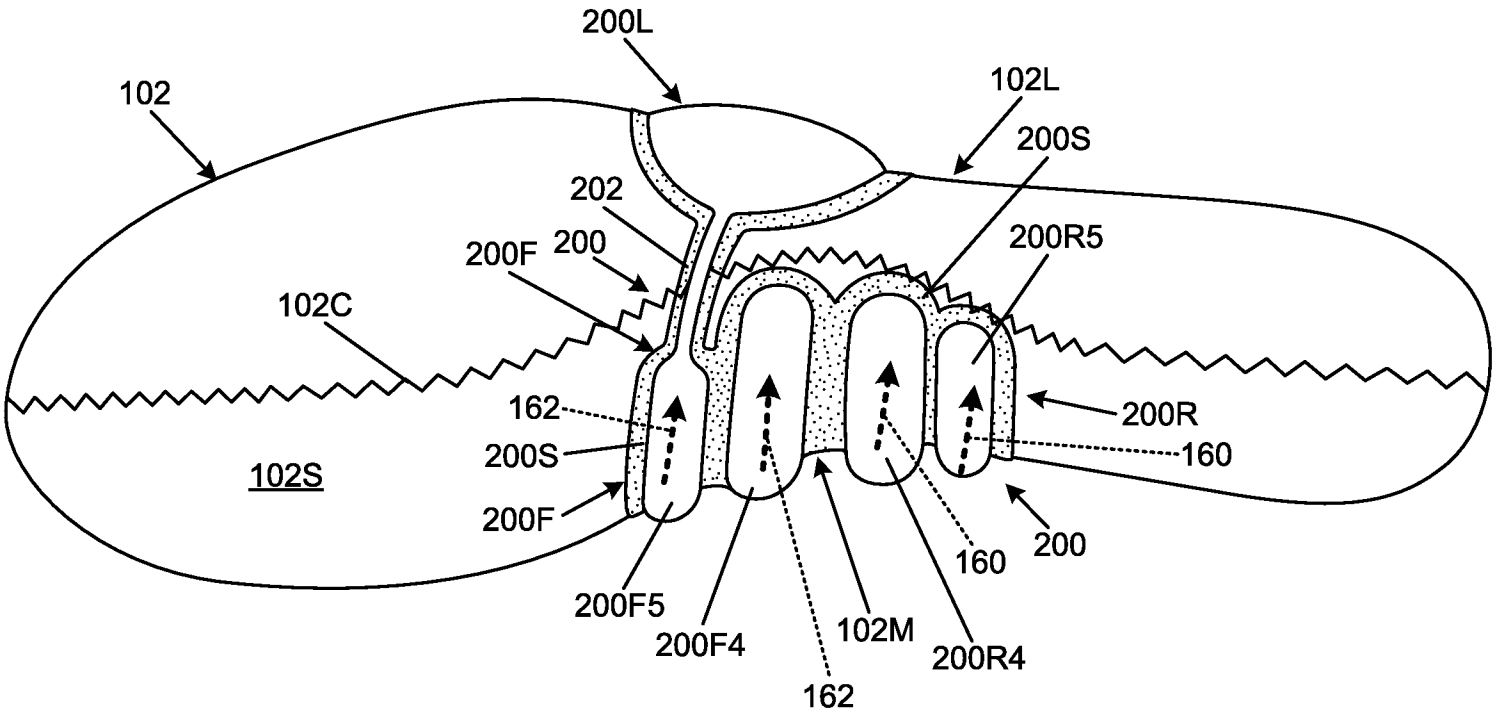

FIGS. 1A and 1B provide medial and lateral side views, respectively, of an article of footwear 100 in accordance with some aspects of this technology. FIG. 1C provides a bottom view of the footwear upper base 102 of that article of footwear 100. While an article of footwear 100 for the left foot is shown in FIGS. 1A-1C, a complementary right shoe of a pair of shoes may have structures that are mirror images of the structures shown in FIGS. 1A-1C.

The footwear upper base 102 may be made from one or more components, e.g., including one or more knit components. The footwear upper base 102 defines a foot-receiving opening 106 that may be formed at least in part from a component 112 formed from a stretchable and/or elastic material that allows insertion and removal of a wearer's foot. The stretchable and/or elastic component 112 of this example extends around the ankle region of the footwear upper base 102 (e.g., completely around the top perimeter of the footwear opening) and includes forward extensions 112L and 112M that extend into and partially define the tongue region of the footwear upper base 102. The stretchable and/or elastic component 112 may have a wide variety of sizes, shapes, arrangements, and/or ornamental appearances from the specific examples shown in FIGS. 1A and 1B.

This illustrated example footwear upper base 102 further includes a heel counter component 102H, e.g., to provide additional support for the wearer's heel. The heel counter component 102H may be formed from a rigid plastic material (e.g., a thermoplastic polyurethane material), a leather material, a textile material, or other appropriate material, including heel counter materials known and used in the footwear art. The heel counter arrangement 102H also may vary widely in size, shape, arrangement, and/or ornamental appearance from the specific example shown in FIGS. 1A and 1B.

As further shown in FIGS. 1A and 1, the footwear upper base 102 of this example is engaged with a sole structure 104. Sole structure 104 may have any desired construction and/or number of parts without departing from this technology. In the illustrated example, sole structure 104 includes one or more midsole component 104M parts (e.g., formed from a polymer foam material, such as ethylvinylacetate ("EVA") foam, polyurethane foam, etc.) and one or more outsole component 1040 parts (e.g., formed from a rubber material, a thermoplastic polyurethane material, etc.). The sole structure 104 may include cleats or other traction-enhancing structures (e.g., on an outsole component 1040) and/or may include features suited to a specific sport, athletic activity, or use. This illustrated example sole structure 104 includes at least one recess 104R, e.g., located along at least one of its sidewalls (on the medial sidewall 104W and the lateral sidewall 104W in this illustrated example). The purpose of the recess(es) 104R will be described in more detail below.

Article of footwear 100 of this example further includes an arch supporting bladder system 200. The bladder system 200 may be engaged with the footwear upper base 102 component(s) in any desired manner. As some more specific examples, the bladder system 200 may be engaged with one or more footwear upper base 102 components at least in part by adhesives. Additionally or alternatively, the bladder system 200 may be engaged with one or more footwear upper base 102 components at least in part by one or more mechanical connectors (e.g., rivets, crimped metal ring connectors, sewn seams, etc. engaged with the seam(s) 200S forming the bladder system 200). Still additionally or alternatively, bladder system 200 may be engaged with one or more footwear upper base 102 components at least in part by: (a) a melt bonded connection (e.g., bonding a thermoplastic material of the bladder system 200 with a thermoplastic material present in a footwear upper base 102 component part (e.g., a knitted part including a thermoplastic component in one or more yarns)), (b) by heat and pressure, (c) by localized melting, (d) by welding techniques (e.g., RF welding, ultrasonic welding, etc.), etc. In some examples of this technology, the bladder system 200 will be engaged with one or more footwear upper base 102 components (including a knit footwear upper base 102 component) at least in part in an adhesive-free manner. U.S. Patent Appln. No. 63/277,916 and U.S. Patent Appln. No. 63/277,932 describe various ways that a bladder system 200 may be bonded to a footwear upper component that may be used in accordance with this technology.

Features of the bladder system 200 of the example article of footwear 100 shown in FIGS. 1A-1C now will be described in more detail. Bladder systems 200 in accordance with examples of this technology may vary widely in ornamental appearance, size, shape, number of bladder chambers, number of fluid lines, locations of bladder chambers, location of fluid lines, and the like. This example article of footwear 100 includes a footwear upper base 102 formed from one or more component parts. The footwear upper base 102 includes at least: (i) an instep region 102T including at least one of a tongue base region or an instep base region and (ii) a first midfoot side region (e.g., a medial side region 102M and/or a lateral side region 102L-see FIGS. 1A and 1, respectively). An arch supporting bladder system 200 is engaged with the footwear upper base 102. This illustrated example arch supporting bladder system 200 includes two bladder chamber portions a rearward bladder chamber portion 200R and a forward bladder chamber portion 200F. These two bladder chamber portions 200R and 200F may be isolated from one another (and optionally formed as two completely separate parts) or may be in fluid communication with one another (e.g., connected by one or more fluid lines).

Arch supporting bladder systems 200 in accordance with at least some examples of this technology include at least: (i) a first instep chamber engaged with the instep region 102T of the footwear upper base 102, (ii) a first arch support chamber located at the first midfoot side region 102M or 102L of the footwear upper base 102, and (iii) a first fluid line connecting the first instep chamber and the first arch support chamber and placing the first instep chamber in fluid communication with the first arch support chamber. In fact, in the specific example arch supporting bladder system 200 of FIGS. 1A-1C, each of the rear bladder chamber portion 200R and the forward bladder chamber portion 200F includes elements (i) to (iii) above. In the specific example shown in FIGS. 1A-1C, the rear bladder chamber portion 200R includes: (i) a first rearward instep chamber 200R1 engaged with the instep region 102T of the footwear upper base 102; (ii) a second rearward instep chamber 200R2 engaged with the instep region 102T of the footwear upper base 102 and spaced rearward of the first rearward instep chamber 200R1; (iii) a fluid line 200R3 connecting the first rearward instep chamber 200R1 and the second rearward instep chamber 200R2; (iv) a first rearward arch support chamber 200R4 located at the first midfoot side region 102M of the footwear upper base 102; (v) a second rearward arch support chamber 200R5 located at the first midfoot side region 102M of the footwear upper base 102 and spaced rearward from the first rearward arch support chamber 200R4; (vi) a fluid line 200R6 connecting the first rearward arch support chamber 200R4 and the second rearward arch support chamber 200R5; and (vii) a fluid line 200R7 connecting the first rearward instep chamber 200R1 and the first rearward arch support chamber 200R4 and placing the first rearward instep chamber 200R1 in fluid communication with the first rearward arch support chamber 200R4. Alternatively, if desired, fluid line 200R6 could be omitted and a fluid line could be provided between the second rearward instep chamber 200R2 and the second rearward arch support chamber 200R5. Other fluid line connections are possible without departing from this technology (e.g., with different numbers of fluid lines, sizes of fluid lines, shapes of fluid lines, etc.).

Additionally, in this illustrated example, the forward bladder chamber portion 200F includes: (i) a first forward instep chamber 200F1 engaged with the instep region 102T of the footwear upper base 102; (ii) a second forward instep chamber 200F2 engaged with the instep region 102T of the footwear upper base 102 and spaced forward from the first forward instep chamber 200F1; (iii) a first forward arch support chamber 200F4 located at the first midfoot side region 102M of the footwear upper base 102; (iv) a second forward arch support chamber 200F5 located at the first midfoot side region 102M of the footwear upper base 102 and spaced forward from the first forward arch support chamber 200F4; (v) a fluid line 200F3 connecting the first forward instep chamber 200F1 and the first forward arch support chamber 200F4; and (vi) a fluid line 200F6 connecting the second forward instep chamber 200F2 and the second forward arch support chamber 200F5. Additionally or alternatively, if desired, the forward bladder chamber portion 200F could include a fluid line connecting the first forward instep chamber 200F1 and the second forward instep chamber 200F2 and/or a fluid line connecting the first forward arch support chamber 200F4 and the second forward arch support chamber 200F5. Still additionally or alternatively, if desired, the rear bladder chamber portion 200R and the forward bladder chamber portion 200F may be placed in fluid communication with one another, e.g., via a fluid line extending between the first rearward instep chamber 200R1 and the first forward instep chamber 200F1, via a fluid line extending between the first rearward instep chamber 200R1 and the first forward arch support chamber 200F4, and/or via a fluid line extending between the first forward instep chamber 200F1 and the first rearward arch support chamber 200R4.

Other fluid line connections are possible without departing from this technology (e.g., with different numbers of fluid lines, sizes of fluid lines, shapes of fluid lines, etc.).

In this illustrated example, the four instep bladder chambers 200F2, 200F1, 200R1, and 200R2 are arranged in a front-to-rear direction on the footwear upper base 102 and on the article of footwear 100. More specifically, the second forward instep chamber 200F2 is located furthest forward (toward the toe area), first forward instep chamber 200F1 is located rearward of second forward instep chamber 200F2, first rearward instep chamber 200R1 is located rearward of first forward instep chamber 200F1, and second rearward instep chamber 200R2 is located rearward of first rearward instep chamber 200R1 (with second rearward instep chamber 200R2 furthest rearward (toward the heel area) in this illustrated example). Two or more of the instep chambers 200R1, 200R2, 200F1, and 200F2 may extend across the instep region 102T in a medial side-to-lateral side direction in substantially parallel directions (the term "substantially parallel" as used herein in this context means parallel or oriented at an angle of 5 degrees or less, e.g., a central axial direction of at least two of the instep chambers 200R1, 200R2, 200F1, and 200F2 extend in a parallel direction or within 5 degrees of parallel). Any one or more of the instep chambers 200R1, 200R2, 200F1, and/or 200F2 may have curved upper and/or lower surfaces in the side-to-side direction to better fit over and onto the top surface of the wearer's foot in the instep area.

Also, in this illustrated example, the four arch support bladder chambers 200F5, 200F4, 200R4, and 200R5 are arranged in a front-to-rear direction on the footwear upper base 102 and on the article of footwear 100. More specifically, the second forward arch support chamber 200F5 is located furthest forward (toward the toe area), first forward arch support chamber 200F4 is located rearward of second forward arch support chamber 200F5, first rearward arch support chamber 200R4 is located rearward of first forward arch support chamber 200F4, and second rearward arch support chamber 200R5 is located rearward of first rearward arch support chamber 200R4 (with second rearward arch support chamber 200R5 furthest rearward (toward the heel area) in this illustrated example). Also, in this illustrated example, each of fluid lines 200F6, 200F3, and 200R7 extending between instep bladder chambers (200F2, 200F1, 200R1, respectively) and the corresponding arch support bladder chambers (200F5, 200F4, 200R4, respectively) extends in a downward and rearward direction such that the arch support bladder chamber (200F5, 200F4, 200R4, respectively) is oriented rearward from its corresponding instep bladder chamber (200F2, 200F1, 200R1, respectively). Two or more of the arch support chambers 200R4, 200R5, 200F4, and 200F5 may extend across the bottom surface 102S in the side-to-side direction in substantially parallel directions (the term "substantially parallel" as used herein in this context means parallel or oriented at an angle of 5 degrees or less, e.g., a central axial direction of at least two of the arch support chambers 200R4, 200R5, 200F4, and 200F5 at the bottom surface 102S extend in a parallel direction or within 5 degrees of parallel).

As described above, the sole structure 104 engaged with the footwear upper base 102 of this example includes at least a first recess 104R in its sidewall 104W. A first portion of at least one of a first arch support chamber and/or a first fluid line is received in the first recess 104R such that this first portion extends from a first side surface of the footwear upper base 102 to its bottom surface 102S. As best shown in FIG. 1A, in this illustrated example, the recess 104R is sized and shaped to accommodate all four of first rearward arch support chamber 200R4, second rearward arch support chamber 200R5, first forward arch support chamber 200F4, and second forward arch support chamber 200F5.

Alternatively, two or more recesses 104R may be provided in the sidewall 104W, and each recess 104R may be sized to accommodate any desired number of arch support chambers and/or fluid lines. The recess(es) 104R allows (allow) the arch support chamber(s) and/or fluid line(s) to "turn the corner" from the side surface 102M of the footwear upper base 102 to its bottom surface 102S without pinching completely closed, e.g., to maintain open fluid communication through bladder system 200 where it extends through the recess(es) (e.g., recess 104R) to the bottom surface 102S.

FIGS. 1B and 1C further show that the lateral side of this example article of footwear 100 structure includes a bladder chamber 200L that extends through a lateral side recess 104R of the sole structure 104 (in the midsole 104 lateral sidewall 104W). The bladder chamber 200L extends from the lateral midfoot side region 102L of the footwear upper base 102, through the recess 104R, to the bottom surface 102S of the footwear upper base 102. If desired, in some examples of this technology, a fluid line 202 may place the bladder chamber 200L in fluid communication with one or more of the arch support bladder chambers 200R4, 200R5, 200F4, and/or 200F5 (e.g., placing second forward arch support bladder chamber 200F5 in fluid communication with lateral side bladder chamber 200L via fluid line 202). In this illustrated example, however, fluid line 202 (and thus bladder chamber 200L) is not in fluid communication with any of the arch support bladder chamber(s) 200R4, 200R5, 200F4, and/or 200F5 (e.g., fluid communication is stopped (in either direction) at and/or by the bottom seam 102C along the bottom surface 102S of the footwear upper base 102). Additionally or alternatively, if desired, the lateral side of the article of footwear 100 may include one or more fluid lines and/or one or more arch support bladder chambers having structures and/or arrangements the same as or similar to those described above for the medial side of the article of footwear 100. Bladder chamber 200L may provide additional arch support and/or support for the lateral side of the wearer's foot (e.g., when the wearer makes a quick turn or cut). Any size and/or shape may be used for the lateral bladder chamber 200L.

FIG. 1B further shows a strap securing system 150 (including two straps in this illustrated example) for securing the article of footwear 100 to a wearer's foot and to apply force to the rear bladder portion 200R (e.g., to the major surfaces of the rearward instep bladder chambers 200R1, 200R2). Strap securing system 150 may include a cover plate 152 that extends over the exterior major surfaces of the rearward instep bladder chambers 200R1, 200R2. Rearward strap component 152R and forward strap component 152F extend between the cover plate 152 (or the seam 200S of the rear bladder portion 200R) and a base support 154 on the lateral side of the footwear upper base 102. The base support 154 may constitute part of the heel counter 102H structure, part of the seam forming lateral bladder chamber 200L, and/or a separate footwear component part. In use, a wearer can pull the strap components 152R, 152F tight to the foot. That action applies force to the rearward instep bladder chambers 200R1, 200R2 by forcing the cover plate 152 onto the major surfaces of the rearward instep bladder chambers 200R1, 200R2. The applied force moves fluid from the rearward instep bladder chambers 200R1, 200R2, through fluid line 200R7, into first rearward arch support chamber 200R4, through fluid line 200R6, and into second rearward arch support chamber 200R5. The added fluid volume and/or pressure in rearward arch support chambers 200R4 and 200R5 provide additional arch support for the wearer. Note fluid flow arrows 160 in FIGS. 1A-1C.

Alternatively, the strap(s) 152R, 152F of the strap securing system 150 may engage with openings provided in and/or hardware elements mounted to the seam 200S of one or more of the bladders of the bladder system 200 (e.g., the seam 200S of one or more of rearward bladder portion 200R and/or lateral bladder chamber 200L). As another example, at least some (and optionally all) of the rearward bladder portion 200R (e.g., one or more of the first rearward instep chamber 200R1, the second rearward instep chamber 200R2, the fluid line 200R3, the first rearward arch support chamber 200R4, the second rearward arch support chamber 200R5, the fluid line 200R6, and/or the fluid line 200R7) may be combined with the cover plate 152 as a single component part (e.g., with the bladder(s) 200R1, 200R2 mounted beneath the cover plate 152 so force is applied by pressing the bladder(s) 200R1, 200R2 against the wearer's foot when the strap(s) 152F, 152R are tightened). As yet another alternative, if desired, the strap securing system 150 may be replaced with a conventional footwear lacing system in which the laces apply force to the major surface(s) of the rearward bladder portion 200R (e.g., to one or more of rearward instep bladder chambers 200R1, 200R2) and/or to the major surface(s) of the forward bladder portion 200F (e.g., to one or more of forward instep bladder chambers 200F1, 200F2).

With respect to the forward bladder chamber portion 200F in this illustrated example, force applied from bending an instep area of a wearer's foot (e.g., during a step, jump, etc.) causes fluid to flow from first forward instep bladder chamber 200F1 and second forward instep bladder chamber 200F2, through fluid lines 200F3 and 200F6, respectively, and into forward arch support bladder chambers 200F4 and 200F5, respectively. See fluid flow arrows 162. Alternatively, a strap system could be provided for the forward bladder chamber portion 200F, e.g., akin to the strap system 150 described above for rear bladder chamber portion 200R.

In the illustrated example of FIGS. 1A-1C: (a) the entire volume of bladder portion 200F inside its perimeter seam 200S is in open fluid communication and (b) the entire volume of bladder portion 200R inside its perimeter seam 200S is in open fluid communication.

No valves, pumps, or other fluid flow control devices are provided in these example bladder portions 200F and 200R. Thus, fluid may flow freely within the interior chambers 200I defined inside the seam 200S. In this manner, when the strap system 150 is released or loosened and/or when the instep bend is relaxed, fluid can return to the instep chamber(s) 200R1, 200R2, 200 F1, 200F2 (e.g., in a reverse direction to fluid flow lines 160, 162). In other words, fluid can freely flow within the bladder portions 200F, 200R to equalize pressure throughout.

While FIGS. 1A-1C show the arch support bladder chambers 200R4, 200R5, 200F4, 200F5 and their associated fluid lines on the medial side of the article of footwear 100, if desired, the structures on the medial and lateral sides could be flip-flopped. In other words, if desired, the structures shown in FIG. 1A could be located on the lateral side of the article of footwear 100 and the structures shown in FIG. 1B could be located on the medial side of the article of footwear 100.

Figure 2A:
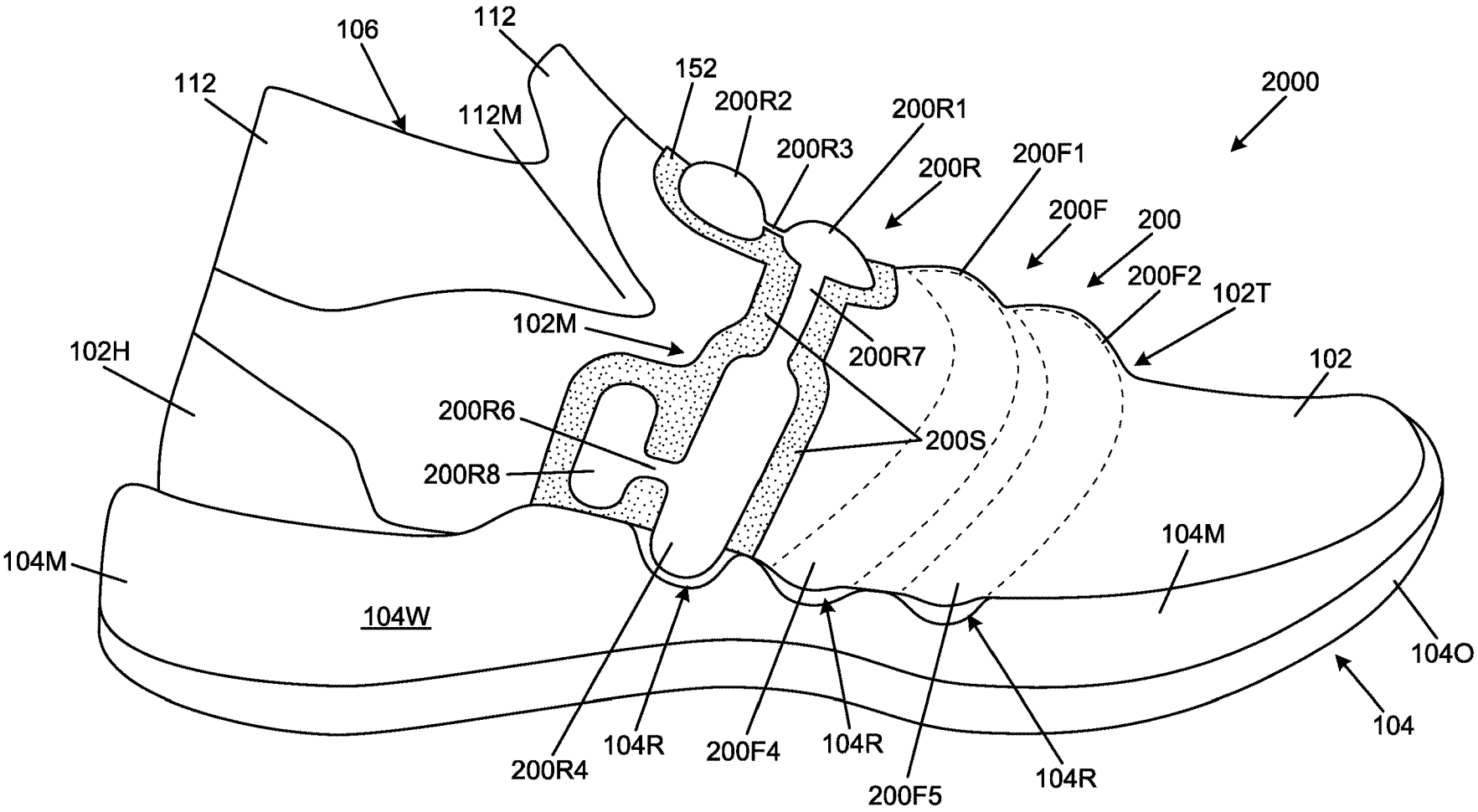
FIGS. 2A-2B provide medial side and lateral side views, respectively, of articles of footwear and components thereof in accordance with some aspects of this technology.
Figure 2B:
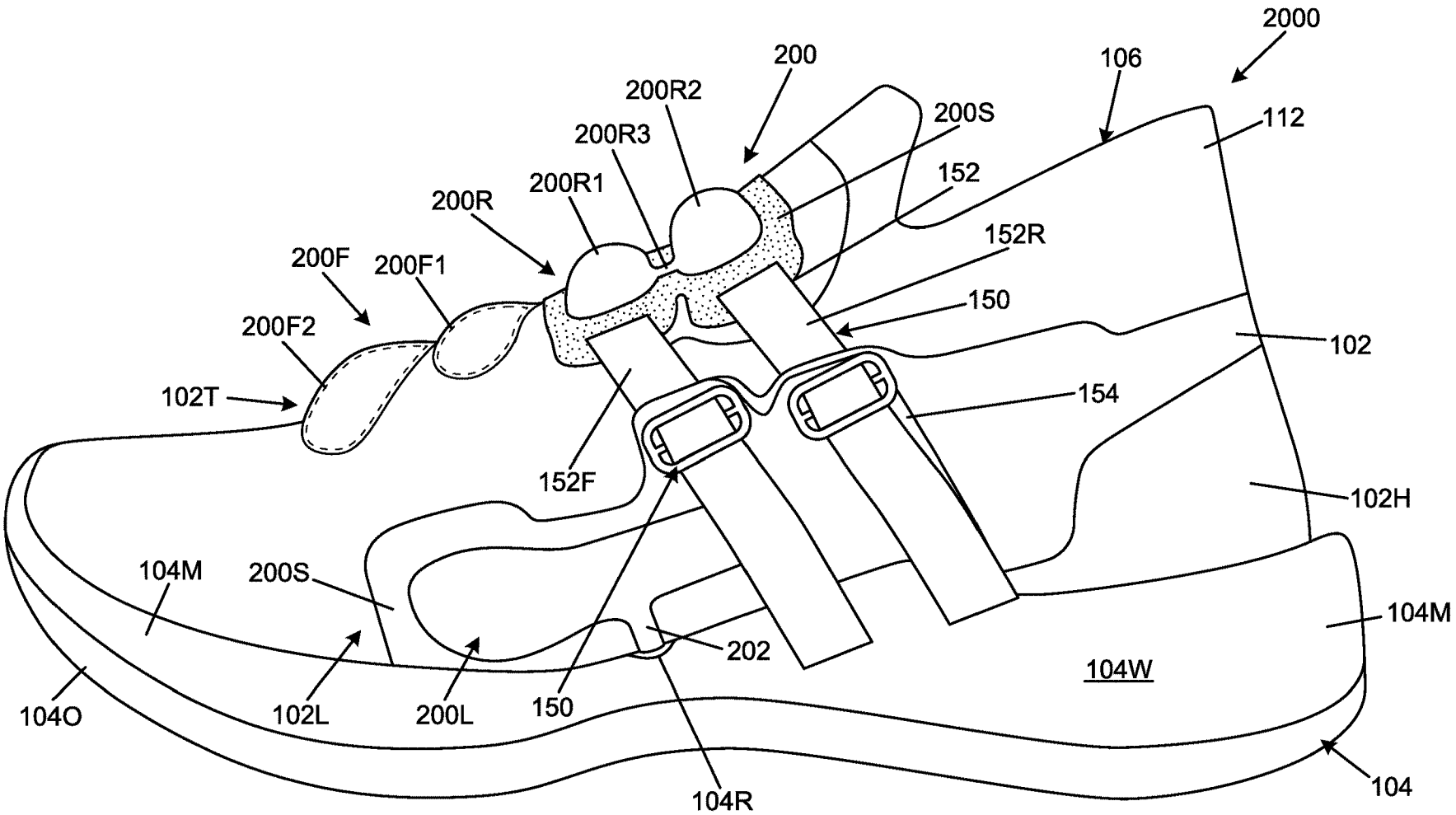

FIGS. 2A-2B show medial side and lateral side views, respectively, of another article of footwear 2000 in accordance with some examples of this technology. Where the same reference numbers are used in FIGS. 2A-2B as used in FIGS. 1A-IC, the same or similar parts are intended (with any of the features, alternatives, or options for that part described above), and much of the overlapping disclosure may be omitted. Also, while an article of footwear 2000 for the left foot is shown in FIGS. 2A-2B, a complementary right shoe of a pair of shoes may have a structure that is the mirror image of the structures shown in FIGS. 2A-2B. The following discussion of FIGS. 2A-2B will focus on differences between this illustrated example structure and those described above in conjunction with FIGS. 1A-1C.

One difference between the article of footwear 100 of FIGS. 1A-1C and the article of footwear 2000 of FIGS. 2A-2B relates to the location of the forward bladder chamber portion 200F. In the example of FIGS. 1A-1C, the forward bladder chamber portion 200F is located on (and engaged with) the outermost surface of the footwear upper base 102. In the example of FIGS. 2A-2B, on the other hand, the forward bladder chamber portion 200F is located inside at least one layer of the footwear upper base 102. In this structure, at least part (and optionally all) of the forward bladder chamber portion 200F may be located inside and/or between layers of the footwear upper base 102. More specifically, at least part of any one or more of first forward instep chamber 200F1, second forward instep chamber 200F2, fluid line 200F3, first forward arch support chamber 200F4, second forward arch support chamber F5, and/or fluid line 200F6 may be located beneath the outer layer of the footwear upper base 102 (optionally between layers of the footwear upper base 102).

Additionally or alternatively, at least part (and optionally all) of the forward bladder chamber portion 200F may be located such that a surface of the forward bladder chamber portion 200F (e.g., a surface of any one or more of first forward instep chamber 200F1, second forward instep chamber 200F2, fluid line 200F3, first forward arch support chamber 200F4, second forward arch support chamber 200F5, and/or fluid line 200F6) is located within the foot-receiving chamber of the article of footwear 2000 and/or in contact with the wearer's foot.

While FIGS. 2A and 2B show the forward bladder chamber portion 200F located inside at least one layer of the footwear upper base 102, additionally or alternatively, if desired, all or some portion of the rearward bladder chamber portion 200R may be located inside at least one layer of the footwear upper base 102, between layers of the footwear upper base 102, and/or within the foot-receiving chamber of the article of footwear 2000. More specifically, at least part of any one or more of first rearward instep chamber 200R1, second rearward instep chamber 200R2, fluid line 200R3, first rearward arch support chamber 200R4, rearward foot support chamber 200R8, fluid line 200R6, and/or fluid line 200R7) may be located inside at least one layer of the footwear upper base 102, between layers of the footwear upper base 102, and/or within the foot-receiving chamber of the article of footwear 2000.

When some or all of the forward bladder chamber portion 200F and/or some or all of the rearward bladder chamber portion 200R is/are located inside at least one layer of the footwear upper base 102, properties of the footwear upper base 102 (e.g., stretchability, resilience, stiffness, etc.) may be selected to control the direction of displacement of the bladder surface(s) as fluid moves within the bladder system 200. For example, if a layer of the footwear upper base 102 located outside some portion of the bladder system 200 has low stretchability and/or high stiffness, this may cause the bladder system 200 surface(s) to displace inward when fluid volume and/or pressure is increased in a selected area. Additionally or alternatively, if an interior layer of the footwear upper base 102 is made more stretchable, this also may cause the bladder system 200 surface(s) to displace inward when fluid volume and/or pressure is increased in that stretchable area. Such inward displacement can help hold the surface(s) of the bladder system 200 against the wearer's foot thereby providing added support.

As another difference, the second rearward arch support chamber 200R5 from FIGS. 1A-1C is replaced with a rearward foot support chamber 200R8 in the example of FIGS. 2A-2B. Unlike second rearward arch support chamber 200R5, rearward foot support chamber 200R8 does not extend to the bottom surface 102S (a plantar support surface) of the footwear upper base 102. Thus, rearward foot support chamber 200R8 supports the medial side and arch area of the wearer's foot, e.g., in the heel and/or midfoot area(s). Additionally or alternatively, any one or more of first rearward arch support chamber 200R4, first forward arch support chamber 200F4, and/or second forward arch support chamber 200F5 could be sized and shaped to not extend to the bottom surface 102S of the footwear upper base 102 (and thus just support the medial side surface or the lateral side surface of the wearer's foot).

The article of footwear 2000 of FIGS. 2A-2B also differs from the article of footwear 100 of FIGS. 1A-1C with respect to the lateral bladder chamber 200L. In the example of FIGS. 1A-1C, the lateral bladder chamber 200L extends through a recess 104R in the sole structure 104 and to the bottom surface 102S of the footwear upper base 102. See FIG. 1C. In the article of footwear 2000 of FIGS. 2A-2B, on the other hand, the lateral bladder chamber 200L is located only on the side region 102L of the article of footwear 2000, and fluid line 202 extends through a recess 104R in the sole structure 104 to the bottom surface of the footwear upper base 102. The fluid line 202 of FIGS. 2A-2B may extend to and/or be in fluid communication with one or more of the arch support chambers, e.g., any one or more of first rearward arch support chamber 200R4, first forward arch support chamber 200F4, second forward arch support chamber 200F5, and/or, if present, second rearward arch support chamber 200F5. Alternatively, fluid line 202 of FIGS. 2A-2B may extend to a different arch support chamber.

While FIGS. 2A-2B show the arch and foot support bladder chambers 200R4, 200R8, 200F4, 200F5 and their associated fluid lines on the medial side of the article of footwear 2000, if desired, the structures on the medial and lateral sides could be flip-flopped. In other words, if desired, the structures shown in FIG. 2A could be located on the lateral side of the article of footwear 2000 and the structures shown in FIG. 2B could be located on the medial side of the article of footwear 2000.

Figure 3:
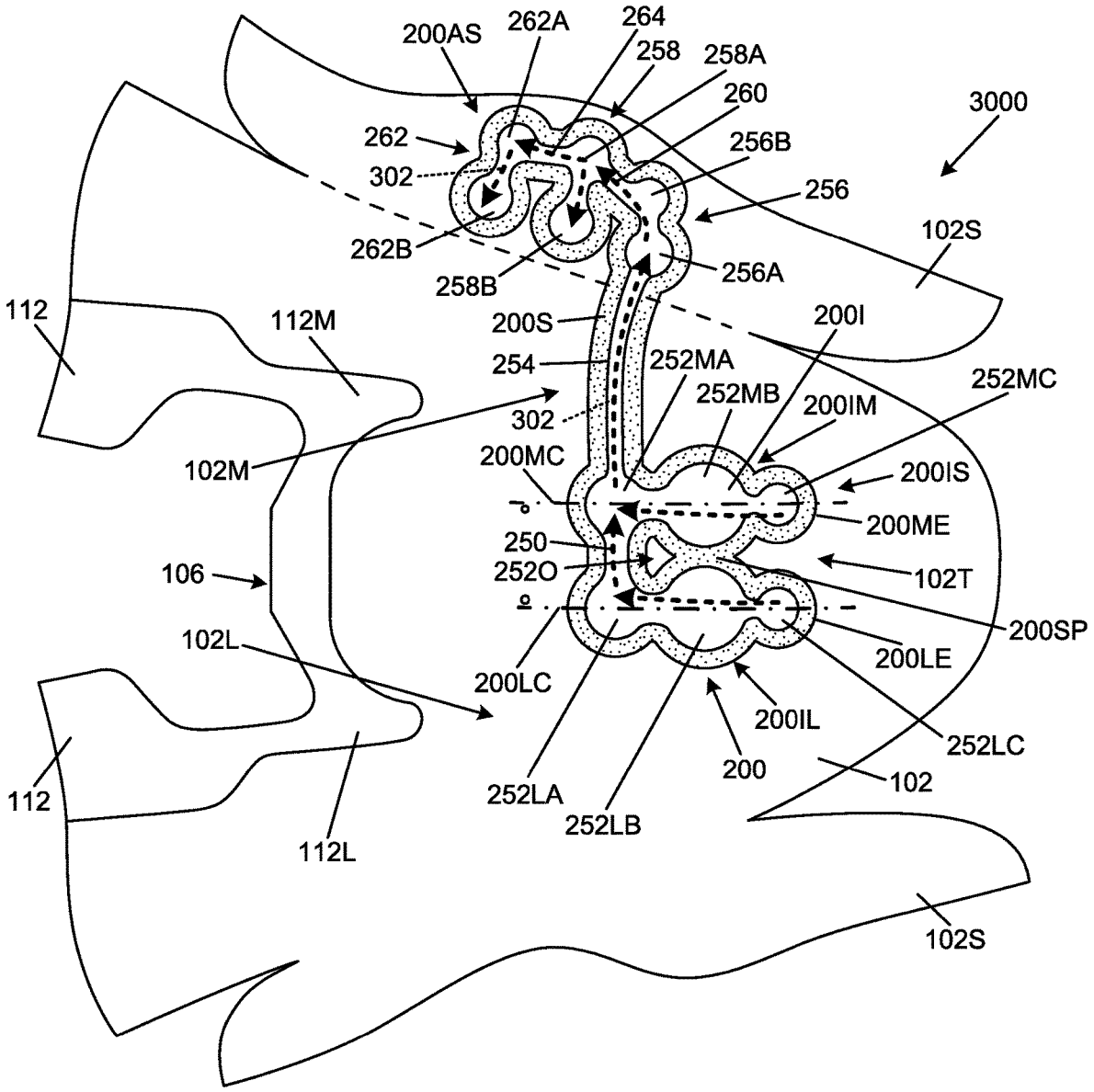
FIG. 3 provides a top or bottom view of a footwear upper blank including a bladder system in accordance with some aspects of this technology.

FIG. 3 illustrates an example upper "blank" 3000 for an article of footwear. This substantially flat upper blank 3000 may be arranged around a footwear last during the footwear manufacturing process to make the final footwear upper and/or article of footwear product. The final footwear product may be made by attaching the upper blank 3000 (while on the last) to a sole structure 104, e.g., of the types described above in conjunction with FIGS. 1A-2B. This example upper blank 3000 includes a footwear upper base 102 (formed from one or more component parts) having a bladder system 200 engaged with it. The bladder system 200 may be engaged with the footwear upper base 102 in any desired manner, including any of the manners described above (e.g., an adhesive based bond, an adhesive free bond, sewn seams, mechanical fasteners, etc.) and/or on or between any layer(s) of the footwear upper base 102. The view shown in FIG. 3 may constitute an interior view or an exterior view of the footwear upper blank 3000 (i.e., the bladder system 200 may be located on the exterior surface or on the interior surface of the footwear upper in the final shoe construction). Where the same reference numbers are used in FIG. 3 as used in FIGS. 1A-2B, the same or similar parts are intended (with any of the features, alternatives, or options for that part described above), and much of the overlapping disclosure may be omitted. Also, while the upper blank 3000 illustrated in FIG. 3 is for a right shoe, a complementary left upper blank 3000 for the left shoe of a pair of shoes may have a structure that is the mirror image of the structures shown in FIG. 3. The following discussion of FIG. 3 focuses on differences between this illustrated example structure and those described above in conjunction with FIGS. 1A-2B.

The bladder system 200 of FIG. 3 includes an instep based bladder chamber portion 200IS and an arch supporting bladder chamber portion 200AS connected by a fluid line and in open fluid communication (pump-free, valve-free). But, the bladder system 200 of FIG. 3 differs in several ways from the bladder systems 200 described above in conjunction with FIGS. 1A-2B. First, the portion of the bladder system 200 located at the instep region 102T of the footwear upper base 102 (the instep based bladder chamber portion 200IS) includes two substantially parallel bladder chamber portions-a lateral instep bladder chamber portion 200IL and a medial instep bladder chamber portion 200IM. In this illustrated example, the lateral instep bladder chamber portion 200IL defines a lateral central axial direction 200LC and the medial instep bladder chamber portion 200IM defines a medial central axial direction 200MC. These axial directions 200LC and 200MC are substantially parallel in this illustrated example. The term "substantially parallel" as used herein in this context means parallel or oriented at an angle of 5 degrees or less, e.g., axial directions 200LC and 200MC extend in a parallel direction or within 5 degrees of parallel. Further, in this illustrated example, each of the lateral instep bladder chamber portion 200IL and the medial instep bladder chamber portion 200IM includes a free end 200LE and 200ME, respectively. At least one of these free ends 200LE, 200ME (and in this illustrated example, both free ends 200LE, 200ME) form a forwardmost extent of the bladder system 200 on the footwear upper base 102. A connecting fluid line 250 places the lateral instep bladder chamber portion 200IL and the medial instep bladder chamber portion 200IM in fluid communication with one another.

FIG. 3 further illustrates that this example instep region of bladder system 200 constitutes a single bladder chamber formed to include multiple "bulbs" (i.e., a "multi-bulbed chamber"). In fact, each of the lateral instep bladder chamber portion 200IL and the medial instep bladder chamber portion 200IM has a multi-bulbed construction in this illustrated example, with the individual bulbs in the lateral instep bladder chamber portion 200IL having substantially the same size, shape, and volume as the corresponding and adjacent individual bulbs in the medial instep bladder chamber portion 200IM. While other arrangements, numbers, and/or combinations of bulb sizes and shapes are possible (including no discernible bulbs in instep bladder chamber portion 200IS), in this illustrated example: (A) the lateral instep bladder chamber portion 200IL, includes three interconnected bulbed areas (252LA, 252LB, 252LC, with bulb 252LC located furthest forward and at the free end 200LE) and (B) the medial instep bladder chamber portion 200IM includes three inter-connected bulbed areas (252MA, 252MB, 252MC, with bulb 252MC located furthest forward and at the free end 200ME). Further, as shown in FIG. 3, the central bulbed areas 252LB and 252MB are separated by a continuous portion 200SP of seam 200S and an opening 2520 is defined rearward of this continuous portion 200SP. A footwear upper base 102 component may be exposed through this opening 2520. As other alternatives, however, the lateral instep chamber portion 200IL and the medial instep chamber portion 200IM may include different numbers of bulbs, different sizes of bulbs, different shapes of bulbs, and/or otherwise different bulb and/or chamber structures.

A fluid line 254 connects instep based bladder chamber portion 200IS (e.g., one or both of lateral instep bladder chamber portion 200IL and medial instep bladder chamber portion 200IM) with arch supporting bladder chamber portion 200AS. In the final footwear structure, fluid line 254 may extend through a recess in a sole structure (e.g., like recesses 104R in midsole component 104M in the examples of FIGS. 1A-2B) to move fluid between the instep based bladder chamber portions 200IS (e.g., including 200IL and/or 200IM) and the arch supporting bladder chamber portion 200AS.

The arch supporting bladder chamber portion 200AS of this example includes a multi-bulbed construction. While any desired arrangement may be used, in the illustrated example, the arch supporting bladder chamber portion 200AS includes three bulbed regions. The first bulbed region 256 includes a first bulb 256A that connects with fluid line 254 and a second bulb 256B in fluid communication with the first bulb 256A. This first bulbed region 256 is the forwardmost arch supporting bulbed region in this illustrated example. First bulbed region 256 connects to a second bulbed region 258, e.g., by a fluid line 260 connecting second bulb 256B of the first bulbed region 256 with a first bulb 258A of the second bulbed region 258. First bulb 258A of the second bulbed region 258 connects with a second bulb 258B of the second bulbed region 258, which provides a free end of the second bulbed region 258. Second bulbed region 258 connects to a third bulbed region 262, e.g., by a fluid line 264 connecting first bulb 258A of the second bulbed region 258 with a first bulb 262A of the third bulbed region 258. First bulb 262A of the third bulbed region 262 connects with a second bulb 262B of the third bulbed region 262, which provides a free end of the third bulbed region 262. Third bulbed region 262 is the rearwardmost arch supporting bulbed region in this illustrated example. Thus, the structure shown in FIG. 3 includes three interconnected arch supporting regions (e.g., bulbed regions 256, 258, 262) spaced apart in the longitudinal direction (the front-to-back direction) of the footwear upper base 102 structure. More or fewer spaced apart arch supporting regions (with or without "bulbed" structures) could be provided, if desired. The spaced bulbed regions 256, 258, 262 of this example may help maintain flexibility and natural motion as the foot flexes (rolls forward during a step) while still providing desired arch support.

Additionally or alternatively, if desired, the fluid line 254 could extend to provide fluid to a different location in the arch supporting bladder chamber portion 200AS (e.g., to a different bulbed region, to the second bulbed region 258, and/or to the third bulbed region 262, and/or to multiple bulbed regions, etc.). Still additionally or alternatively, if desired, multiple fluid lines (like 254) may extend from the instep based bladder chamber portion 200IS to one or more locations in the arch supporting bladder chamber portion 200AS.

The footwear upper blank 3000 shown in FIG. 3 may be engaged with a sole structure 104 of any of the types described above and/or in any of the manners described above. One or more of the fluid line 254, the first bulbed region 256, the second bulbed region 258, and/or the third bulbed region 262 (e.g., bulbs 256A, 258B, and/or 262B) may extend through one or more recesses in the sole structure, e.g., such as recesses 104R in a sole structure 104 (e.g., midsole component 104M) in the manners described above for FIGS. 1A-2B.

In use, a strap system (e.g., one or more straps), a lace system, or other system may apply force to the lateral instep bladder chamber portion 200IL and/or the medial instep bladder chamber portion 200IM, e.g., when the footwear upper base 102 is secured to a wearer's foot. This force moves fluid via fluid line 254 to the arch supporting bladder portion 200AS to provide additional support to the wearer's arch (i.e., increasing fluid volume and/or pressure in one or more of the first bulbed region 256, the second bulbed region 258, and/or the third bulbed region 262). Additionally or alternatively, fluid movement down fluid line 254 to the arch supporting bladder portion 200AS may be induced when the wearer bends his/her foot in the instep region (e.g., during a step or jump). See fluid movement arrows 302. The entire volume 200I of the bladder system 200 inside the seam 200S may be in open fluid communication to facilitate movement of fluid.

FIG. 3 illustrates the arch supporting bladder portion 200AS on the medial side of the upper blank 3000 and receiving fluid from a fluid line 254 extending down the medial side 102M of the footwear upper base 102 directly from medial instep bladder chamber portion 200IM. Additionally or alternatively, the same or a similar arch supporting bladder portion 200AS could be provided on the lateral side of the upper blank 3000, e.g., with the same or a similar fluid line (like 254) extending down the lateral side 102L of the footwear upper base 102 to the bottom surface 102S of the footwear upper base 102 (e.g., directly from lateral instep bladder chamber portion 200IL). Thus, if desired, in the structure shown in FIG. 3, the top half of the figure could constitute the lateral side of the upper blank 3000 and the lower half of the figure could constitute the medial side. Also, both the lateral side and the medial side could include an arch supporting bladder portion (of the same or different structure).

Figure 4A:
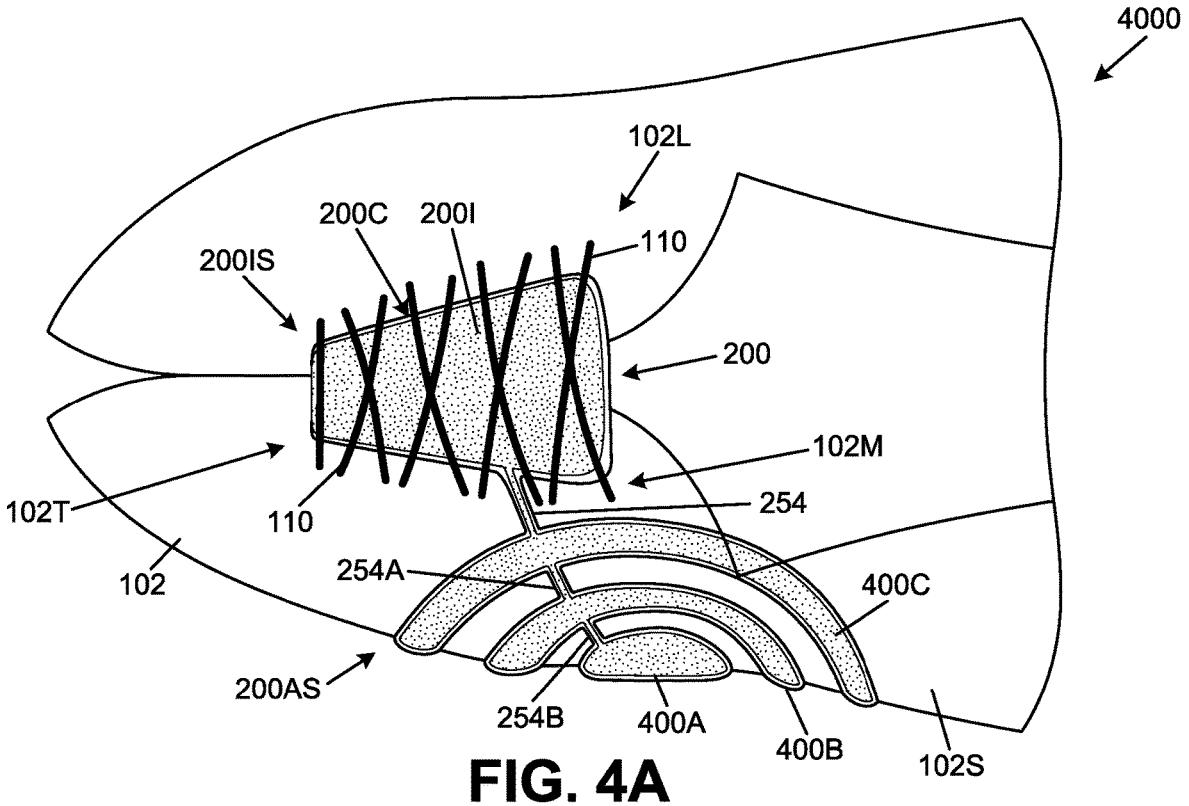
FIGS. 4A-4B provide views of an upper blank and a side of a footwear upper and components thereof in accordance with some aspects of this technology.
Figure 4B:
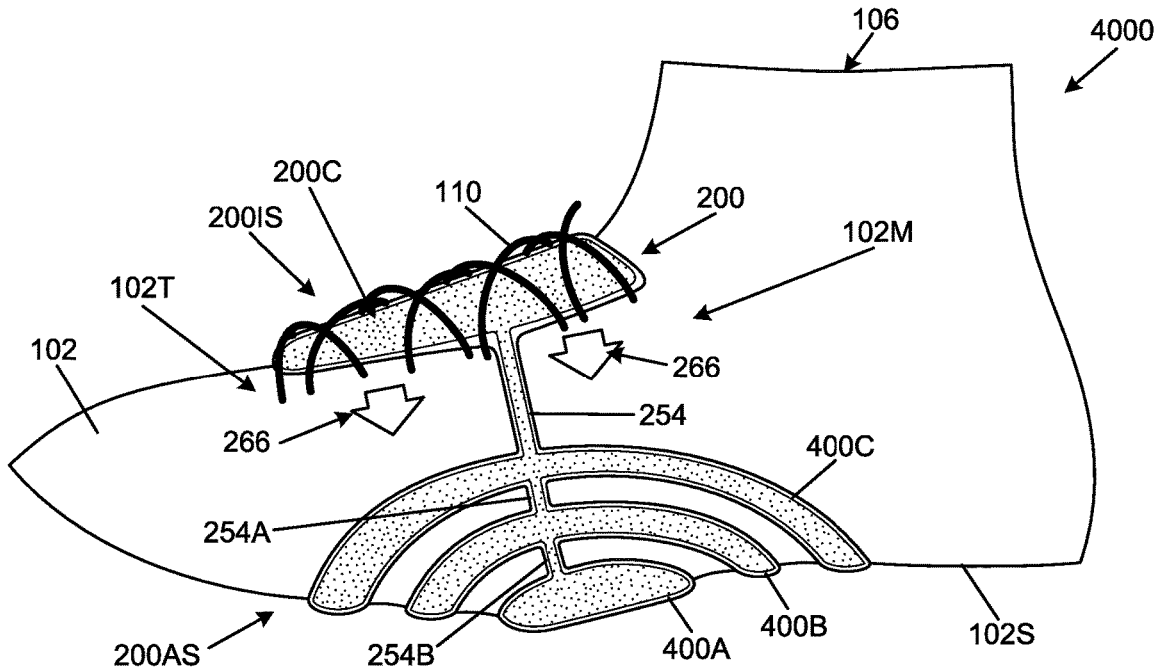

FIGS. 4A-4B illustrate another example upper blank 4000 (in flat form (FIG. 4A) and shaped to engage a sole structure (FIG. 4B)) that includes an instep based bladder chamber portion 200IS and an arch supporting bladder chamber portion 200AS connected by a fluid line 254 and in open fluid communication. Where the same reference numbers are used in FIGS. 4A-4B as used in FIGS. 1A-3, the same or similar parts are intended (with any of the features, alternatives, or options for that part described above), and much of the overlapping disclosure may be omitted. Also, while the upper blank 4000 illustrated in FIGS. 4A-4B is for a right shoe, a complementary left upper blank 4000 for the left shoe of a pair of shoes may have a structure that is the mirror image of the structures shown in FIGS. 4A-4B. The following discussion of FIGS. 4A-4B focuses on differences between this illustrated example structure and those described above in conjunction with FIGS. 1A-3.

In the example of FIGS. 4A-4B, the instep based bladder chamber portion 200IS constitutes a single instep bladder chamber 200C mounted over the tongue region of the footwear upper base 102. More bladder chambers could be provided in the instep region 102T in the example of FIGS. 4A-4B (e.g., like the arrangements shown in FIGS. 1A-3). Also, the multiple instep chamber systems shown in FIGS. 1A-3 could be replaced by a single instep bladder chamber, like instep bladder chamber 200C shown in FIGS. 4A-4B. The bladder system 200 may be engaged with the footwear upper base 102 in any desired manner, including any of the manners described above.

FIGS. 4A-4B further show that this example footwear upper blank 4000 includes a shoelace 110 and lacing system at the instep region 102T. The shoelace 110 may be engaged with eyelets, openings, or other lace-engaging components provided with or on the upper blank 4000, including in any conventional manners known and used in the footwear arts. In use, the shoelace 110 applies force to the major surface of the instep bladder chamber 200C when tightened around a wearer's foot and/or when the wearer steps or jumps in the shoe. This force (see force arrows 266 in FIG. 4B) moves fluid through fluid line 254 from the instep based bladder chamber 200C and the instep based bladder chamber portion 200IS to the arch supporting bladder chamber portion 200AS (i.e., increasing fluid volume and/or pressure in one or more of the arch support chamber portions (400A, 400B, 400C) described below). A shoelace 110 and lacing system of this type also could be provided with any of the footwear upper structures described above and/or any of those described below. Alternatively, a strap system could replace shoelace 110 and the lacing system shown in FIGS. 4A-4B.

The arch supporting bladder chamber portion 200AS of this example also differs from the structures described above in conjunction with FIGS. 1A-3. As shown in FIGS. 4A-4B, in this example, the arch supporting bladder chamber portion 200AS includes a base arch support chamber portion 400A and at least one elongated arch support chamber portion providing fluid to the base arch support chamber portion 400A. While the base arch support chamber portion 400A is shown as a single chamber in FIGS. 4A-4B, two or more chamber portions and/or chamber bulbs could be provided in some examples of this technology. In the example of FIGS. 4A-4B, two elongated arch support chamber portions 400B, 400C are provided, although more or fewer could be provided in other examples of this technology. The arch support chamber portions 400B, 400C of this example are arranged such that: (a) the second elongated arch support chamber portion 400C is engaged with the fluid line 254 from the instep chamber portion 200IS, (b) at least a portion of the first elongated arch support chamber portion 400B is located below (and/or spaced downward and/or inward from) at least a portion of the second elongated arch support chamber portion 400C on the footwear upper base 102, and (c) at least a portion of the base arch support chamber portion 400A (which also could constitute an elongated chamber structure) is located below (and/or spaced downward and/or inward from) at least a portion of the first elongated arch support chamber portion 400B on the footwear upper base 102.

Fluid line 254A connects the second elongated arch support chamber portion 400C with the first elongated arch support chamber portion 400B, and fluid line 254B connects the first elongated arch support chamber portion 400B with the base arch support chamber portion 400A. Alternatively, if desired, two or more fluid lines may connect any one or more: (a) the instep bladder chamber portion 200IS with the second elongated arch support chamber portion 400C, (b) the second elongated arch support chamber portion 400C with the first elongated arch support chamber portion 400B, and/or (c) the first elongated arch support chamber portion 400B with the base arch support chamber portion 400A. Any other desired manner of providing fluid communication between the instep based bladder chamber portion 200IS and the arch supporting bladder chamber portion 200AS may be used in other examples of this technology. As some more specific examples, one or more fluid lines may directly connect the instep based bladder chamber portion 200IS with the first elongated arch support chamber portion 400B and/or the base arch support chamber portion 400A.

The footwear upper blank 4000 shown in FIGS. 4A-4B may be engaged with a sole structure 104 of any of the types described above and/or in any of the manners described above. One or more of the fluid lines 254, 254A, 254B, the base arch support chamber portion 400A, the first elongated arch support chamber portion 400B, and/or the second elongated arch support chamber portion 400C may extend through one or more recesses in the sole structure, e.g., such as recesses 104R in a sole structure 104 (e.g., midsole component 104M) in the manners described above for FIGS. 1A-2B.

While FIGS. 4A-4B show the base arch support chamber portion 400A, the first elongated arch support chamber portion 400B, and the second elongated arch support chamber portion 400C and their associated fluid lines on the medial side of the footwear upper blank 4000, if desired, the same or similar structures could be provided on only the lateral side of the footwear upper blank 4000 or on both the lateral side and the medial side of the footwear upper blank 4000. Thus, if desired, the view shown in FIG. 4B could be a lateral side view of the footwear upper blank 4000 or a view of both sides of the footwear upper blank 4000.

Figure 5A:
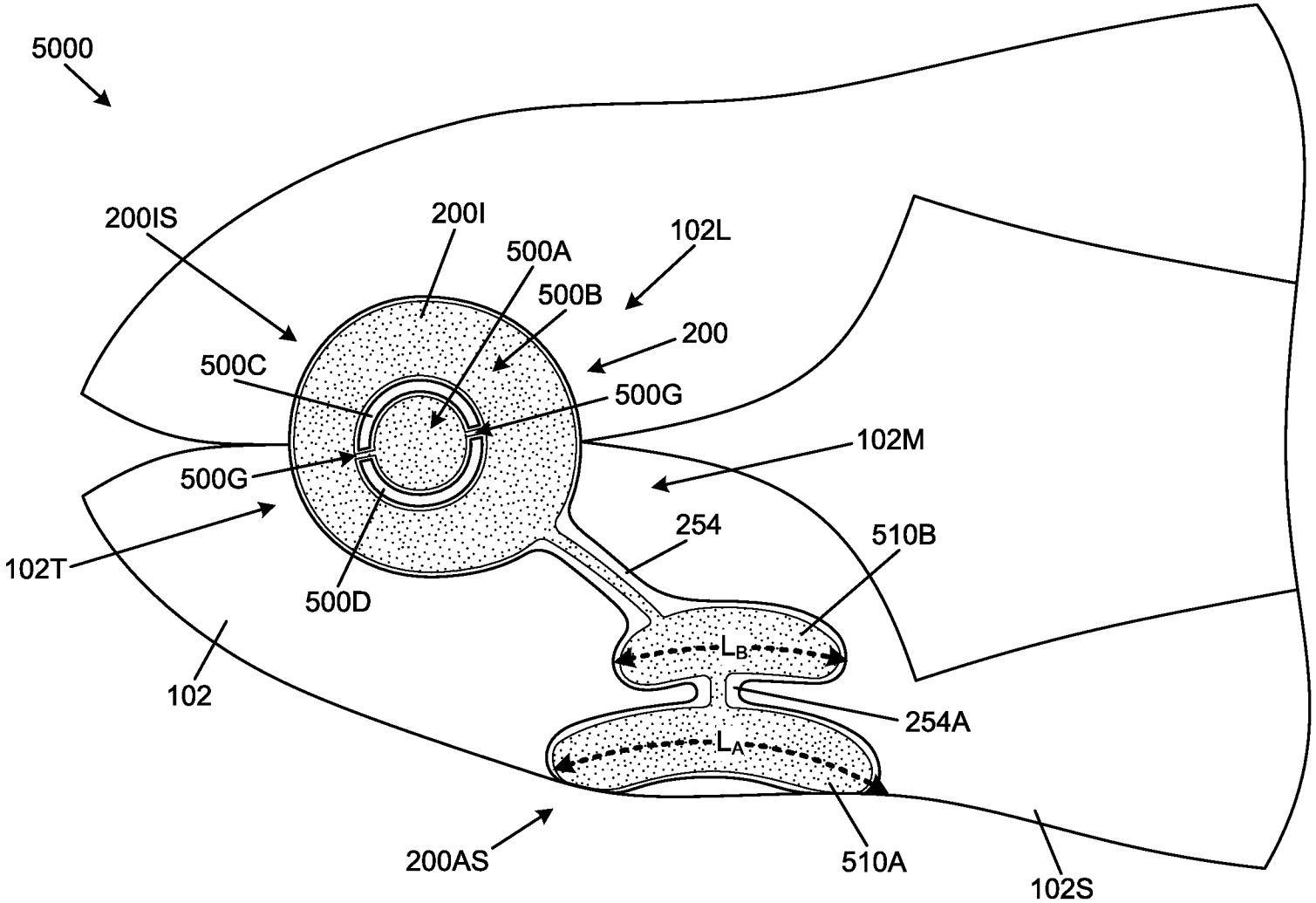
FIGS. 5A-5C provide views of another upper blank and a side of a footwear upper and components thereof in accordance with some aspects of this technology.
Figure 5B:
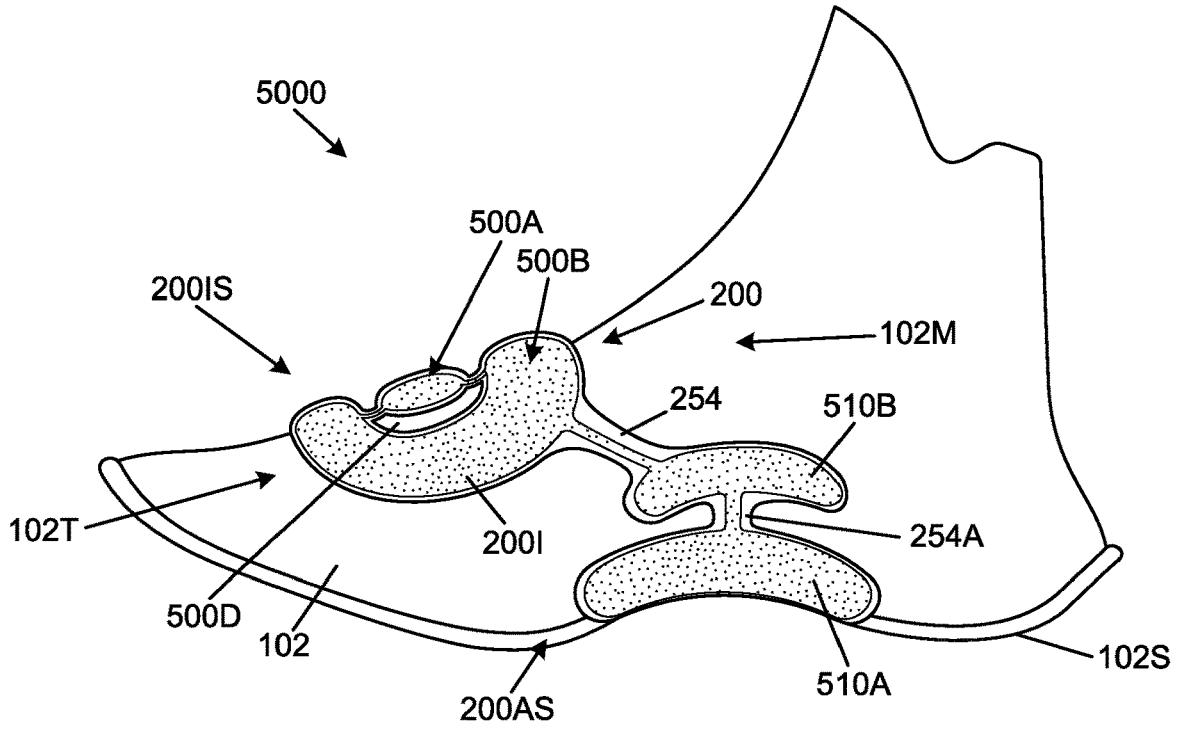
Figure 5C:
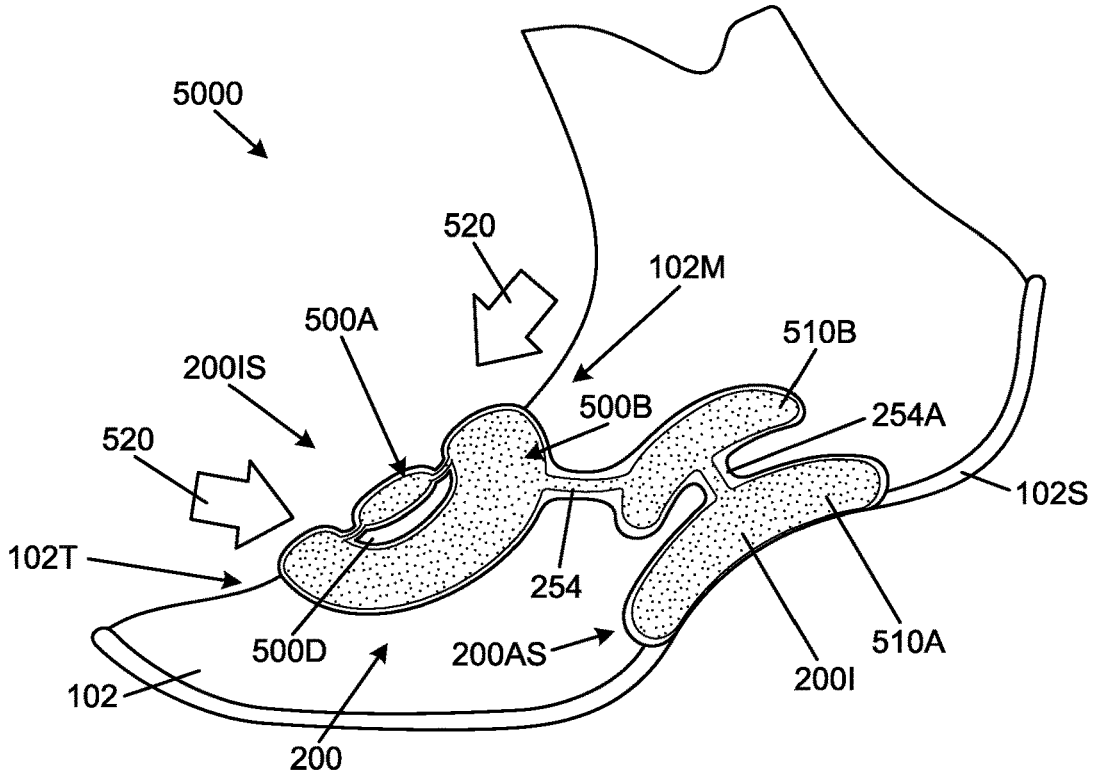

FIGS. 5A-5C illustrate another example upper blank 5000—in flat form (FIG. 5A), shaped to engage a sole structure (FIG. 5B), and in use (FIG. 5C). This upper blank 5000 includes an instep based bladder chamber portion 200IS and an arch supporting bladder chamber portion 200AS connected by a fluid line 254 and in open fluid communication. Where the same reference numbers are used in FIGS. 5A-5C as used in FIGS. 1A-4B, the same or similar parts are intended (with any of the features, alternatives, or options for that part described above), and much of the overlapping disclosure may be omitted. Also, while the upper blank 5000 illustrated in FIGS. 5A-5C is for a right shoe, a complementary left upper blank 5000 for the left shoe of a pair of shoes may have a structure that is the mirror image of the structures shown in FIGS. 5A-5C. The following discussion of FIGS. 5A-5C will focus on differences between this illustrated example structure and those described above in conjunction with FIGS. 1A-4B.

In the example of FIGS. 5A-5C, the instep based bladder chamber portion 200IS includes: (a) an inner bladder chamber portion 500A (e.g., an inner ring or disk), and (b) an outer bladder chamber portion 500B (e.g., an outer ring) at least partially surrounding (and in some examples, completely surrounding) an outer perimeter edge of the inner bladder chamber portion 500A. One or more seams (e.g., where interior surfaces of the thermoplastic layers forming the bladder system 200 are engaged (e.g., welded or bonded) together) may define and separate the inner bladder chamber portion 500A from the outer bladder chamber portion 500B. Two seams 500C and 500D are shown in the example of FIGS. 5A-5C. The inner bladder chamber portion 500A and the outer bladder chamber portion 500B may be in fluid communication with one another, e.g., through one or more spaces or gaps 500G in or between the seams 500C, 500D (the seam gap(s) 500G may be considered a connecting fluid line between inner bladder portion 500A and outer bladder portion 500B). An instep based chamber portion 200IS of this type could be used in any of the example structures described above in conjunction with FIGS. 1A-4B and/or any of the other structures described below. The bladder system 200 may be engaged with the footwear upper base 102 in any desired manner, including any of the manners described above.

Fluid line 254 connects the outer bladder chamber portion 500B of this example with the arch supporting bladder chamber portion 200AS. The arch supporting bladder chamber portion 200AS of this example also differs from the other structures described above in conjunction with FIGS. 1A-4B. As shown in FIGS. 5A-5C, in this example, the arch supporting bladder chamber portion 200AS includes an elongated base arch support chamber portion 510A and at least one additional elongated arch support chamber portion providing fluid to the elongated base arch support chamber portion 510A. In the example of FIGS. 5A-5C, one elongated arch support chamber portions 510B is provided, although more could be provided in other examples of this technology (e.g., like the two elongated arch support chamber portions 400B, 400C shown in the example of FIGS. 4A-4B). The arch support chamber portions of this example are arranged such that the elongated arch support chamber portion 510B is engaged with the fluid line 254 and at least a portion of the elongated base arch support chamber portion 510A is located below (and/or spaced downward and/or inward from) at least a portion of the elongated arch support chamber portion 510B on the footwear upper base 102. Fluid line 254A connects the elongated arch support chamber portion 510B with the elongated base arch support chamber portion 510A.

Alternatively, if desired, two or more fluid lines may connect any one or more: (a) the instep bladder chamber portion 200IS with the elongated arch support chamber portion 510B, (b) the elongated arch support chamber portion 510B with the elongated base arch support chamber portion 510A, and/or (c) the instep bladder chamber portion 200IS with the elongated base arch support chamber portion 510A. Any other desired manner of providing fluid communication between the instep based bladder chamber portion 200IS and the arch supporting bladder chamber portion 200AS may be used in other examples of this technology.

In the example shown in FIGS. 5A-5C, the elongated base arch support chamber portion 510A has a greater central axial length (dimension $L_A$) (in the front-to-back direction of the footwear upper blank 5000) than the central axial length (dimension $L_B$) of the elongated arch support chamber portion 510B. In some examples, $L_A$ will be between $1.05\times L_B$ and $3\times L_B$, between $1.1\times L_B$ and $2.5\times L_B$, and in some examples between $1.2\times L_B$ and $2.2\times L_B$. Alternatively, in some examples, the elongated base arch support chamber portion 510A may have the same or a smaller central axial length than the central axial length of the elongated arch support chamber portion 510B (e.g., similar to the relative sizes shown in FIGS. 4A-4B). In some more specific examples, $L_A$ may be between $0.25\times L_B$ and $1\times L_B$.

While FIGS. 5A-5C show the base arch support chamber portion 510A and the elongated arch support chamber portion 510B and their associated fluid lines on the medial side of the footwear upper blank 5000, if desired, the same or similar structures could be provided on only the lateral side of the footwear upper blank 5000 or on both the lateral side and the medial side of the footwear upper blank 5000. Thus, if desired, the view shown in FIG. 5B could be a lateral side view of the footwear upper blank 5000 or a view of both sides of footwear upper blank 5000.

The footwear upper blank 5000 shown in FIGS. 5A-5C may be engaged with a sole structure 104 of any of the types described above and/or in any of the manners described above. One or more of the fluid lines 254, 254A, the elongated base arch support chamber portion 510A, and/or the elongated arch support chamber portion 510B may extend through one or more recesses in the sole structure, e.g., such as recesses 104R in a sole structure 104 (e.g., midsole component 104M) in the manners described above for FIGS. 1A-2B.

In use, as a wearer bends his/her foot in the instep region (e.g., when taking a step, initiating a jump, landing a jump, etc.), force is applied to the instep based bladder chamber portion 200IS. See force arrows 520 in FIG. 5C. Additionally or alternatively, a lace 110, a strap system, and/or other footwear securing system may apply force to the instep based bladder chamber portion 200IS. Force applied in any and/or all of these manners moves fluid down fluid line 254 to the arch supporting bladder portion 200AS to increase fluid pressure and/or volume in the elongated arch support chamber portion 510B and the elongated base arch support chamber portion 510A. The entire interior volume 200I of the bladder system 200 may be in open fluid communication to facilitate movement of fluid.

Figure 6A:
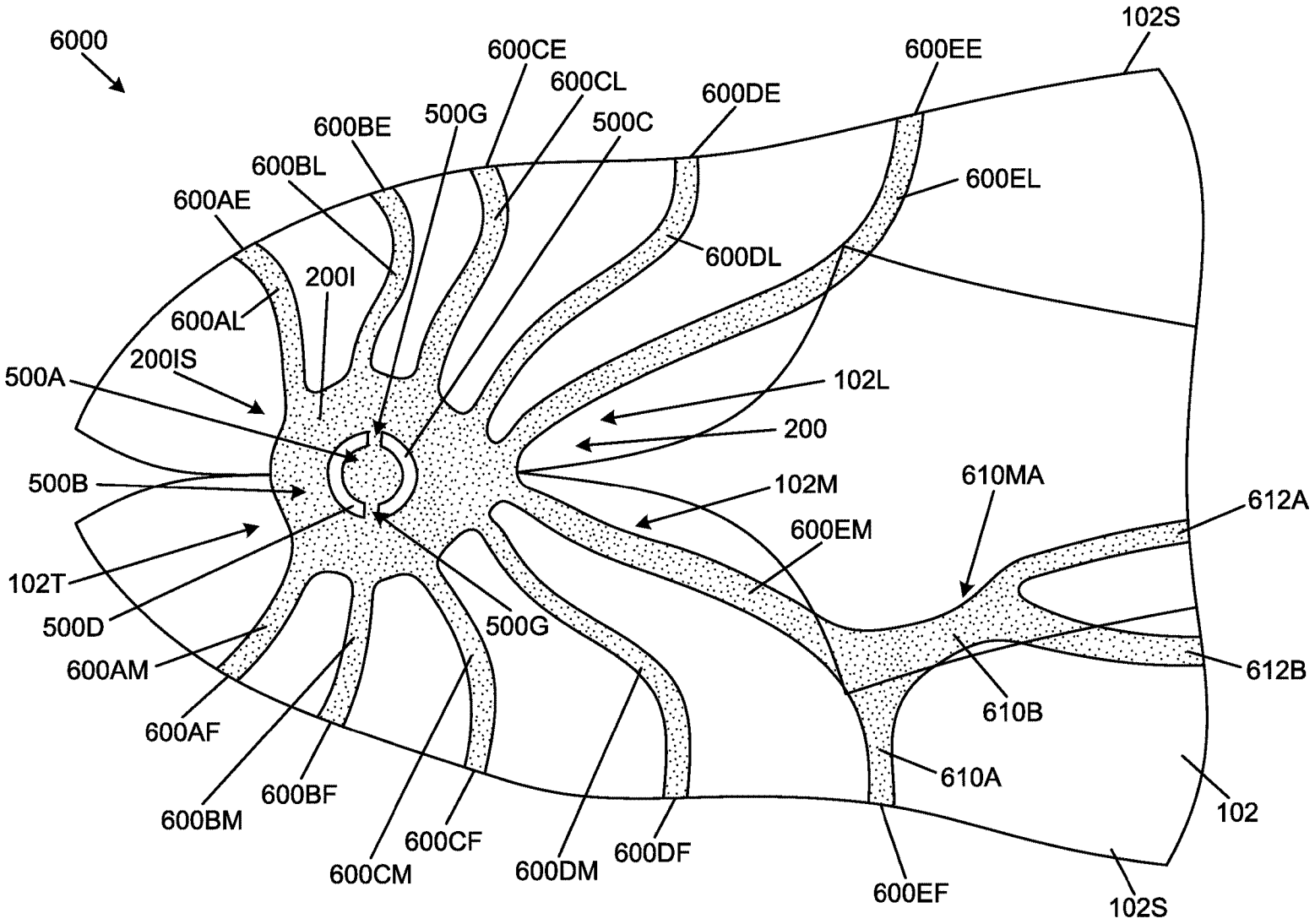
FIGS. 6A-6B provide views of another upper blank and a side of a footwear upper and components thereof in accordance with some aspects of this technology.
Figure 6B:
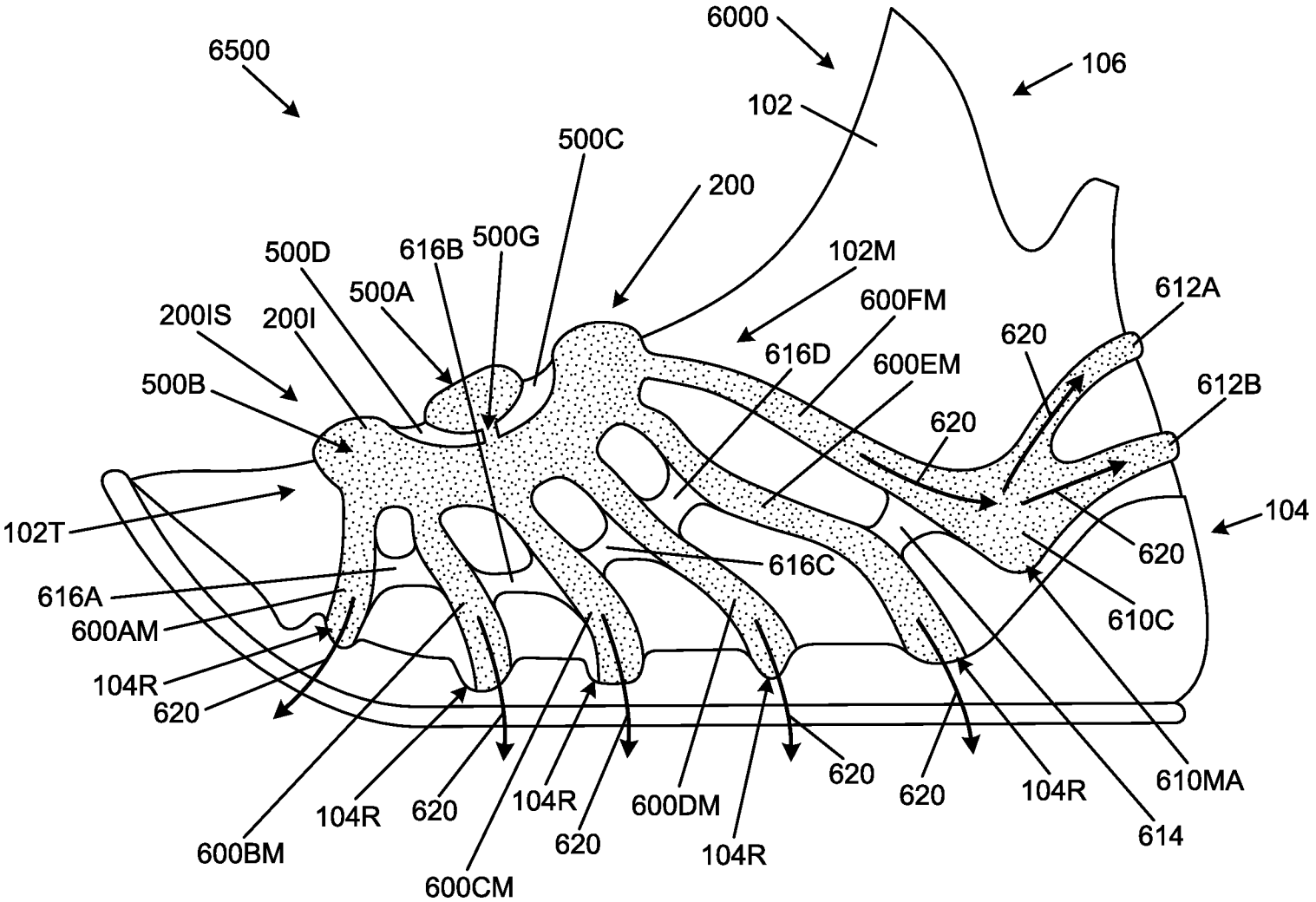

FIGS. 6A-6B illustrate other example upper blanks 6000—in flat form (FIG. 6A) and engaged with a sole structure 104 (FIG. 6B). This upper blank 6000 includes an instep based bladder chamber portion 200IS and a foot supporting bladder system connected with the instep based bladder chamber portion 200IS and in open fluid communication with it. Where the same reference numbers are used in FIGS. 6A-6B as used in FIGS. 1A-5C, the same or similar parts are intended (with any of the features, alternatives, or options for that part described above), and much of the overlapping disclosure may be omitted. Also, while the upper blank 6000 illustrated in FIGS. 6A-6B is for a right shoe, a complementary left upper blank 6000 for the left shoe of a pair of shoes may have a structure that is the mirror image of the structures shown in FIGS. 6A-6B. The following discussion of FIGS. 6A-6B focuses on differences between this illustrated example structure and those described above in conjunction with FIGS. 1A-5C.

In the examples of FIGS. 6A-6B, the instep based bladder chamber portion 200IS includes: (a) an inner bladder chamber portion 500A (e.g., an inner ring or disk), and (b) an outer bladder chamber portion 500B (e.g., an outer ring) at least partially surrounding (and in some examples, completely surrounding) an outer perimeter of the inner bladder chamber portion 500A. One or more seams (e.g., where interior surfaces of the thermoplastic layers forming the bladder system 200 are engaged (e.g., welded or bonded) together) may define and separate the inner bladder chamber portion 500A from the outer bladder chamber portion 500B. Two seams 500C and 500D are shown in the example of FIGS. 6A-6B. The inner bladder chamber portion 500A and the outer bladder chamber portion 500B may be in fluid communication with one another, e.g., through one or more gaps 500G in or between the seams 500C, 500D. The seam gap(s) 500G may be considered a connecting fluid line between inner bladder portion 500A and outer bladder portion 500B. An instep based chamber portion 200IS of this type could be used in any of the example structures described above in conjunction with FIGS. 1A-4B and/or any of the other structures described below. The bladder system 200 may be engaged with the footwear upper base 102 in any desired manner, including any of the manners described above.

In this illustrated example, the foot support bladder system includes one or more elongated foot support chambers. More specifically, this example foot supporting bladder system includes at least: (i) a first instep chamber (e.g., at least one of inner bladder chamber portion 500A and/or outer bladder chamber portion 500B) engaged with the instep region 102T of the footwear upper base 102, (ii) a first lateral elongated foot support chamber (e.g., one of 600AL to 600EL) extending from the first instep chamber (e.g., from outer bladder chamber portion 500B) down and/or along the lateral side region 102L of the footwear upper base 102, wherein the first lateral elongated foot support chamber (e.g., one of 600AL to 600EL) is in fluid communication with the first instep chamber (e.g., outer bladder chamber portion 500B), and (iii) a first medial elongated foot support chamber (e.g., one of 600AM to 600EM) extending from the first instep chamber (e.g., from outer bladder chamber portion 500B) down and/or along the medial side region 102M of the footwear upper base 102, wherein the first medial elongated foot support chamber (e.g., one of 600AM to 600EM) is in fluid communication with the first instep chamber (e.g., outer bladder chamber portion 500B).

This example foot supporting bladder system further includes a second lateral elongated foot support chamber (e.g., one of 600BL to 600EL) extending from the first instep chamber (e.g., outer bladder chamber portion 500B) and down and/or along the lateral side region 102L of the footwear upper base 102. This second lateral elongated foot support chamber (e.g., one of 600BL to 600EL) is in fluid communication with the first instep chamber (e.g., outer bladder chamber portion 500B). Also, this second lateral elongated foot support chamber (e.g., one of 600BL to 600EL) originates rearward of a corresponding origination location of the first lateral elongated foot support chamber (e.g., one of 600AL to 600DL). The terms "originates" and "origination location" as used herein mean an end of the elongated foot support chamber—e.g., either a free end (600AE to 600EE) thereof or a location where the elongated foot support chamber extends outward from the first instep chamber (e.g., outer bladder chamber portion 500B).

This example foot supporting bladder system further includes a third lateral elongated foot support chamber (e.g., one of 600CL to 600EL) extending from the first instep chamber (e.g., outer bladder chamber portion 500B) and down and/or along the lateral side region 102L of the footwear upper base 102. This third lateral elongated foot support chamber (e.g., one of 600CL to 600EL) is in fluid communication with the first instep chamber (e.g., outer bladder chamber portion 500B). Also, this third lateral elongated foot support chamber (e.g., one of 600CL to 600EL) originates rearward of a corresponding origination location of the second lateral elongated foot support chamber (e.g., 600BL).

This example foot supporting bladder system further includes a fourth lateral elongated foot support chamber (e.g., one of 600DL to 600EL) extending from the first instep chamber (e.g., outer bladder chamber portion 500B) and down and/or along the lateral side region 102L of the footwear upper base 102. This fourth lateral elongated foot support chamber (e.g., one of 600DL to 600EL) is in fluid communication with the first instep chamber (e.g., outer bladder chamber portion 500B). Also, this fourth lateral elongated foot support chamber (e.g., one of 600DL to 600EL) originates rearward of a corresponding origination location of the third lateral elongated foot support chamber (e.g., 600CL).

This example foot supporting bladder system further includes a fifth lateral elongated foot support chamber (e.g., 600EL) extending from the first instep chamber (e.g., outer bladder chamber portion 500B) and down and/or along the lateral side region 102L of the footwear upper base 102. This fifth lateral elongated foot support chamber (e.g., 600EL) is in fluid communication with the first instep chamber (e.g., outer bladder chamber portion 500B).

Also, this fifth lateral elongated foot support chamber (e.g., 600EL) originates rearward of a corresponding origination location of the fourth lateral elongated foot support chamber (e.g., 600DL).

This example foot supporting bladder system further includes a second medial elongated foot support chamber (e.g., one of 600BM to 600EM) extending from the first instep chamber (e.g., outer bladder chamber portion 500B) and down and/or along the medial side region 102M of the footwear upper base 102. This second medial elongated foot support chamber (e.g., one of 600BM to 600EM) is in fluid communication with the first instep chamber (e.g., outer bladder chamber portion 500B). Also, this second medial elongated foot support chamber (e.g., one of 600BM to 600EM) originates rearward of a corresponding origination location of the first medial elongated foot support chamber (e.g., one of 600AM to 600DM). The terms "originates" and "origination location" as used herein mean an end of the elongated foot support chamber—e.g., either a free end (600AF to 600EF) thereof or a location where the elongated foot support chamber extends outward from the first instep chamber (e.g., outer bladder chamber portion 500B).

This example foot supporting bladder system further includes a third medial elongated foot support chamber (e.g., one of 600CM to 600EM) extending from the first instep chamber (e.g., outer bladder chamber portion 500B) and down and/or along the medial side region 102M of the footwear upper base 102. This third medial elongated foot support chamber (e.g., one of 600CM to 600EM) is in fluid communication with the first instep chamber (e.g., outer bladder chamber portion 500B). Also, this third medial elongated foot support chamber (e.g., one of 600CM to 600EM) originates rearward of a corresponding origination location of the second medial elongated foot support chamber (e.g., 600BM).

This example foot supporting bladder system further includes a fourth medial elongated foot support chamber (e.g., one of 600DM to 600EM) extending from the first instep chamber (e.g., outer bladder chamber portion 500B) and down and/or along the medial side region 102M of the footwear upper base 102. This fourth medial elongated foot support chamber (e.g., one of 600DM to 600EM) is in fluid communication with the first instep chamber (e.g., outer bladder chamber portion 500B). Also, this fourth medial elongated foot support chamber (e.g., one of 600DM to 600EM) originates rearward of a corresponding origination location of the third medial elongated foot support chamber (e.g., 600CM).

This example foot supporting bladder system further includes a fifth medial elongated foot support chamber (e.g., 600EM) extending from the first instep chamber (e.g., outer bladder chamber portion 500B) and down and/or along the medial side region 102M of the footwear upper base 102. This fifth medial elongated foot support chamber (e.g., 600EM) is in fluid communication with the first instep chamber (e.g., outer bladder chamber portion 500B). Also, this fifth medial elongated foot support chamber (e.g., 600EM) originates rearward of a corresponding origination location of the fourth medial elongated foot support chamber (e.g., 600DM).

The example bladder system 200 shown in FIG. 6A further includes a medial ankle support bladder region 610MA. The medial ankle support bladder region 610MA of FIG. 6A branches from and is in fluid communication with the fifth medial elongated foot support chamber 600EM. At the forward end of the medial ankle support bladder region 610MA, the fifth medial elongated foot support chamber 600EM branches to form: (a) a first portion 610A extending to the free end 600EF of the fifth elongated foot support chamber 600EM and (b) a second portion 610B forming a heel and/or ankle support bladder chamber. The rear end of the medial ankle support bladder region 610MA of this example forms at least one fluid line (two fluid lines 612A, 612B shown) that extends rearward to an area around and at the rear heel and/or ankle area of the footwear upper base 102.

Further, while FIG. 6A shows the ankle support bladder region 610MA on the medial side of the footwear upper base 102, alternatively, if desired, the same or a similar ankle support bladder region could be provided on the lateral side of the footwear upper base 102 (e.g., region 610MA could branch from fifth lateral elongated foot support chamber 600EL in the same manner described above and shown in FIG. 6A). As another option, both the lateral side and the medial side of the footwear upper base 102 could include such ankle support bladder regions (like region 610MA). If both sides include an ankle support bladder region (like region 610MA), the one or more fluid lines 612A, 612B, if present on both sides, could be separate from one another (ending at free ends). As another alternative, if both sides include an ankle support bladder region (like region 610MA), the one more fluid lines 612A, 612B, if present on both sides, could join together to place the medial ankle support bladder region 610MA in direct fluid communication with the lateral ankle support bladder region.

FIG. 6B shows a footwear structure 6500 including an upper blank 6000 similar to that shown in FIG. 6A engaged with a sole structure 104. As shown in FIG. 6B, the sole structure 104 includes spaced apart recesses 104R through which the free ends 600AF to 600EF of the first to fifth medial elongated foot support chambers 600AM to 600EM extend. Similar recesses 104R may be provided on the lateral side to accommodate chambers 600AL to 600EL and to receive free ends 600AE to 600EE. The recesses 104R allow the first to fifth medial elongated foot support chambers 600AM to 600EM and/or the first to fifth lateral elongated foot support chambers 600AL to 600EL to extend to an underfoot location without pinching the fluid line closed at the footwear upper base 102/sole structure 104 junction.

The upper blank 6000 of FIG. 6B differs from the upper blank 6000 shown in FIG. 6A. In the example of FIG. 6B, the upper blank 6000 includes a sixth medial elongated foot support chamber 600FM that extends rearward along the footwear upper base 102 to and is in fluid communication with a medial ankle support bladder region 610MA (rather than having medial ankle support bladder region 610MA as part of the fifth medial elongated foot support chamber 600EM). This example medial ankle support bladder region 610MA includes a medial base region 610C that is in fluid communication with both the fifth medial elongated foot support chamber 600EM (via fluid line 614) and the sixth medial elongated foot support chamber 600FM. Also, in this illustrated example, at least one elongated fluid line (two elongated fluid lines 612A and 612B shown in FIG. 6B) extends from the medial base region 610C and around to a rear heel or ankle region of the footwear upper base 102.

FIG. 6B further illustrates: (a) interconnection 616A between the first medial elongated foot support chamber 600AM and the second medial elongated foot support chamber 600BM, (b) interconnection 616B between the second medial elongated foot support chamber 600BM and the third medial elongated foot support chamber 600CM, (c) interconnection 616C between the third medial elongated foot support chamber 600CM and the fourth medial elongated foot support chamber 600DM, and (d) interconnection 616D between the fourth medial elongated foot support chamber 600DM and the fifth medial elongated foot support chamber 600EM. One or more of these interconnections 616A to 616D, when present, may include open fluid lines that allow fluid to flow between the connected chambers. Additionally or alternatively, one or more of these interconnections 616A to 616D, when present, may comprise supporting webs of material that do not support fluid flow (e.g., welded or seamed portions of the thermoplastic materials making up the bladder system 200). Additionally or alternatively, similar interconnections could be provided between any two or more of the first to fifth lateral elongated foot support chambers 600AL to 600EL shown in FIG. 6A. These interconnections (e.g., 616A to 616D) may help define the shape of the bladder system 200 when inflated, may help the bladder system 200 maintain its desired shape in use, may help maintain the relative positioning of the elongated foot support chambers 600AM to 600EM and/or 600AL to 600EL, may help securely engage the bladder system 200 with the footwear upper base 102, and/or may help prevent the elongated foot support chambers 600AM to 600EM and/or 600AL to 600EL from snagging on something in use. Any number of such interconnections 616A-616D may be provided at any desired location(s) on the footwear upper base 102, and the interconnection(s) 616A-616D, when present, may have any desired size, shape, location, number, and/or ornamental appearance.

While FIG. 6B shows the sixth elongated foot support chamber 600FM, the ankle support bladder region 610MA, the connecting fluid line 614, and the fluid lines 612A, 612B on the medial side of the footwear upper base 102, alternatively, if desired, the same or a similar ankle support bladder region could be provided on the lateral side of the footwear upper base 102 (e.g., the view shown in FIG. 6B could constitute the lateral side of the footwear structure 6500). As another option, both the lateral side and the medial side of the footwear upper base 102 could include such ankle support bladder regions (like region 610MA). If both sides include an ankle support bladder region (like region 610MA), the one or more fluid lines 612A, 612B, if present on both sides, could be separate from one another extending to the rear heel area and ending at free ends. As another alternative, if both sides include an ankle support bladder region (like region 610MA), the one more fluid lines 612A, 612B, if present on both sides, could join together to place the medial ankle support bladder region 610MA in direct fluid communication with the lateral ankle support bladder region.

In the examples shown in FIGS. 6A and 6B, each lateral elongated foot support chamber 600AL to 600EL is in fluid communication with the outer bladder chamber portion 500B.

Similarly, in these examples, each medial elongated foot support chamber 600AM to 600FM is in fluid communication with the outer bladder chamber portion 500B. In fact, in these illustrated examples, the entire interior 200I of the bladder assembly 200 is in open fluid communication to allow free transfer of fluid throughout the interior chamber 200I.

In use, as a wearer bends his/her foot in the instep region (e.g., when taking a step, initiating a jump, landing a jump, etc.) and/or as a lace or strap is tightened around a wearer's foot, force is applied to the instep based bladder chamber portion 200IS (e.g., to exterior major surfaces of inner bladder chamber portion 500A and/or outer bladder chamber portion 500B). Such applied force at the instep based bladder chamber portion 200IS moves fluid into and down and/or along the elongated foot support chambers 600AL to 600EL and 600AM to 600EM (or 600FM) and/or to the ankle support bladder region(s) 610MA (when present) and/or fluid lines 612A, 612B (when present). See fluid flow arrows 620 in FIG. 6B. The increased fluid volume and/or pressure in the elongated foot support chambers 600AL to 600EL and 600AM to 600EM (or 600FM) and/or to the ankle support bladder region(s) 610MA (when present) and/or fluid lines 612A, 612B (when present) provide additional support for the foot regions at the fluid chamber locations.

Figure 7A:
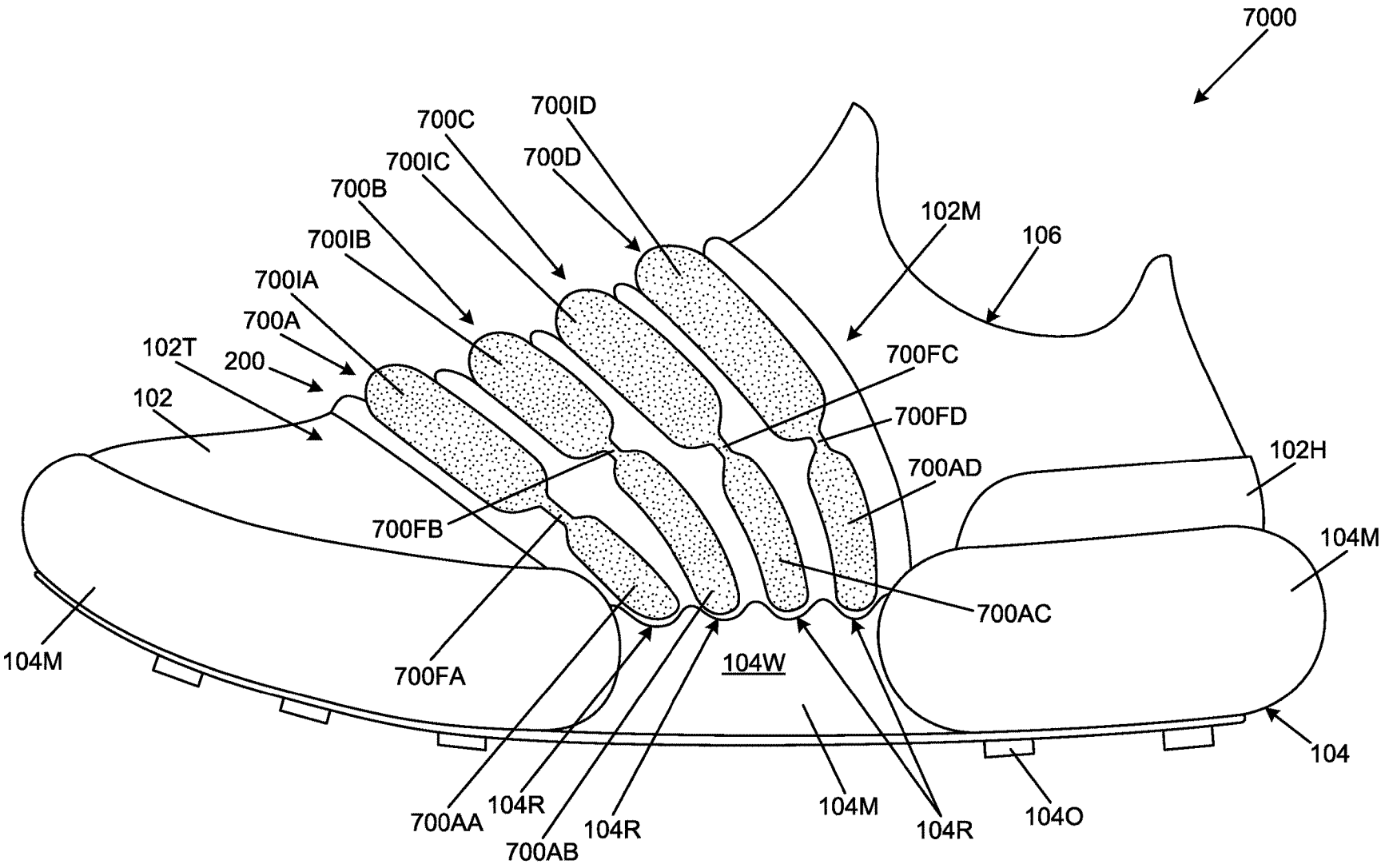
FIGS. 7A-7C provide side views of another article of footwear in accordance with some aspects of this technology.
Figure 7B:
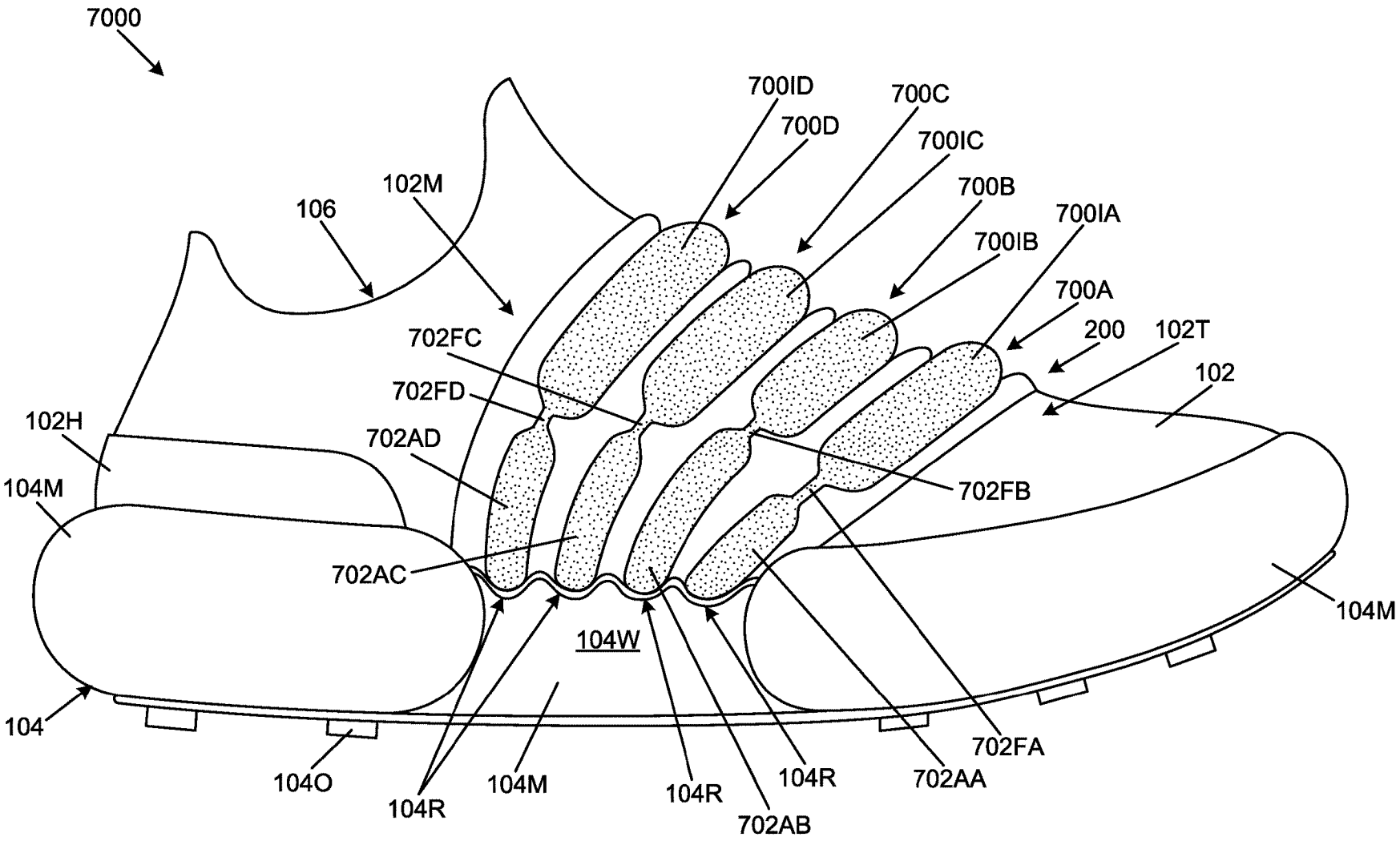
Figure 7C:
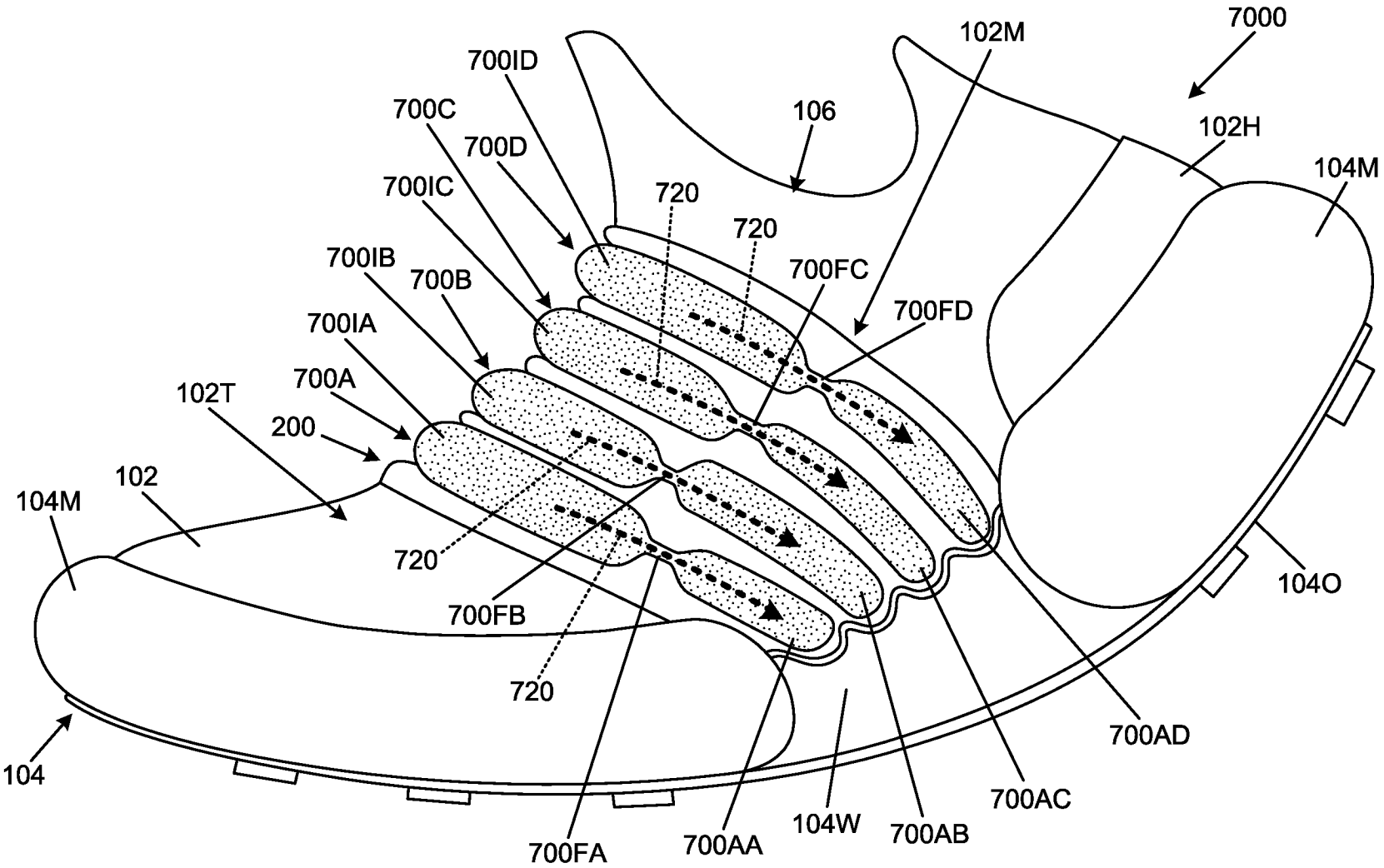

FIGS. 7A-7C provide various views of an article of footwear 7000 in accordance with some examples of this technology. FIG. 7A is a medial side view; FIG. 7B is a lateral side view; and FIG. 7C is an "in use" view. Where the same reference numbers are used in FIGS. 7A-7C as used in FIGS. 1A-6B, the same or similar parts are intended (with any of the features, alternatives, or options for that part described above), and much of the overlapping disclosure may be omitted. Also, while the article of footwear 7000 illustrated in FIGS. 7A-7C is for a right shoe, a complementary left article of footwear of a pair of shoes may have a structure that is the mirror image of the structures shown in FIGS. 7A-7C. The following discussion of FIGS. 7A-7C focuses on differences between this illustrated example structure and those described above in conjunction with FIGS. 1A-6B.

The article of footwear 7000 of FIGS. 7A-7C includes a bladder system 200 having one or more instep based bladder chambers and one or more arch supporting bladder chambers. In this illustrated example, the bladder system 200 includes two or more bladder chamber portions that are not in fluid communication with one another, e.g., that are separated from one another in the front-to-rear direction of the article of footwear 7000. A first bladder chamber portion 700A of this example includes: (a) a first (e.g., forwardmost) instep bladder chamber 700IA, (b) a first (e.g., forwardmost) arch supporting chamber 700AA, and (c) a first (e.g., forwardmost) fluid line 700FA connecting and placing the first instep bladder chamber 700IA in fluid communication with the first arch supporting chamber 700AA. In some examples, the bladder system 200 will include another bladder chamber portion, e.g., a second bladder chamber portion 700B, which may be located (e.g., spaced) rearward of the first bladder chamber portion 700A. This second example bladder chamber portion 700B includes: (a) a second instep bladder chamber 700IB, (b) a second arch supporting chamber 700AB, and (c) a second fluid line 700FB connecting and placing the second instep bladder chamber 700IB in fluid communication with the second arch supporting chamber 700AB. Additionally, some examples of bladder system 200 may include a third bladder chamber portion 700C located (e.g., spaced) rearward of the second bladder chamber portion 700B, e.g., and having: (a) a third instep bladder chamber 700IC, (b) a third arch supporting chamber 700AC, and (c) a third fluid line 700FC connecting and placing the third instep bladder chamber 700IC in fluid communication with the third arch supporting chamber 700AC. Further, some examples of bladder system 200 may include a fourth bladder chamber portion 700D located (e.g., spaced) rearward of the third bladder chamber portion 700C, e.g., and having: (a) a fourth instep bladder chamber 700ID, (b) a fourth arch supporting chamber 700AD, and (c) a fourth fluid line 700FD connecting and placing the fourth instep bladder chamber 7001D in fluid communication with the fourth arch supporting chamber 700AD. More or fewer (e.g., one or more) bladder chamber portions of the types shown at reference numbers 700A-700D may be provided in an article of footwear 7000 structure in some examples of this technology.

The arch supporting bladders (e.g., 700AA to 700AD) could be provided on only a "first side" (one of the medial or lateral sides) of the article of footwear 7000. As shown in FIG. 7B, however, the lateral side (or "second" side) of this example article of footwear 7000 also includes arch supporting chambers. More specifically, the first bladder chamber portion 700A of this example additionally includes a second arch supporting chamber 702AA connected to the first (e.g., forwardmost) instep bladder chamber 700IA via fluid line 702FA. Additionally, when present and if desired: (a) the second bladder chamber portion 700B may include a second arch supporting chamber 702AB connected to the second instep bladder chamber 700IB via fluid line 702FB; (b) the third bladder chamber portion 700C may include a third arch supporting chamber 702AC connected to the third instep bladder chamber 700IC via fluid line 702FC; and/or (c) the fourth bladder chamber portion 700D may include a fourth arch supporting chamber 702AD connected to the fourth instep bladder chamber 7001D via fluid line 702FD. Arch supporting chambers 700AA to 700AD from the first (e.g., medial) side may join together with and be in fluid communication with the arch supporting chambers 702AA to 702AD on the second (e.g., lateral) side. Alternatively, if desired, the arch supporting chambers 700AA to 700AD from the first (e.g., medial) side may remain separated from and/or not in fluid communication with the arch supporting chambers 702AA to 702AD on the second (e.g., lateral) side. As another alternative or optional feature, if desired, separate instep based bladder chambers may be provided for each side (e.g., two separate sets of instep bladder chambers 700IA-700ID may be provided—one set for each side).

FIG. 7C shows the example article of footwear 7000 bent at the instep area, e.g., when taking a step. Such bending applies force to the instep based bladder chamber(s) 7001A to 7001D. This applied force at the instep based bladder chamber(s) 7001A to 700ID moves fluid through fluid lines 700FA to 700FD (and, when present, 702FA to 702FD) and into the arch supporting chambers 700AA to 700AD (and, when present, 702AA to 702AD).

See fluid flow arrows 720 in FIG. 7C. The increased fluid volume and/or pressure in the arch supporting chambers 700AA to 700AD (and, when present, 702AA to 702AD) provides additional support for the side and arch regions of the wearer's foot.

Figure 8A:
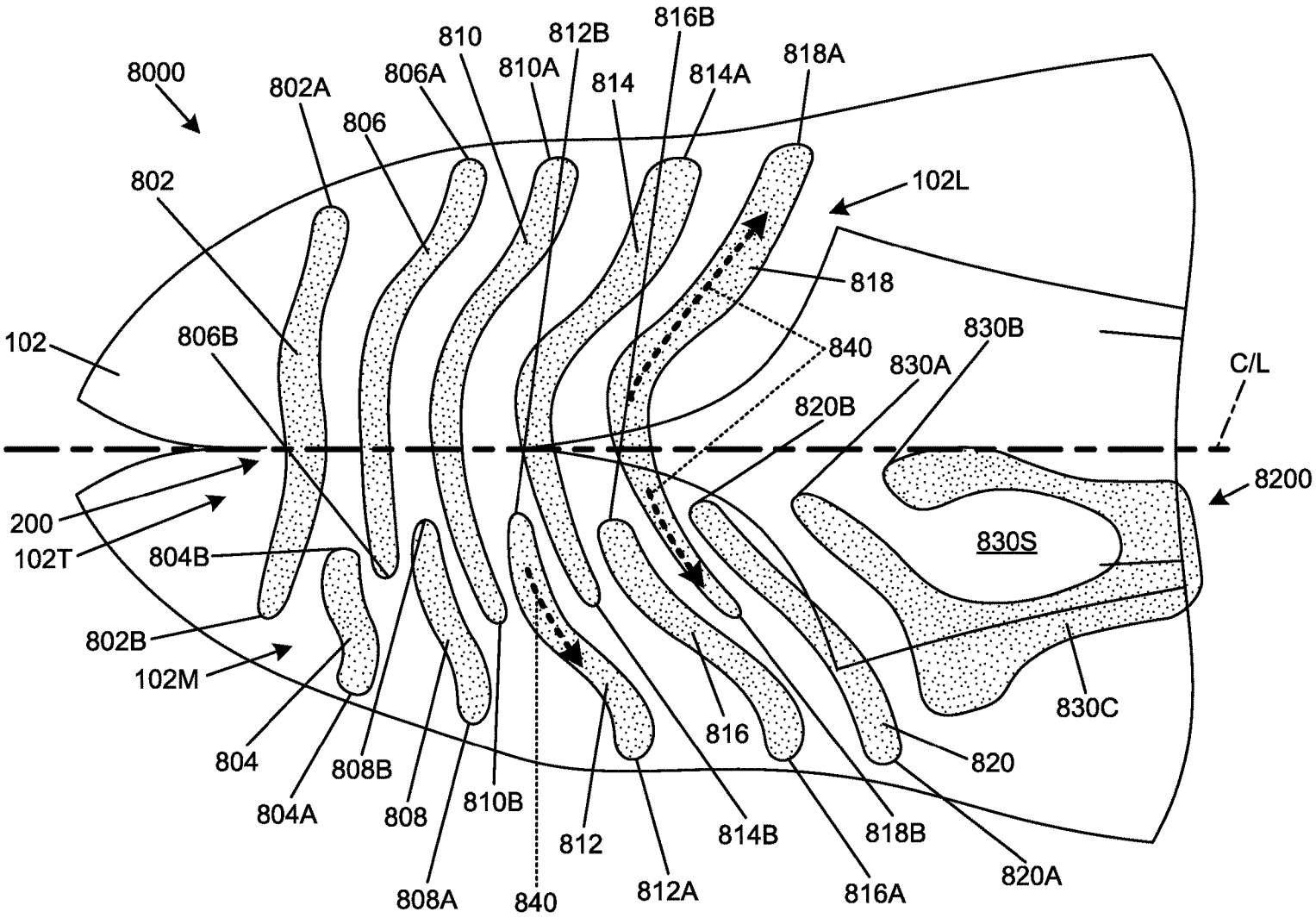
FIGS. 8A-8B provide views of another upper blank and a side of an article of footwear and components thereof in accordance with some aspects of this technology.
Figure 8B:
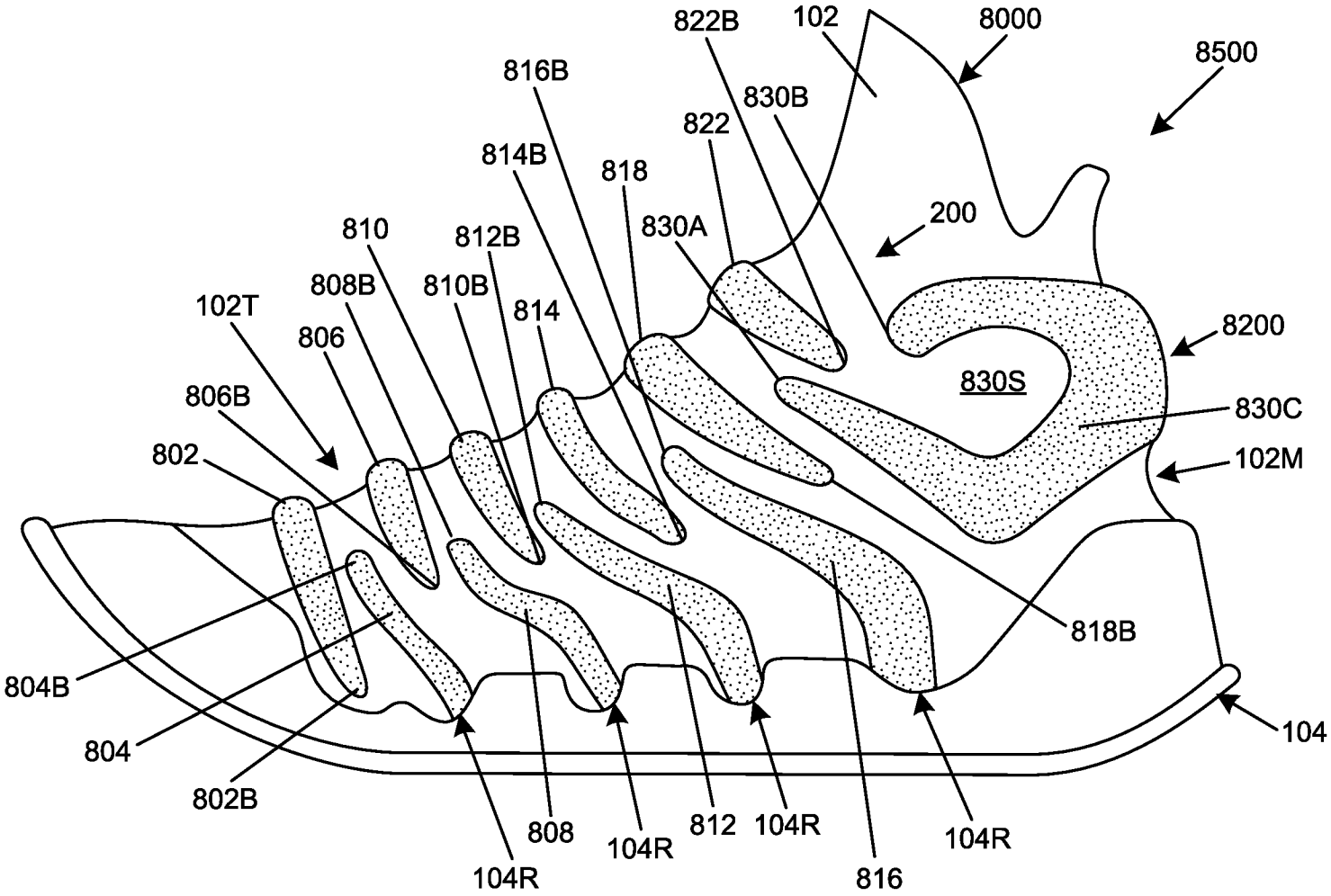

FIGS. 8A-8B provide various views of an upper blank 8000 and an article of footwear 8500 including an upper blank 8000 in accordance with some examples of this technology. FIG. 8A provides a top view of the upper blank 8000 and FIG. 8B provides a side view of the article of footwear 8500. FIG. 8B could constitute a medial side view or a lateral side view, and the upper blank 8000 and article of footwear 8500 of FIGS. 8A and 8B could provide an ankle support bladder chamber 8200 on either or both of the lateral side or the medial side of a footwear upper base 102 and/or an article of footwear 8500. Where the same reference numbers are used in FIGS. 8A-8B as used in FIGS. 1A-7C, the same or similar parts are intended (with any of the features, alternatives, or options for that part described above), and much of the overlapping disclosure may be omitted. Also, while the upper blank 8000 and article of footwear 8500 illustrated in FIGS. 8A-8B are for a right shoe, a complementary left article of footwear of a pair of shoes may have a structure that is the mirror image of the structures shown in FIGS. 8A-8B. The following discussion of FIGS. 8A-8B focuses on differences between this illustrated example structure and those described above in conjunction with FIGS. 1A-7C.

As shown in FIGS. 8A-8B, the footwear upper blank 8000 includes a footwear upper base 102 formed from one or more component parts, e.g., of any of the various types described above. The footwear upper base 102 includes: (i) an instep region 102T (which includes a central forefoot region), (ii) a first side region 102L extending (e.g., downward and rearward) from the instep region 102T, and (iii) a second side region 102M extending (e.g., downward and rearward) from the instep region 102T. The footwear upper base 102 may be engaged with a sole structure 104, e.g., including one or more midsole components and/or one or more outsole components, including sole structures 104 of any of the various types described above.

This example footwear upper blank 8000 and article of footwear 8500 includes a bladder system 200 having a plurality of bladder chambers extending along the footwear upper base 102 to support the wearer's foot. The bladder chambers shown in FIGS. 8A-8B are in a "staggered" arrangement in the front-to-back direction with bladder chambers originating on one side of the upper blank 8000 and/or article of footwear 8500 alternating with bladder chambers originating on the other side of the upper blank 8000 and/or article of footwear 8500. In this illustrated example, the plurality of bladder chambers are not in fluid communication with one another. If desired, however, any two or more of the illustrated bladder chambers could be placed in fluid communication with one another (e.g., through a connecting fluid line). The illustrated example bladder chambers will be described in more detail below. The bladder systems 200 shown in FIGS. 8A and 8B differ somewhat from one another, and at least some of these differences will be described in more detail below.

The bladder system 200 of FIGS. 8A and 8B includes a first elongated bladder chamber 802 having a first end 802A located in the first side region 102L and a second end 802B located in the instep region 102T or the second side region 102M. As shown in FIGS. 8A and 8B, the first elongated bladder chamber 802 of this example extends across a front-to-rear centerline C/L of the footwear upper base 102 in the instep region 102T (e.g., first elongated bladder chamber 802 extends from the lateral side to the medial side of the footwear upper base 102 across the instep region 102T). If desired, the first elongated bladder chamber 802 could extend to an area beneath the plantar support surface of the footwear upper base 102 (e.g., through a recess 104R in the sole structure 104), optionally concealing the first end 802A between the bottom surface of the footwear upper base 102 and the sole structure 104.

This example bladder system 200 further includes a second elongated bladder chamber 804 spaced rearward from the first elongated bladder chamber 802 on the footwear upper base 102. The second elongated bladder chamber 804 of this example is not in fluid communication with the first elongated bladder chamber 802 (or any other bladder chamber described in more detail below). The second elongated bladder chamber 804 has a first end 804A located in the second side region 102M and a second end 804B located in the instep region 102T or the second side region 102M. Thus, as shown in FIGS. 8A-8B, the second elongated bladder chamber 804 of this example does not extend across the front-to-rear centerline C/L of the footwear upper base 102 (e.g., all portions of second elongated bladder chamber 804 are located only on the medial side or only on the lateral side of the footwear upper base 102 in the instep region 102T). If desired, the second elongated bladder chamber 804 could extend to an area beneath the plantar support surface of the footwear upper base 102 (e.g., through a recess 104R in the sole structure 104), optionally concealing the first end 804A between the bottom surface of the footwear upper base 102 and the sole structure 104.

The bladder system 200 of FIGS. 8A-8B further includes a third elongated bladder chamber 806 spaced rearward from the first elongated bladder chamber 802 and/or the second elongated bladder chamber 804 on the footwear upper base 102. The third elongated bladder chamber 806 of this example is not in fluid communication with the first elongated bladder chamber 802 or the second elongated bladder chamber 804 (or any other bladder chamber described in more detail below). The third elongated bladder chamber 806 has a first end 806A located in the first side region 102L and a second end 806B located in the instep region 102T or the second side region 102M. As shown in FIGS. 8A and 8B, the third elongated bladder chamber 806 of this example extends across a front-to-rear centerline C/L of the footwear upper base 102 in the instep region 102T (e.g., third elongated bladder chamber 806 extends from the lateral side to the medial side of the footwear upper base 102 across the instep region 102T). If desired, the third elongated bladder chamber 806 could extend to an area beneath the plantar support surface of the footwear upper base 102 on the first side region 102L (e.g., through a recess 104R in the sole structure 104), optionally concealing the first end 806A between the bottom surface of the footwear upper base 102 and the sole structure 104. In this illustrated example, the second end 804B of the second elongated bladder chamber 804 is located between the first elongated bladder chamber 802 and the third elongated bladder chamber 806. An "end" of a bladder chamber is located "between" two other elongated bladder chambers, as those terms are used herein in this context, if a plane contacting the "end" can be oriented to intersect the two "other" elongated bladder chambers.

Bladder system 200 of FIGS. 8A-8B further includes a fourth elongated bladder chamber 808 spaced rearward from the second elongated bladder chamber 804 and/or the third elongated bladder chamber 806 on the footwear upper base 102. The fourth elongated bladder chamber 808 of this example is not in fluid communication with the first elongated bladder chamber 802, the second elongated bladder chamber 804, or the third elongated bladder chamber 806 (or any other bladder chamber described in more detail below). The fourth elongated bladder chamber 808 has a first end 808A located in the second side region 102M and a second end 808B located in the instep region 102T or the second side region 102M. Thus, as shown in FIGS. 8A-8B, the fourth elongated bladder chamber 808 of this example does not extend across the front-to-rear centerline C/L of the footwear upper base 102 (e.g., all portions of fourth elongated bladder chamber 808 are located only on the medial side or only on the lateral side of the footwear upper base 102 in the instep region 102T). If desired, the fourth elongated bladder chamber 808 could extend to an area beneath the plantar support surface of the footwear upper base 102 (e.g., through a recess 104R in the sole structure 104), optionally concealing the first end 808A between the bottom surface of the footwear upper base 102 and the sole structure 104.

The bladder system 200 of FIGS. 8A-8B further includes a fifth elongated bladder chamber 810 spaced rearward from the third elongated bladder chamber 806 and/or the fourth elongated bladder chamber 808 on the footwear upper base 102. The fifth elongated bladder chamber 810 of this example is not in fluid communication with the first elongated bladder chamber 802, the second elongated bladder chamber 804, the third elongated bladder chamber 806, or the fourth elongated bladder chamber 808 (or any other bladder chamber described in more detail below). The fifth elongated bladder chamber 810 has a first end 810A located in the first side region 102L and a second end 810B located in the instep region 102T or the second side region 102M. As shown in FIGS. 8A and 8B, the fifth elongated bladder chamber 810 of this example extends across a front-to-rear centerline C/L of the footwear upper base 102 in the instep region 102T (e.g., fifth elongated bladder chamber 810 extends from the lateral side to the medial side of the footwear upper base 102 across the instep region 102T). If desired, the fifth elongated bladder chamber 810 could extend to an area beneath the plantar support surface of the footwear upper base 102 on the first side region 102L (e.g., through a recess 104R in the sole structure 104), optionally concealing the first end 810A between the bottom surface of the footwear upper base 102 and the sole structure 104. In this illustrated example, the second end 808B of the fourth elongated bladder chamber 808 is located between the third elongated bladder chamber 806 and the fifth elongated bladder chamber 810.

Bladder system 200 of FIGS. 8A-8B further includes a sixth elongated bladder chamber 812 spaced rearward from the fourth elongated bladder chamber 808 and/or the fifth elongated bladder chamber 810 on the footwear upper base 102. The sixth elongated bladder chamber 812 of this example is not in fluid communication with the first elongated bladder chamber 802, the second elongated bladder chamber 804, the third elongated bladder chamber 806, the fourth elongated bladder chamber 808, or the fifth elongated bladder chamber 810 (or any other bladder chamber described in more detail below). The sixth elongated bladder chamber 812 has a first end 812A located in the second side region 102M and a second end 812B located in the instep region 102T or the second side region 102M. Thus, as shown in FIGS. 8A-8B, the sixth elongated bladder chamber 812 of this example does not extend across the front-to-rear centerline C/L of the footwear upper base 102 (e.g., all portions of sixth elongated bladder chamber 812 are located only on the medial side or only on the lateral side of the footwear upper base 102 in the instep region 102T). If desired, the sixth elongated bladder chamber 812 could extend to an area beneath the plantar support surface of the footwear upper base 102 (e.g., through a recess 104R in the sole structure 104), optionally concealing the first end 812A between the bottom surface of the footwear upper base 102 and the sole structure 104.

The bladder system 200 of FIGS. 8A-8B further includes a seventh elongated bladder chamber 814 spaced rearward from the fifth elongated bladder chamber 810 and/or the sixth elongated bladder chamber 812 on the footwear upper base 102. The seventh elongated bladder chamber 814 of this example is not in fluid communication with the first elongated bladder chamber 802, the second elongated bladder chamber 804, the third elongated bladder chamber 806, the fourth elongated bladder chamber 808, the fifth elongated bladder chamber 810, or the sixth elongated bladder chamber 812 (or any other bladder chamber described in more detail below). The seventh elongated bladder chamber 814 has a first end 814A located in the first side region 102L and a second end 814B located in the instep region 102T or the second side region 102M. As shown in FIGS. 8A and 8B, the seventh elongated bladder chamber 814 of this example extends across a front-to-rear centerline C/L of the footwear upper base 102 in the instep region 102T (e.g., seventh elongated bladder chamber 814 extends from the lateral side to the medial side of the footwear upper base 102 across the instep region 102T). If desired, the seventh elongated bladder chamber 814 could extend to an area beneath the plantar support surface of the footwear upper base 102 on the first side region 102L (e.g., through a recess 104R in the sole structure 104), optionally concealing the first end 814A between the bottom surface of the footwear upper base 102 and the sole structure 104. In this illustrated example, the second end 812B of the sixth elongated bladder chamber 812 is located between the fifth elongated bladder chamber 810 and the seventh elongated bladder chamber 814.

Bladder system 200 of FIGS. 8A-8B further includes an eighth elongated bladder chamber 816 spaced rearward from the sixth elongated bladder chamber 812 and/or the seventh elongated bladder chamber 814 on the footwear upper base 102. The eighth elongated bladder chamber 816 of this example is not in fluid communication with the first elongated bladder chamber 802, the second elongated bladder chamber 804, the third elongated bladder chamber 806, the fourth elongated bladder chamber 808, the fifth elongated bladder chamber 810, the sixth elongated bladder chamber 812, or the seventh elongated bladder chamber 814 (or any other bladder chamber described in more detail below). The eighth elongated bladder chamber 816 has a first end 816A located in the second side region 102M and a second end 816B located in the instep region 102T or the second side region 102M. Thus, as shown in FIGS. 8A-8B, the eighth elongated bladder chamber 816 of this example does not extend across the front-to-rear centerline C/L of the footwear upper base 102 (e.g., all portions of eighth elongated bladder chamber 816 are located only on the medial side or only on the lateral side of the footwear upper base 102 in the instep region 102T). If desired, the eighth elongated bladder chamber 816 could extend to an area beneath the plantar support surface of the footwear upper base 102 (e.g., through a recess 104R in the sole structure 104), optionally concealing the first end 816A between the bottom surface of the footwear upper base 102 and the sole structure 104.

The example bladder system 200 of FIGS. 8A-8B further includes a ninth elongated bladder chamber 818 spaced rearward from the seventh elongated bladder chamber 814 and/or the eighth elongated bladder chamber 816 on the footwear upper base 102. The ninth elongated bladder chamber 818 of this example is not in fluid communication with the first elongated bladder chamber 802, the second elongated bladder chamber 804, the third elongated bladder chamber 806, the fourth elongated bladder chamber 808, the fifth elongated bladder chamber 810, the sixth elongated bladder chamber 812, the seventh elongated bladder chamber 814, or the eighth elongated bladder chamber 816 (or any other bladder chamber described in more detail below). The ninth elongated bladder chamber 818 has a first end 818A located in the first side region 102L and a second end 818B located in the instep region 102T or the second side region 102M. As shown in FIGS. 8A and 8B, the ninth elongated bladder chamber 818 of this example extends across a front-to-rear centerline C/L of the footwear upper base 102 in the instep region 102T (e.g., ninth elongated bladder chamber 818 extends from the lateral side to the medial side of the footwear upper base 102 across the instep region 102T). If desired, the ninth elongated bladder chamber 818 could extend to an area beneath the plantar support surface of the footwear upper base 102 on the first side region 102L (e.g., through a recess 104R in the sole structure 104), optionally concealing the first end 818A between the bottom surface of the footwear upper base 102 and the sole structure 104. In this illustrated example, the second end 816B of the eighth elongated bladder chamber 816 is located between the seventh elongated bladder chamber 814 and the ninth elongated bladder chamber 818.

While not shown in FIG. 8B, FIG. 8A shows a bladder system 200 that further includes a tenth elongated bladder chamber 820 spaced rearward from the eighth elongated bladder chamber 816 and/or the ninth elongated bladder chamber 818 on the footwear upper base 102. The tenth elongated bladder chamber 820 of this example is not in fluid communication with the first elongated bladder chamber 802, the second elongated bladder chamber 804, the third elongated bladder chamber 806, the fourth elongated bladder chamber 808, the fifth elongated bladder chamber 810, the sixth elongated bladder chamber 812, the seventh elongated bladder chamber 814, the eighth elongated bladder chamber 816, or the ninth elongated bladder chamber 818 (or any other bladder chamber described in more detail below). The tenth elongated bladder chamber 820 has a first end 820A located in the second side region 102M and a second end 820B located in the instep region 102T or the second side region 102M. Thus, as shown in FIG. 8A, the tenth elongated bladder chamber 820 of this example does not extend across the front-to-rear centerline C/L of the footwear upper base 102 (e.g., all portions of tenth elongated bladder chamber 820 are located only on the medial side or only on the lateral side of the footwear upper base 102 in the instep region 102T). If desired, the tenth elongated bladder chamber 820 could extend to an area beneath the plantar support surface of the footwear upper base 102 (e.g., through a recess 104R in the sole structure 104), optionally concealing the first end 820A between the bottom surface of the footwear upper base 102 and the sole structure 104.

While not shown in FIG. 8A, FIG. 8B shows a bladder system 200 that further includes an additional elongated bladder chamber 822 spaced rearward from the ninth elongated bladder chamber 818 on the footwear upper base 102. The additional elongated bladder chamber 822 of this example is not in fluid communication with the first elongated bladder chamber 802, the second elongated bladder chamber 804, the third elongated bladder chamber 806, the fourth elongated bladder chamber 808, the fifth elongated bladder chamber 810, the sixth elongated bladder chamber 812, the seventh elongated bladder chamber 814, the eighth elongated bladder chamber 816, or the ninth elongated bladder chamber 818 (or any other bladder chamber described in more detail below). This additional elongated bladder chamber 822 has a first end (not shown in FIG. 8B but similar to first ends 802A, 806A, 810A, 814A, 818A shown in FIG. 8A) located in the first side region 102L and a second end 822B located in the instep region 102T or the second side region 102M. As shown in FIG. 8B, this additional elongated bladder chamber 822 extends across a front-to-rear centerline C/L of the footwear upper base 102 in the instep region 102T (e.g., additional elongated bladder chamber 822 extends from the lateral side to the medial side of the footwear upper base 102 across the instep region 102T). If desired, this additional elongated bladder chamber 822 could extend to an area beneath the plantar support surface of the footwear upper base 102 on the first side region 102L (e.g., through a recess 104R in the sole structure 104), optionally concealing its first end between the bottom surface of the footwear upper base 102 and the sole structure 104.

FIGS. 8A-8B further illustrate that these example bladder systems 200 include an ankle support bladder chamber 8200 located in the second side region (which may be either on the lateral side or the medial side of the footwear upper base 102 and/or article of footwear 8500). In this illustrated example, the ankle support bladder chamber 8200 includes a first free end 830A, a second free end 830B, and a continuous bladder chamber 830C (e.g., substantially C-shaped chamber 830C) extending between the first free end 830A and the second free end 830B. The continuous bladder chamber 830C may extend to a central rear ankle and/or heel area of the footwear upper base 102. The continuous bladder chamber 830C may have an elongated shape over at least a portion of its length between the first free end 830A and the second free end 830B. In the illustrated example, the continuous bladder chamber 830C is shaped to form a central open space 830S. This central open space may be positioned on the footwear upper base 102 and/or article of footwear 8500 to receive the wearer's medial malleolus or the lateral malleolus (depending on which side the ankle support bladder chamber 8200 is located).

In the example structure shown in FIG. 8B, the second free end (822B in the illustrated example) of one of the elongated bladder chambers (additional elongated bladder chamber 822 in the illustrated example) extends to a location between the first free end 830A of the ankle support bladder chamber 8200 and the second free end 830B of the ankle support bladder chamber 8200. In at least some examples of this technology, the ankle support bladder chamber 8200 will not be in fluid communication with any of the elongated bladder chambers 802-822.

As noted above, any one or more of the elongated bladder chambers 802-822 may be sized and shaped such that the elongated bladder chamber(s) 802-822 extend to an area beneath the plantar support surface of the footwear upper base 102 and such that its first end 802A-822A is located beneath the plantar support surface of the footwear upper base 102. Thus, these one or more of the elongated bladder chambers 802-822 may extend to a plantar support surface 102S in a manner similar to the structures shown in FIG. 1C. Alternatively, if desired, the first ends 802A-822A of one or more of the elongated bladder chambers 802-822 may be located at the side surface of the footwear upper base 102, e.g., supporting the side area(s) of a wearer's foot.

In use, as a wearer bends his/her foot in the instep region 102T (e.g., when taking a step, initiating a jump, landing a jump, etc.) and/or as a lace or strap is tightened around a wearer's foot (not shown in FIGS. 8A-8B), force is applied to the instep based portions of the elongated bladder chambers 802-822. This applied force at the instep areas moves fluid down the elongated bladder chambers 802-822 toward their respective first ends 802A-820A (and optionally toward second free ends 802B, 806B, 810B, 814B, 818B, 822B).

See the example fluid flow arrows 840 shown in FIG. 8A. The increased fluid volume and/or pressure at and toward the free ends of the elongated bladder chambers 802-822 provide additional support for the foot regions at the bladder chamber locations (e.g., at the sides and at the bottom of the wearer's foot).

Aspects of this technology are advantageous because the footwear provides additional arch support or other foot support using a simple system. In at least some examples of this technology, the interior bladder chamber 200I will be completely open to allow free movement of fluid under the applied forces. In the completed and inflated upper/article of footwear in accordance with some examples of this technology, no pumps (manually operated or powered), valves, electronics, and/or complicated and/or expensive mechanical/electrical parts are needed to provide the added heel and/or ankle support. Rather, the additional support can be activated simply by tightening the footwear to the wearer's foot and/or using the footwear. Alternatively, if desired, any of these hardware components could be provided. For example, some valving or fluid flow control devices (e.g., baffles) could be provided to slow the return flow of fluid after it moves to the desired support location(s), e.g., to increase the amount of time the foot is supported one the fluid moves.

While FIGS. 1A-8B illustrate various different bladder sizes, shapes, and specific configurations, many variations in bladder sizes, shapes, and/or configurations are possible without departing from this technology. The specifically illustrated bladders could be varied widely in size, shape, and/or configuration while still providing the desired functions and/or properties described above.

III. CONCLUSION

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. An article of footwear, comprising:

a footwear upper base formed from one or more component parts and including: (i) an instep region including at least one of a tongue base region or an instep base region and (ii) a first midfoot side region;

an arch supporting bladder system engaged with the footwear upper base and including: (i) a first instep chamber engaged with the instep region of the footwear upper base, (ii) a first arch support chamber located at the first midfoot side region of the footwear upper base, and (iii) a first fluid line connecting the first instep chamber and the first arch support chamber and placing the first instep chamber in fluid communication with the first arch support chamber; and a sole structure engaged with the footwear upper base, wherein the sole structure includes a first recess, wherein a first portion of at least one of the first arch support chamber or the first fluid line is received in the first recess such that the first portion extends from a first side surface of the footwear upper base to a bottom surface of the footwear upper base, and wherein the first portion is in open fluid communication through the first recess.

Clause 2. The article of footwear according to Clause 1, wherein the arch supporting bladder system further includes a second arch support chamber and a second fluid line connecting the first arch support chamber and the second arch support chamber and placing the first arch support chamber in fluid communication with the second arch support chamber.

Clause 3. The article of footwear according to Clause 2, wherein the second arch support chamber extends along the first side surface of the footwear upper base to the bottom surface of the footwear upper base.

Clause 4. The article of footwear according to Clause 2, wherein the second arch support chamber extends around a medial side edge of the footwear upper base to the bottom surface of the footwear upper base.

Clause 5. The article of footwear according to any one of Clauses 2 to 4, wherein the sole structure includes a second recess, wherein a second portion of the second arch support chamber is received in the second recess such that the second arch support chamber extends from the first side surface of the footwear upper base to the bottom surface of the footwear upper base, and wherein the second arch support chamber is in open fluid communication through the second recess.

Clause 6. The article of footwear according to Clause 2, wherein at least a portion of the second arch support chamber is located below at least a portion of the first arch support chamber on the footwear upper base.

Clause 7. The article of footwear according to any one of Clauses 2 to 6, wherein the arch supporting bladder system further includes a third arch support chamber and a third fluid line connecting the second arch support chamber and the third arch support chamber and placing the second arch support chamber in fluid communication with the third arch support chamber.

Clause 8. The article of footwear according to Clause 7, wherein at least a portion of the third arch support chamber is located below at least a portion of the second arch support chamber on the footwear upper base.

Clause 9. The article of footwear according to Clause 1 or 2, wherein the arch supporting bladder system further includes a second instep chamber engaged with the instep region of the footwear upper base and a connecting fluid line connecting the second instep chamber and the first instep chamber and placing the second instep chamber in fluid communication with the first instep chamber.

Clause 10. The article of footwear according to Clause 9, wherein the first instep chamber at least partially surrounds an outer perimeter edge of the second instep chamber.

Clause 11. The article of footwear according to Clause 9, wherein the first instep chamber fully surrounds an outer perimeter edge of the second instep chamber.

Clause 12. The article of footwear according to Clause 9, wherein the first instep chamber defines a first central axial direction and the second instep chamber defines a second central axial direction.

Clause 13. The article of footwear according to Clause 12, wherein the first central axial direction and the second central axial direction are substantially parallel.

Clause 14. The article of footwear according to any one of Clauses 9 to 13, wherein the first instep chamber includes a first free end, and wherein the second instep chamber includes a second free end.

Clause 15. The article of footwear according to Clause 14, wherein at least one of the first free end and the second free end forms a forwardmost extent of the arch supporting bladder system on the footwear upper base.

Clause 16. The article of footwear according to any one of Clauses 9 to 15, wherein the second instep chamber is a multi-bulbed chamber having a plurality of fluid bulbs in fluid communication with one another.

Clause 17. The article of footwear according to Clause 16, wherein the first instep chamber is a multi-bulbed chamber having a plurality of fluid bulbs in fluid communication with one another, and wherein a single continuous seam separates one bulb of the first instep chamber from one bulb of the second instep chamber.

Clause 18. The article of footwear according to Clause 9, wherein the first instep chamber and the second instep chamber extend in substantially parallel directions.

Clause 19. The article of footwear according to Clause 9 or 18, wherein the first instep chamber is located further forward on the foot upper base than the second instep chamber.

Clause 20. The article of footwear according to Clause 1, wherein the arch supporting bladder system further includes: (i) a second instep chamber engaged with the instep region of the footwear upper base, (ii) a second arch support chamber located at the first midfoot side region of the footwear upper base, and (iii) a second fluid line connecting the second instep chamber and the second arch support chamber and placing the second instep chamber in fluid communication with the second arch support chamber.

Clause 21. The article of footwear according to Clause 20, wherein the second arch support chamber extends around a medial side edge of the footwear upper base to the bottom surface of the footwear upper base.

Clause 22. The article of footwear according to Clause 20, wherein the sole structure includes a second recess, wherein a second portion of at least one of the second arch support chamber or the second fluid line is received in the second recess such that the second portion extends from the first side surface of the footwear upper base to the bottom surface of the footwear upper base, and wherein the second portion is in open fluid communication through the second recess.

Clause 23. The article of footwear according to any one of Clauses 20 to 22, wherein the arch supporting bladder system further includes: (i) a third instep chamber engaged with the instep region of the footwear upper base, (ii) a third arch support chamber located at the first midfoot side region of the footwear upper base, and (iii) a third fluid line connecting the third instep chamber and the third arch support chamber and placing the third instep chamber in fluid communication with the third arch support chamber.

Clause 24. The article of footwear according to Clause 23, wherein the third arch support chamber extends around a medial side edge of the footwear upper base to the bottom surface of the footwear upper base.

Clause 25. The article of footwear according to Clause 23, wherein the sole structure includes a third recess, wherein a third portion of at least one of the third arch support chamber or the third fluid line is received in the third recess such that the third portion extends from the first side surface of the footwear upper base to the bottom surface of the footwear upper base, and wherein the third portion is in open fluid communication through the third recess.

Clause 26. The article of footwear according to any one of Clauses 23 to 25, wherein the arch supporting bladder system further includes: (i) a fourth instep chamber engaged with the instep region of the footwear upper base, (ii) a fourth arch support chamber located at the first midfoot side region of the footwear upper base, and (iii) a fourth fluid line connecting the fourth instep chamber and the fourth arch support chamber and placing the fourth instep chamber in fluid communication with the fourth arch support chamber.

Clause 27. The article of footwear according to Clause 26, wherein the fourth arch support chamber extends around a medial side edge of the footwear upper base to the bottom surface of the footwear upper base.

Clause 28. The article of footwear according to Clause 26, wherein the sole structure includes a fourth recess, wherein a fourth portion of at least one of the fourth arch support chamber or the fourth fluid line is received in the fourth recess such that the fourth portion extends from the first side surface of the footwear upper base to the bottom surface of the footwear upper base, and wherein the fourth portion is in open fluid communication through the fourth recess.

Clause 29. A footwear upper, comprising:

a footwear upper base formed from one or more component parts and including: (i) an instep region including at least one of a tongue base region or an instep base region and (ii) a first midfoot side region; and an arch supporting bladder system including: (i) a first instep chamber engaged with the instep region of the footwear upper base, (ii) a first arch support chamber located at the first midfoot side region of the footwear upper base, and (iii) a first fluid line connecting the first instep chamber and the first arch support chamber and placing the first instep chamber in fluid communication with the first arch support chamber.

Clause 30. The footwear upper according to Clause 29, wherein the arch supporting bladder system further includes a second arch support chamber and a second fluid line connecting the first arch support chamber and the second arch support chamber and placing the first arch support chamber in fluid communication with the second arch support chamber.

Clause 31. The footwear upper according to Clause 30, wherein the second arch support chamber extends around a medial side edge of the footwear upper base to a bottom surface of the footwear upper base.

Clause 32. The footwear upper according to Clause 30, wherein at least a portion of the second arch support chamber is located below at least a portion of the first arch support chamber on the footwear upper base.

Clause 33. The footwear upper according to any one of Clauses 30 to 32, wherein the arch supporting bladder system further includes a third arch support chamber and a third fluid line connecting the second arch support chamber and the third arch support chamber and placing the second arch support chamber in fluid communication with the third arch support chamber.

Clause 34. The footwear upper according to Clause 33, wherein at least a portion of the third arch support chamber is located below at least a portion of the second arch support chamber on the footwear upper base.

Clause 35. The footwear upper according to Clause 29, wherein the arch supporting bladder system further includes: (i) a second instep chamber engaged with the instep region of the footwear upper base, (ii) a second arch support chamber located at the first midfoot side region of the footwear upper base, and (iii) a second fluid line connecting the second instep chamber and the second arch support chamber and placing the second instep chamber in fluid communication with the second arch support chamber.

Clause 36. The footwear upper according to Clause 35, wherein the second arch support chamber extends around a medial side edge of the footwear upper base to a bottom surface of the footwear upper base.

Clause 37. The footwear upper according to Clause 31 or 36, wherein the arch supporting bladder system further includes a third arch support chamber and a third fluid line connecting the second arch support chamber and the third arch support chamber and placing the second arch support chamber in fluid communication with the third arch support chamber.

Clause 38. The footwear upper according to Clause 37, wherein the third arch support chamber extends around a medial side edge of the footwear upper base to a bottom surface of the footwear upper base.

Clause 39. The footwear upper according to Clause 37 or 38, wherein the arch supporting bladder system further includes a fourth arch support chamber and a fourth fluid line connecting the first arch support chamber and the fourth arch support chamber and placing the first arch support chamber in fluid communication with the fourth arch support chamber.

Clause 40. The footwear upper according to Clause 39, wherein the fourth arch support chamber extends around a medial side edge of the footwear upper base to a bottom surface of the footwear upper base.

Clause 41. The footwear upper according to Clause 35 or 36, wherein the arch supporting bladder system further includes: (i) a third instep chamber engaged with the instep region of the footwear upper base, (ii) a third arch support chamber located at the first midfoot side region of the footwear upper base, and (iii) a third fluid line connecting the third instep chamber and the third arch support chamber and placing the third instep chamber in fluid communication with the third arch support chamber.

Clause 42. The footwear upper according to Clause 41, wherein the third arch support chamber extends around a medial side edge of the footwear upper base to a bottom surface of the footwear upper base.

Clause 43. The footwear upper according to Clause 41 or 42, wherein the arch supporting bladder system further includes: (i) a fourth instep chamber engaged with the instep region of the footwear upper base, (ii) a fourth arch support chamber located at the first midfoot side region of the footwear upper base, and (iii) a fourth fluid line connecting the fourth instep chamber and the fourth arch support chamber and placing the fourth instep chamber in fluid communication with the fourth arch support chamber.

Clause 44. The footwear upper according to Clause 43, wherein the fourth arch support chamber extends around a medial side edge of the footwear upper base to a bottom surface of the footwear upper base.

Clause 45. The footwear upper according to Clause 29, wherein the arch supporting bladder system further includes: (i) a second instep chamber engaged with the instep region of the footwear upper base and (ii) a connecting fluid line connecting the first instep chamber and the second instep chamber and placing the first instep chamber in fluid communication with the second instep chamber.

Clause 46. The footwear upper according to Clause 45, wherein the first instep chamber at least partially surrounds an outer perimeter edge of the second instep chamber.

Clause 47. The footwear upper according to Clause 45, wherein the first instep chamber fully surrounds an outer perimeter edge of the second instep chamber.

Clause 48. The footwear upper according to Clause 45, wherein the first instep chamber defines a first central axial direction and the second instep chamber defines a second central axial direction.

Clause 49. The footwear upper according to Clause 48, wherein the first central axial direction and the second central axial direction are substantially parallel.

Clause 50. The footwear upper according to any one of Clauses 45 to 49, wherein the first instep chamber includes a first free end, and wherein the second instep chamber includes a second free end.

Clause 51. The footwear upper according to Clause 50, wherein at least one of the first free end and the second free end forms a forwardmost extent of the arch supporting bladder system on the footwear upper base.

Clause 52. The footwear upper according to any one of Clauses 45 to 51, wherein the second instep chamber is a multi-bulbed chamber having a plurality of fluid bulbs in fluid communication with one another.

Clause 53. The footwear upper according to Clause 52, wherein the first instep chamber is a multi-bulbed chamber having a plurality of fluid bulbs in fluid communication with one another, and wherein a single continuous seam in the arch supporting bladder system separates one bulb of the first instep chamber from one bulb of the second instep chamber.

Clause 54. The footwear upper according to any one of Clauses 29 or 45 to 53, wherein the first instep chamber is a multi-bulbed chamber having a plurality of fluid bulbs in fluid communication with one another.

Clause 55. The footwear upper according to Clause 45, wherein the first instep chamber and the second instep chamber extend in substantially parallel directions.

Clause 56. The footwear upper according to Clause 45 or 55, wherein the first instep chamber is located further forward on the foot upper base than the second instep chamber.

Clause 57. The footwear upper according to any one of Clauses 29 to 56, wherein the first arch support chamber extends around a medial side edge of the footwear upper base to a bottom surface of the footwear upper base.

Clause 58. An article of footwear, comprising:

a footwear upper according to any one of Clauses 29 to 57; and a sole structure engaged with the footwear upper.

Clause 59. A footwear upper, comprising:

a footwear upper base formed from one or more component parts and including: (i) an instep region including at least one of a tongue base region or an instep base region, (ii) a lateral side region, and (iii) a medial side region; and a foot supporting bladder system including: (i) a first instep chamber engaged with the instep region of the footwear upper base, (ii) a first lateral elongated foot support chamber extending from the first instep chamber down and/or along the lateral side region of the footwear upper base, wherein the first lateral elongated foot support chamber is in fluid communication with the first instep chamber, and (iii) a first medial elongated foot support chamber extending from the first instep chamber down and/or along the medial side region of the footwear upper base, wherein the first medial elongated foot support chamber is in fluid communication with the first instep chamber.

Clause 60. The footwear upper according to Clause 59, wherein the foot supporting bladder system further includes a second lateral elongated foot support chamber extending from the first instep chamber and down the lateral side region of the footwear upper base, wherein the second lateral elongated foot support chamber is in fluid communication with the first instep chamber, and wherein the second lateral elongated foot support chamber originates rearward of a corresponding origination location of the first lateral elongated foot support chamber.

Clause 61. The footwear upper according to Clause 60, wherein the foot supporting bladder system further includes a third lateral elongated foot support chamber extending from the first instep chamber and down the lateral side region of the footwear upper base, wherein the third lateral elongated foot support chamber is in fluid communication with the first instep chamber, and wherein the third lateral elongated foot support chamber originates rearward of a corresponding origination location of the second lateral elongated foot support chamber.

Clause 62. The footwear upper according to Clause 61, wherein the foot supporting bladder system further includes a fourth lateral elongated foot support chamber extending from the first instep chamber and down the lateral side region of the footwear upper base, wherein the fourth lateral elongated foot support chamber is in fluid communication with the first instep chamber, and wherein the fourth lateral elongated foot support chamber originates rearward of a corresponding origination location of the third lateral elongated foot support chamber.

Clause 63. The footwear upper according to Clause 62, wherein the foot supporting bladder system further includes a fifth lateral elongated foot support chamber extending from the first instep chamber and down the lateral side region of the footwear upper base, wherein the fifth lateral elongated foot support chamber is in fluid communication with the first instep chamber, and wherein the fifth lateral elongated foot support chamber originates rearward of a corresponding origination location of the fourth lateral elongated foot support chamber.

Clause 64. The footwear upper according to Clause 63, wherein the foot supporting bladder system further includes a sixth lateral elongated foot support chamber extending from the first instep chamber and rearward along the lateral side region of the footwear upper base, wherein the sixth lateral elongated foot support chamber is in fluid communication with the first instep chamber, and wherein the sixth lateral elongated foot support chamber originates rearward of a corresponding origination location of the fifth lateral elongated foot support chamber.

Clause 65. The footwear upper according to Clause 64, wherein the sixth lateral elongated foot support chamber extends to and is in fluid communication with a lateral ankle support bladder region.

Clause 66. The footwear upper according to Clause 65, wherein the lateral ankle support bladder region includes a lateral base region that is in fluid communication with the fifth lateral elongated foot support chamber and the sixth lateral elongated foot support chamber.

Clause 67. The footwear upper according to Clause 66, wherein the foot supporting bladder system further includes at least one elongated fluid line that extends from the lateral base region and around a rear heel or ankle region of the footwear upper base.

Clause 68. The footwear upper according to Clause 66, wherein the foot supporting bladder system further includes two elongated fluid lines that extend from the lateral base region and around a rear heel or ankle region of the footwear upper base.

Clause 69. The footwear upper according to any one of Clauses 59 to 68, wherein the foot supporting bladder system further includes a second medial elongated foot support chamber extending from the first instep chamber and down the medial side region of the footwear upper base, wherein the second medial elongated foot support chamber is in fluid communication with the first instep chamber, and wherein the second medial elongated foot support chamber originates rearward of a corresponding origination location of the first medial elongated foot support chamber.

Clause 70. The footwear upper according to Clause 69, wherein the foot supporting bladder system further includes a third medial elongated foot support chamber extending from the first instep chamber and down the medial side region of the footwear upper base, wherein the third medial elongated foot support chamber is in fluid communication with the first instep chamber, and wherein the third medial elongated foot support chamber originates rearward of a corresponding origination location of the second medial elongated foot support chamber.

Clause 71. The footwear upper according to Clause 70, wherein the foot supporting bladder system further includes a fourth medial elongated foot support chamber extending from the first instep chamber and down the medial side region of the footwear upper base, wherein the fourth medial elongated foot support chamber is in fluid communication with the first instep chamber, and wherein the fourth medial elongated foot support chamber originates rearward of a corresponding origination location of the third medial elongated foot support chamber.

Clause 72. The footwear upper according to Clause 71, wherein the foot supporting bladder system further includes a fifth medial elongated foot support chamber extending from the first instep chamber and down the medial side region of the footwear upper base, wherein the fifth medial elongated foot support chamber is in fluid communication with the first instep chamber, and wherein the fifth medial elongated foot support chamber originates rearward of a corresponding origination location of the fourth medial elongated foot support chamber.

Clause 73. The footwear upper according to Clause 72, wherein the foot supporting bladder system further includes a sixth medial elongated foot support chamber extending from the first instep chamber and rearward along the medial side region of the footwear upper base, wherein the sixth medial elongated foot support chamber is in fluid communication with the first instep chamber, and wherein the sixth medial elongated foot support chamber originates rearward of a corresponding origination location of the fifth medial elongated foot support chamber.

Clause 74. The footwear upper according to Clause 73, wherein the sixth medial elongated foot support chamber extends to and is in fluid communication with a medial ankle support bladder region.

Clause 75. The footwear upper according to Clause 74, wherein the medial ankle support bladder region includes a medial base region that is in fluid communication with the fifth medial elongated foot support chamber and the sixth medial elongated foot support chamber.

Clause 76. The footwear upper according to Clause 75, wherein the foot supporting bladder system further includes at least one elongated fluid line that extends from the medial base region and around a rear heel or ankle region of the footwear upper base.

Clause 77. The footwear upper according to Clause 75, wherein the foot supporting bladder system further includes two elongated fluid lines that extend from the medial base region and around a rear heel or ankle region of the footwear upper base.

Clause 78. The footwear upper according to Clause 59, wherein the first lateral elongated foot support chamber extends to and is in fluid communication with a lateral ankle support bladder region.

Clause 79. The footwear upper according to Clause 78, wherein the lateral ankle support bladder region includes a lateral base region that is in fluid communication with the first lateral elongated foot support chamber.

Clause 80. The footwear upper according to Clause 79, wherein the foot supporting bladder system further includes at least one elongated fluid line that extends from the lateral base region and around a rear heel or ankle region of the footwear upper base.

Clause 81. The footwear upper according to Clause 79, wherein the foot supporting bladder system further includes two elongated fluid lines that extend from the lateral base region and around a rear heel or ankle region of the footwear upper base.

Clause 82. The footwear upper according to any one of Clauses 59, 78, or 79, wherein the first medial elongated foot support chamber extends to and is in fluid communication with a medial ankle support bladder region.

Clause 83. The footwear upper according to Clause 82, wherein the medial ankle support bladder region includes a medial base region that is in fluid communication with the first medial elongated foot support chamber.

Clause 84. The footwear upper according to Clause 83, wherein the foot supporting bladder system further includes at least one elongated fluid line that extends from the medial base region and around a rear heel or ankle region of the footwear upper base.

Clause 85. The footwear upper according to Clause 83, wherein the foot supporting bladder system further includes two elongated fluid lines that extend from the medial base region and around a rear heel or ankle region of the footwear upper base.

Clause 86. The footwear upper according to Clause 59, wherein the first lateral elongated foot support chamber extends to and is in fluid communication with a lateral ankle support bladder region, wherein the first medial elongated foot support chamber extends to and is in fluid communication with a medial ankle support bladder region, and wherein the foot supporting bladder system further includes at least one elongated fluid line that extends from the lateral ankle support bladder region to the medial ankle support bladder region and around a rear heel or ankle region of the footwear upper base.

Clause 87. The footwear upper according to Clause 86, wherein the lateral ankle support bladder region includes a lateral base region that is in fluid communication with the first lateral elongated foot support chamber, wherein the medial ankle support bladder region includes a medial base region that is in fluid communication with the first medial elongated foot support chamber, and wherein the at least one elongated fluid line extends from the lateral base region to the medial base region.

Clause 88. The footwear upper according to Clause 59, wherein the first lateral elongated foot support chamber extends to and is in fluid communication with a lateral ankle support bladder region, wherein the first medial elongated foot support chamber extends to and is in fluid communication with a medial ankle support bladder region, and wherein the foot supporting bladder system further includes two elongated fluid lines that extend from the lateral ankle support bladder region to the medial ankle support bladder region and around a rear heel or ankle region of the footwear upper base.

Clause 89. The footwear upper according to Clause 88, wherein the lateral ankle support bladder region includes a lateral base region that is in fluid communication with the first lateral elongated foot support chamber, wherein the medial ankle support bladder region includes a medial base region that is in fluid communication with the first medial elongated foot support chamber, and wherein the two elongated fluid lines extend from the lateral base region to the medial base region.

Clause 90. The footwear upper according to Clause 59, wherein the foot supporting bladder system further includes a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region.

Clause 91. The footwear upper according to Clause 90, wherein the lateral ankle support bladder region includes a lateral base region that is in fluid communication with the first lateral elongated foot support chamber and the second lateral elongated foot support chamber.

Clause 92. The footwear upper according to Clause 91, wherein the foot supporting bladder system further includes at least one elongated fluid line that extends from the lateral base region and around a rear heel or ankle region of the footwear upper base.

Clause 93. The footwear upper according to Clause 91, wherein the foot supporting bladder system further includes two elongated fluid lines that extend from the lateral base region and around a rear heel or ankle region of the footwear upper base.

Clause 94. The footwear upper according to any one of Clauses 59 or 90 to 93, wherein the foot supporting bladder system further includes a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region.

Clause 95. The footwear upper according to Clause 94, wherein the medial ankle support bladder region includes a medial base region that is in fluid communication with the first medial elongated foot support chamber and the second medial elongated foot support chamber.

Clause 96. The footwear upper according to Clause 95, wherein the foot supporting bladder system further includes at least one elongated fluid line that extends from the medial base region and around a rear heel or ankle region of the footwear upper base.

Clause 97. The footwear upper according to Clause 95, wherein the foot supporting bladder system further includes two elongated fluid lines that extend from the medial base region and around a rear heel or ankle region of the footwear upper base.

Clause 98. The footwear upper according to Clause 59, wherein the foot supporting bladder system further includes:

a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region;

a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region; and at least one elongated fluid line that extends from the lateral ankle support bladder region to the medial ankle support bladder region and around a rear heel or ankle region of the footwear upper base.

Clause 99. The footwear upper according to Clause 98, wherein the lateral ankle support bladder region includes a lateral base region that is in fluid communication with the second lateral elongated foot support chamber, wherein the medial ankle support bladder region includes a medial base region that is in fluid communication with the second medial elongated foot support chamber, and wherein the at least one elongated fluid line extends from the lateral base region to the medial base region.

Clause 100. The footwear upper according to Clause 59, wherein the foot supporting bladder system further includes:

a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region;

a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region; and two elongated fluid lines that extend from the lateral ankle support bladder region to the medial ankle support bladder region and around a rear heel or ankle region of the footwear upper base.

Clause 101. The footwear upper according to Clause 100, wherein the lateral ankle support bladder region includes a lateral base region that is in fluid communication with the second lateral elongated foot support chamber, wherein the medial ankle support bladder region includes a medial base region that is in fluid communication with the second medial elongated foot support chamber, and wherein the two elongated fluid line extends from the lateral base region to the medial base region.

Clause 102. The footwear upper according to any one of Clauses 59 to 101, wherein the first instep chamber includes: (a) an inner bladder chamber portion, (b) an outer bladder chamber portion, (c) a first seam separating a first portion of the inner bladder chamber portion from a first portion of the outer bladder chamber portion, and (d) a second seam separating a second portion of the inner bladder chamber portion from a second portion of the outer bladder chamber portion, wherein a first space between the first seam and the second seam provides a first fluid path for fluid exchange between the inner bladder chamber portion and the outer bladder chamber portion.

Clause 103. The footwear upper according to Clause 102, wherein each lateral elongated foot support chamber is in fluid communication with the outer bladder chamber portion.

Clause 104. The footwear upper according to Clause 102 or 103, wherein each medial elongated foot support chamber is in fluid communication with the outer bladder chamber portion.

Clause 105. The footwear upper according to any one of Clauses 102 to 104, wherein a second space between the first seam and the second seam provides a second fluid path for fluid exchange between the inner bladder chamber portion and the outer bladder chamber portion.

Clause 106. The footwear upper according to any one of Clauses 59 to 101, wherein the first instep chamber includes: (a) an inner bladder chamber portion, and (b) an outer bladder chamber portion at least partially surrounding the inner bladder chamber portion, wherein the inner bladder chamber portion and the outer bladder chamber portion are in fluid communication with one another.

Clause 107. The footwear upper according to Clause 106, wherein each lateral elongated foot support chamber is in fluid communication with the outer bladder chamber portion.

Clause 108. The footwear upper according to Clause 106 or 107, wherein each medial elongated foot support chamber is in fluid communication with the outer bladder chamber portion.

Clause 109. An article of footwear, comprising:

a footwear upper according to any one of Clauses 59 to 108; and a sole structure engaged with the footwear upper.

Clause 110. An article of footwear, comprising:

a footwear upper including: (a) a footwear upper base formed from one or more component parts and including: (i) an instep region including at least one of a tongue base region or an instep base region, (ii) a lateral side region, (iii) a medial side region, and (iv) a plantar support surface, and (b) a foot supporting bladder system including: (i) a first instep chamber engaged with the instep region of the footwear upper base, (ii) a first lateral elongated foot support chamber extending from the first instep chamber, down the lateral side region of the footwear upper base, and to the plantar support surface, wherein the first lateral elongated foot support chamber is in fluid communication with the first instep chamber, and (iii) a first medial elongated foot support chamber extending from the first instep chamber, down the medial side region of the footwear upper base, and to the plantar support surface, wherein the first medial elongated foot support chamber is in fluid communication with the first instep chamber; and a sole structure engaged with the footwear upper, wherein the sole structure includes a first lateral recess through which the first lateral elongated foot support chamber extends and a first medial recess through which the first medial elongated foot support chamber extends.

Clause 111. The article of footwear according to Clause 110, wherein the foot supporting bladder system further includes a second lateral elongated foot support chamber extending from the first instep chamber, down the lateral side region of the footwear upper base, and to the plantar support surface, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends through the first lateral recess defined in the sole structure or another lateral recess defined in the sole structure.

Clause 112. The article of footwear according to Clause 111, wherein the foot supporting bladder system further includes a third lateral elongated foot support chamber extending from the first instep chamber, down the lateral side region of the footwear upper base, and to the plantar support surface, wherein the third lateral elongated foot support chamber is in fluid communication with the first instep chamber, wherein the third lateral elongated foot support chamber originates rearward of a corresponding origination location of the second lateral elongated foot support chamber, and wherein the third lateral elongated foot support chamber extends through the first lateral recess defined in the sole structure or through another lateral recess defined in the sole structure.

Clause 113. The article of footwear according to Clause 112, wherein the foot supporting bladder system further includes a fourth lateral elongated foot support chamber extending from the first instep chamber, down the lateral side region of the footwear upper base, and to the plantar support surface, wherein the fourth lateral elongated foot support chamber is in fluid communication with the first instep chamber, wherein the fourth lateral elongated foot support chamber originates rearward of a corresponding origination location of the third lateral elongated foot support chamber, and wherein the fourth lateral elongated foot support chamber extends through the first lateral recess defined in the sole structure or through another lateral recess defined in the sole structure.

Clause 114. The article of footwear upper according to Clause 113, wherein the foot supporting bladder system further includes a fifth lateral elongated foot support chamber extending from the first instep chamber, down the lateral side region of the footwear upper base, and to the plantar support surface, wherein the fifth lateral elongated foot support chamber is in fluid communication with the first instep chamber, wherein the fifth lateral elongated foot support chamber originates rearward of a corresponding origination location of the fourth lateral elongated foot support chamber, and wherein the fifth lateral elongated foot support chamber extends through the first lateral recess defined in the sole structure or through another lateral recess defined in the sole structure.

Clause 115. The article of footwear according to Clause 114, wherein the foot supporting bladder system further includes a sixth lateral elongated foot support chamber extending from the first instep chamber and along the lateral side region of the footwear upper base, wherein the sixth lateral elongated foot support chamber is in fluid communication with the first instep chamber, and wherein the sixth lateral elongated foot support chamber originates rearward of a corresponding origination location of the fifth lateral elongated foot support chamber.

Clause 116. The article of footwear according to Clause 115, wherein the sixth lateral elongated foot support chamber extends to and is in fluid communication with a lateral ankle support bladder region.

Clause 117. The article of footwear according to Clause 116, wherein the lateral ankle support bladder region includes a lateral base region that is in fluid communication with the sixth lateral elongated foot support chamber, and wherein a lateral fluid line connects the fifth lateral elongated foot support chamber with at least one of the lateral base region or the sixth lateral elongated foot support chamber.

Clause 118. The article of footwear according to Clause 117, wherein the foot supporting bladder system further includes at least one elongated fluid line that extends from the lateral base region and around a rear heel or ankle region of the footwear upper base.

Clause 119. The article of footwear according to Clause 118, wherein the foot supporting bladder system further includes two elongated fluid lines that extend from the lateral base region and around a rear heel or ankle region of the footwear upper base.

Clause 120. The article of footwear according to any one of Clauses 110 to 119, wherein the foot supporting bladder system further includes a second medial elongated foot support chamber extending from the first instep chamber, down the medial side region of the footwear upper base, and to the plantar support surface, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends through the first medial recess defined in the sole structure or through another medial recess defined in the sole structure.

Clause 121. The article of footwear according to Clause 120, wherein the foot supporting bladder system further includes a third medial elongated foot support chamber extending from the first instep chamber, down the medial side region of the footwear upper base, and to the plantar support surface, wherein the third medial elongated foot support chamber is in fluid communication with the first instep chamber, wherein the third medial elongated foot support chamber originates rearward of a corresponding origination location of the second medial elongated foot support chamber, and wherein the third medial elongated foot support chamber extends through the first medial recess defined in the sole structure or through another medial recess defined in the sole structure.

Clause 122. The article of footwear according to Clause 121, wherein the foot supporting bladder system further includes a fourth medial elongated foot support chamber extending from the first instep chamber, down the medial side region of the footwear upper base, and to the plantar support surface, wherein the fourth medial elongated foot support chamber is in fluid communication with the first instep chamber, wherein the fourth medial elongated foot support chamber originates rearward of a corresponding origination location of the third medial elongated foot support chamber, and wherein the fourth medial elongated foot support chamber extends through the first medial recess defined in the sole structure or through another medial recess defined in the sole structure.

Clause 123. The article of footwear according to Clause 122, wherein the foot supporting bladder system further includes a fifth medial elongated foot support chamber extending from the first instep chamber, down the medial side region of the footwear upper base, and to the plantar support surface, wherein the fifth medial elongated foot support chamber is in fluid communication with the first instep chamber, wherein the fifth medial elongated foot support chamber originates rearward of a corresponding origination location of the fourth medial elongated foot support chamber, and wherein the fifth medial elongated foot support chamber extends through the first medial recess defined in the sole structure or through another medial recess defined in the sole structure.

Clause 124. The article of footwear according to Clause 123, wherein the foot supporting bladder system further includes a sixth medial elongated foot support chamber extending from the first instep chamber and along the medial side region of the footwear upper base, wherein the sixth medial elongated foot support chamber is in fluid communication with the first instep chamber, and wherein the sixth medial elongated foot support chamber originates rearward of a corresponding origination location of the fifth medial elongated foot support chamber.

Clause 125. The article of footwear according to Clause 124, wherein the sixth medial elongated foot support chamber extends to and is in fluid communication with a medial ankle support bladder region.

Clause 126. The article of footwear according to Clause 125, wherein the medial ankle support bladder region includes a medial base region that is in fluid communication with the sixth medial elongated foot support chamber, and wherein a medial fluid line connects the fifth medial elongated foot support chamber with at least one of the medial base region or the sixth medial elongated foot support chamber.

Clause 127. The article of footwear according to Clause 126, wherein the foot supporting bladder system further includes at least one elongated fluid line that extends from the medial base region and around a rear heel or ankle region of the footwear upper base.

Clause 128. The article of footwear according to Clause 126, wherein the foot supporting bladder system further includes two elongated fluid lines that extend from the medial base region and around a rear heel or ankle region of the footwear upper base.

Clause 129. The article of footwear according to Clause 110, wherein the foot supporting bladder system further includes a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region.

Clause 130. The article of footwear according to Clause 129, wherein the lateral ankle support bladder region includes a lateral base region, and wherein a lateral fluid line connects the first lateral elongated foot support chamber to at least one of the lateral base region or the second lateral elongated foot support chamber.

Clause 131. The article of footwear according to Clause 130, wherein the foot supporting bladder system further includes at least one elongated fluid line that extends from the lateral base region and around a rear heel or ankle region of the footwear upper base.

Clause 132. The article of footwear according to Clause 130, wherein the foot supporting bladder system further includes two elongated fluid lines that extend from the lateral base region and around a rear heel or ankle region of the footwear upper base.

Clause 133. The article of footwear according to any one of Clauses 110 or 129 to 132, wherein the foot supporting bladder system further includes a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region.

Clause 134. The article of footwear according to Clause 133, wherein the medial ankle support bladder region includes a medial base region, and wherein a medial fluid line connects the first medial elongated foot support chamber to at least one of the medial base region or the second medial elongated foot support chamber.

Clause 135. The article of footwear according to Clause 134, wherein the foot supporting bladder system further includes at least one elongated fluid line that extends from the medial base region and around a rear heel or ankle region of the footwear upper base.

Clause 136. The article of footwear according to Clause 134, wherein the foot supporting bladder system further includes two elongated fluid lines that extend from the medial base region and around a rear heel or ankle region of the footwear upper base.

Clause 137. The article of footwear according to Clause 110, wherein the foot supporting bladder system further includes:

a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region;

a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region; and at least one elongated fluid line that extends from the lateral ankle support bladder region to the medial ankle support bladder region and around a rear heel or ankle region of the footwear upper base.

Clause 138. The article of footwear according to Clause 137, wherein the lateral ankle support bladder region includes a lateral base region that is in fluid communication with the second lateral elongated foot support chamber, wherein the medial ankle support bladder region includes a medial base region that is in fluid communication with the second medial elongated foot support chamber, and wherein the at least one elongated fluid line extends from the lateral base region to the medial base region.

Clause 139. The article of footwear according to Clause 110, wherein the foot supporting bladder system further includes:

a second lateral elongated foot support chamber extending from the first instep chamber and along the lateral side region of the footwear upper base, wherein the second lateral elongated foot support chamber is in fluid communication with the first instep chamber, wherein the second lateral elongated foot support chamber originates rearward of a corresponding origination location of the first lateral elongated foot support chamber, and wherein the second lateral elongated foot support chamber extends to and is in fluid communication with a lateral ankle support bladder region;

a second medial elongated foot support chamber extending from the first instep chamber and along the medial side region of the footwear upper base, wherein the second medial elongated foot support chamber is in fluid communication with the first instep chamber, wherein the second medial elongated foot support chamber originates rearward of a corresponding origination location of the first medial elongated foot support chamber, and wherein the second medial elongated foot support chamber extends to and is in fluid communication with a medial ankle support bladder region; and two elongated fluid lines that extend from the lateral ankle support bladder region to the medial ankle support bladder region and around a rear heel or ankle region of the footwear upper base.

Clause 140. The article of footwear according to Clause 139, wherein the lateral ankle support bladder region includes a lateral base region that is in fluid communication with the second lateral elongated foot support chamber, wherein the medial ankle support bladder region includes a medial base region that is in fluid communication with the second medial elongated foot support chamber, and wherein the two elongated fluid line extends from the lateral base region to the medial base region.

Clause 141. The article of footwear according to any one of Clauses 110 to 140, wherein the first instep chamber includes: (a) an inner bladder chamber portion, (b) an outer bladder chamber portion, (c) a first seam separating a first portion of the inner bladder chamber portion from a first portion of the outer bladder chamber portion, and (d) a second seam separating a second portion of the inner bladder chamber portion from a second portion of the outer bladder chamber portion, wherein a first space between the first seam and the second seam provides a first fluid path for fluid exchange between the inner bladder chamber portion and the outer bladder chamber portion.

Clause 142. The article of footwear according to Clause 141, wherein each lateral elongated foot support chamber originates at the outer bladder chamber portion.

Clause 143. The article of footwear according to Clause 141 or 142, wherein each medial elongated foot support chamber originates at the outer bladder chamber portion.

Clause 144. The article of footwear according to Clause 141, wherein any one or more of the lateral elongated foot support chambers originates at the outer bladder chamber portion.

Clause 145. The article of footwear according to Clause 141 or 144, wherein any one or more of the medial elongated foot support chambers originates at the outer bladder chamber portion.

Clause 146. The article of footwear according to any one of Clauses 141 to 145, wherein a second space between the first seam and the second seam provides a second fluid path for fluid exchange between the inner bladder chamber portion and the outer bladder chamber portion.

Clause 147. The article of footwear according to any one of Clauses 110 to 140, wherein the first instep chamber includes: (a) an inner bladder chamber portion, and (b) an outer bladder chamber portion at least partially surrounding the inner bladder chamber portion, wherein the inner bladder chamber portion and the outer bladder chamber portion are in fluid communication with one another.

Clause 148. The article of footwear according to Clause 147, wherein each lateral elongated foot support chamber originates at the outer bladder chamber portion.

Clause 149. The article of footwear according to Clause 147 or 148, wherein each medial elongated foot support chamber originates at the outer bladder chamber portion.

Clause 150. The article of footwear according to Clause 147, wherein any one or more of the lateral elongated foot support chambers originates at the outer bladder chamber portion.

Clause 151. The article of footwear according to Clause 147 or 150, wherein any one or more of the medial elongated foot support chambers originates at the outer bladder chamber portion.

Clause 152. A footwear upper, comprising:

a footwear upper base formed from one or more component parts, the footwear upper base including: (i) an instep region, (ii) a first side region extending from the instep region, and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region; and a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on a lateral side or only on a medial side of the footwear upper base in the instep region.

Clause 153. The footwear upper according to Clause 152, further comprising: a third elongated bladder chamber that is not in fluid communication with any of the first elongated bladder chamber or the second elongated bladder chamber, the third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region.

Clause 154. The footwear upper according to Clause 153, wherein the second end of the second elongated bladder chamber is located between the first elongated bladder chamber and the third elongated bladder chamber.

Clause 155. The footwear upper according to Clause 153, further comprising: a fourth elongated bladder chamber that is not in fluid communication with any of the first elongated bladder chamber, the second elongated bladder chamber, or the third elongated bladder chamber, the fourth elongated bladder chamber having a first end located in the second side region and a second end located in the instep region or the second side region, wherein: (a) the fourth elongated bladder chamber does not extend across the front-to-rear centerline of the footwear upper base and/or (b) all portions of the fourth elongated bladder chamber are located only on the lateral side or only on the medial side of the footwear upper base in the instep region.

Clause 156. The footwear upper according to Clause 155, further comprising: a fifth elongated bladder chamber that is not in fluid communication with any of the first elongated bladder chamber, the second elongated bladder chamber, the third elongated bladder chamber, or the fourth elongated bladder chamber, the fifth elongated bladder chamber having a first end located in the first side region and a second end located in the instep region or the second side region, wherein the fifth elongated bladder chamber: (a) extends across the front-to-rear centerline of the footwear upper base in the instep region and/or (b) extends from the lateral side to the medial side of the footwear upper base across the instep region.

Clause 157. The footwear upper according to Clause 156, wherein the second end of the second elongated bladder chamber is located between the first elongated bladder chamber and the third elongated bladder chamber, and wherein the second end of the fourth elongated bladder chamber is located between the third elongated bladder chamber and the fifth elongated bladder chamber.

Clause 158. The footwear upper according to Clause 156, further comprising: a sixth elongated bladder chamber that is not in fluid communication with any of the first elongated bladder chamber, the second elongated bladder chamber, the third elongated bladder chamber, the fourth elongated bladder chamber, or the fifth elongated bladder chamber, the sixth elongated bladder chamber having a first end located in the second side region and a second end located in the instep region or the second side region, wherein: (a) the sixth elongated bladder chamber does not extend across the front-to-rear centerline of the footwear upper base and/or (b) all portions of the sixth elongated bladder chamber are located only on the lateral side or only on the medial side of the footwear upper base in the instep region.

Clause 159. The footwear upper according to Clause 158, further comprising: a seventh elongated bladder chamber that is not in fluid communication with any of the first elongated bladder chamber, the second elongated bladder chamber, the third elongated bladder chamber, the fourth elongated bladder chamber, the fifth elongated bladder chamber, or the sixth elongated bladder chamber, the seventh elongated bladder chamber having a first end located in the first side region and a second end located in the instep region or the second side region, wherein the seventh elongated bladder chamber: (a) extends across the front-to-rear centerline of the footwear upper base in the instep region and/or (b) extends from the lateral side to the medial side of the footwear upper base across the instep region.

Clause 160. The footwear upper according to Clause 159, wherein the second end of the second elongated bladder chamber is located between the first elongated bladder chamber and the third elongated bladder chamber, wherein the second end of the fourth elongated bladder chamber is located between the third elongated bladder chamber and the fifth elongated bladder chamber, and wherein the second end of the sixth elongated bladder chamber is located between the fifth elongated bladder chamber and the seventh elongated bladder chamber.

Clause 161. The footwear upper according to Clause 159, further comprising: an eighth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, or the seventh elongated bladder chamber, the eighth elongated bladder chamber having a first end located in the second side region and a second end located in the instep region or the second side region, wherein: (a) the eighth elongated bladder chamber does not extend across the front-to-rear centerline of the footwear upper base and/or (b) all portions of the eighth elongated bladder chamber are located only on the lateral side or only on the medial side of the footwear upper base in the instep region.

Clause 162. The footwear upper according to Clause 161, further comprising: a ninth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, the seventh elongated bladder chamber, or the eighth elongated bladder chamber, the ninth elongated bladder chamber having a first end located in the first side region and a second end located in the instep region or the second side region, wherein the ninth elongated bladder chamber: (a) extends across the front-to-rear centerline of the footwear upper base in the instep region and/or (b) extends from the lateral side to the medial side of the footwear upper base across the instep region.

Clause 163. The footwear upper according to Clause 162, wherein the second end of the second elongated bladder chamber is located between the first elongated bladder chamber and the third elongated bladder chamber, wherein the second end of the fourth elongated bladder chamber is located between the third elongated bladder chamber and the fifth elongated bladder chamber, wherein the second end of the sixth elongated bladder chamber is located between the fifth elongated bladder chamber and the seventh elongated bladder chamber, and wherein the second end of the eighth elongated bladder chamber is located between the seventh elongated bladder chamber and the ninth elongated bladder chamber.

Clause 164. The footwear upper according to Clause 163, further comprising: a tenth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, the seventh elongated bladder chamber, or the ninth elongated bladder chamber, the tenth elongated bladder chamber having a first end located in the second side region and a second end located in the instep region or the second side region, wherein: (a) the tenth elongated bladder chamber does not extend across the front-to-rear centerline of the footwear upper base and/or (b) all portions of the tenth elongated bladder chamber are located only on the lateral side or only on the medial side of the footwear upper base in the instep region.

Clause 165. The footwear upper according to any one of Clauses 152 to 164, wherein the second elongated bladder chamber is not in fluid communication with the first elongated bladder chamber.

Clause 166. The footwear upper according to Clause 152, further comprising: a third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region.

Clause 167. The footwear upper according to Clause 166, wherein the second end of the second elongated bladder chamber is located between the first elongated bladder chamber and the third elongated bladder chamber.

Clause 168. The footwear upper according to Clause 166, further comprising: a fourth elongated bladder chamber having a first end located in the second side region and a second end located in the instep region or the second side region, wherein: (a) the fourth elongated bladder chamber does not extend across the front-to-rear centerline of the footwear upper base and/or (b) all portions of the fourth elongated bladder chamber are located only on the lateral side or only on the medial side of the footwear upper base in the instep region.

Clause 169. The footwear upper according to Clause 168, further comprising: a fifth elongated bladder chamber having a first end located in the first side region and a second end located in the instep region or the second side region, wherein the fifth elongated bladder chamber: (a) extends across the front-to-rear centerline of the footwear upper base in the instep region and/or (b) extends from the lateral side to the medial side of the footwear upper base across the instep region.

Clause 170. The footwear upper according to Clause 169, wherein the second end of the second elongated bladder chamber is located between the first elongated bladder chamber and the third elongated bladder chamber, and wherein the second end of the fourth elongated bladder chamber is located between the third elongated bladder chamber and the fifth elongated bladder chamber.

Clause 171. The footwear upper according to Clause 169, further comprising: a sixth elongated bladder chamber having a first end located in the second side region and a second end located in the instep region or the second side region, wherein: (a) the sixth elongated bladder chamber does not extend across the front-to-rear centerline of the footwear upper base and/or (b) all portions of the sixth elongated bladder chamber are located only on the lateral side or only on the medial side of the footwear upper base in the instep region.

Clause 172. The footwear upper according to Clause 171, further comprising: a seventh elongated bladder chamber having a first end located in the first side region and a second end located in the instep region or the second side region, wherein the seventh elongated bladder chamber: (a) extends across the front-to-rear centerline of the footwear upper base in the instep region and/or (b) extends from the lateral side to the medial side of the footwear upper base across the instep region.

Clause 173. The footwear upper according to Clause 172, wherein the second end of the second elongated bladder chamber is located between the first elongated bladder chamber and the third elongated bladder chamber, wherein the second end of the fourth elongated bladder chamber is located between the third elongated bladder chamber and the fifth elongated bladder chamber, and wherein the second end of the sixth elongated bladder chamber is located between the fifth elongated bladder chamber and the seventh elongated bladder chamber.

Clause 174. The footwear upper according to Clause 172, further comprising: an eighth elongated bladder chamber having a first end located in the second side region and a second end located in the instep region or the second side region, and wherein: (a) the eighth elongated bladder chamber does not extend across the front-to-rear centerline of the footwear upper base and/or (b) all portions of the eighth elongated bladder chamber are located only on the lateral side or only on the medial side of the footwear upper base in the instep region.

Clause 175. The footwear upper according to Clause 174, further comprising: a ninth elongated bladder chamber having a first end located in the first side region and a second end located in the instep region or the second side region, wherein the ninth elongated bladder chamber: (a) extends across the front-to-rear centerline of the footwear upper base in the instep region and/or (b) extends from the lateral side to the medial side of the footwear upper base across the instep region.

Clause 176. The footwear upper according to Clause 175, wherein the second end of the second elongated bladder chamber is located between the first elongated bladder chamber and the third elongated bladder chamber, wherein the second end of the fourth elongated bladder chamber is located between the third elongated bladder chamber and the fifth elongated bladder chamber, wherein the second end of the sixth elongated bladder chamber is located between the fifth elongated bladder chamber and the seventh elongated bladder chamber, and wherein the second end of the eighth elongated bladder chamber is located between the seventh elongated bladder chamber and the ninth elongated bladder chamber.

Clause 177. The footwear upper according to Clause 175, further comprising: a tenth elongated bladder chamber having a first end located in the second side region and a second end located in the instep region or the second side region, wherein: (a) the tenth elongated bladder chamber does not extend across the front-to-rear centerline of the footwear upper base and/or (b) all portions of the tenth elongated bladder chamber are located only on the lateral side or only on the medial side of the footwear upper base in the instep region.

Clause 178. The footwear upper according to Clause 177, further comprising: an eleventh elongated bladder chamber having a first end located in the second side region and a second end located in the instep region or the second side region, wherein the eleventh elongated bladder chamber: (a) extends across the front-to-rear centerline of the footwear upper base in the instep region and/or (b) extends from the lateral side to the medial side of the footwear upper base across the instep region.

Clause 179. The footwear upper according to any one of Clauses 152 to 178, further comprising an ankle support bladder chamber located in the second side region.

Clause 180. The footwear upper according to Clause 179, wherein the ankle support bladder chamber includes a first free end, a second free end, and a substantially C-shaped chamber extending between the first free end and the second free end.

Clause 181. The footwear upper according to Clause 180, further comprising a rearward elongated bladder chamber having a first end located in the first side region and a second end located between the first free end and the second free end of the ankle support bladder chamber.

Clause 182. The footwear upper according to Clause 179, wherein the ankle support bladder chamber is not in fluid communication with any of the elongated bladder chambers.

Clause 183. The footwear upper according to any one of Clauses 152 to 182, wherein the first side region is located at a lateral side of the footwear upper and the second side region is located at a medial side of the footwear upper.

Clause 184. The footwear upper according to any one of Clauses 152 to 182, wherein the first side region is located at a medial side of the footwear upper and the second side region is located at a lateral side of the footwear upper.

Clause 185. An article of footwear, comprising:

a footwear upper according to any one of Clauses 152 to 184; and a sole structure engaged with the footwear upper.

Clause 186. The article of footwear according to Clause 185, wherein the footwear upper base further includes a plantar support surface, wherein the sole structure includes a first side recess and a second side recess, wherein the first elongated bladder chamber extends through the first side recess and the first end of the first elongated bladder chamber is located on the plantar support surface, and wherein the second elongated bladder chamber extends through the second side recess and the first end of the second elongated bladder chamber is located on the plantar support surface.

Clause 187. The article of footwear according to Clause 185, wherein the footwear upper base further includes a plantar support surface, wherein the sole structure includes one or more side recesses, wherein each elongated bladder chamber extends through one of the one or more side recesses, and wherein each first end of the elongated bladder chambers is located on the plantar support surface.

Clause 188. The article of footwear according to Clause 185, wherein the footwear upper base further includes a plantar support surface, wherein the sole structure includes one or more side recesses, wherein any one or more of the elongated bladder chambers extend through one of the one or more side recesses, and wherein any one or more of the first ends of the elongated bladder chambers is located on the plantar support surface.

What is claimed is:

1. A footwear upper, comprising:

a footwear upper base formed from one or more component parts, the footwear upper base including: (i) an instep region, (ii) a first side region extending from the instep region, and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region; and a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region, and wherein the second elongated bladder chamber is not in fluid communication with the first elongated bladder chamber.

2. The footwear upper according to claim 1, further comprising:

a third elongated bladder chamber that is not in fluid communication with any of the first elongated bladder chamber or the second elongated bladder chamber, the third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region.

3. The footwear upper according to claim 1, further comprising:

a third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region.

4. The footwear upper according to claim 3, further comprising:

a fourth elongated bladder chamber having a first end located in the second side region and a second end located in the instep region or the second side region, wherein: (a) the fourth elongated bladder chamber does not extend across the front-to-rear centerline of the footwear upper base and/or (b) all portions of the fourth elongated bladder chamber are located only on the lateral side or only on the medial side of the footwear upper base in the instep region.

5. The footwear upper according to claim 1, further comprising an ankle support bladder chamber located in the second side region, wherein the ankle support bladder chamber includes a first free end, a second free end, and a substantially C-shaped chamber extending between the first free end and the second free end.

6. A footwear upper, comprising:

a footwear upper base formed from one or more component parts, the footwear upper base including: (i) an instep region, (ii) a first side region extending from the instep region, and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region;

a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region; and a third elongated bladder chamber that is not in fluid communication with any of the first elongated bladder chamber or the second elongated bladder chamber, the third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region, and wherein the second end of the second elongated bladder chamber is located between the first elongated bladder chamber and the third elongated bladder chamber.

7. The footwear upper according to claim 6, wherein the second elongated bladder chamber is not in fluid communication with the first elongated bladder chamber.

8. A footwear upper, comprising:

a footwear upper base formed from one or more component parts, the footwear upper base including: (i) an instep region, (ii) a first side region extending from the instep region, and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region;

a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region;

a third elongated bladder chamber that is not in fluid communication with any of the first elongated bladder chamber or the second elongated bladder chamber, the third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region; and a fourth elongated bladder chamber that is not in fluid communication with any of the first elongated bladder chamber, the second elongated bladder chamber, or the third elongated bladder chamber, the fourth elongated bladder chamber having a first end located in the second side region and a second end located in the instep region or the second side region, wherein: (a) the fourth elongated bladder chamber does not extend across the front-to-rear centerline of the footwear upper base and/or (b) all portions of the fourth elongated bladder chamber are located only on the lateral side or only on the medial side of the footwear upper base in the instep region.

9. The footwear upper according to claim 8, further comprising:

a fifth elongated bladder chamber that is not in fluid communication with any of the first elongated bladder chamber, the second elongated bladder chamber, the third elongated bladder chamber, or the fourth elongated bladder chamber, the fifth elongated bladder chamber having a first end located in the first side region and a second end located in the instep region or the second side region, wherein the fifth elongated bladder chamber: (a) extends across the front-to-rear centerline of the footwear upper base in the instep region and/or (b) extends from the lateral side to the medial side of the footwear upper base across the instep region.

10. The footwear upper according to claim 9, wherein the second end of the second elongated bladder chamber is located between the first elongated bladder chamber and the third elongated bladder chamber, and wherein the second end of the fourth elongated bladder chamber is located between the third elongated bladder chamber and the fifth elongated bladder chamber.

11. The footwear upper according to claim 9, further comprising:

a sixth elongated bladder chamber that is not in fluid communication with any of the first elongated bladder chamber, the second elongated bladder chamber, the third elongated bladder chamber, the fourth elongated bladder chamber, or the fifth elongated bladder chamber, the sixth elongated bladder chamber having a first end located in the second side region and a second end located in the instep region or the second side region, wherein: (a) the sixth elongated bladder chamber does not extend across the front-to-rear centerline of the footwear upper base and/or (b) all portions of the sixth elongated bladder chamber are located only on the lateral side or only on the medial side of the footwear upper base in the instep region.

12. The footwear upper according to claim 11, further comprising:

a seventh elongated bladder chamber that is not in fluid communication with any of the first elongated bladder chamber, the second elongated bladder chamber, the third elongated bladder chamber, the fourth elongated bladder chamber, the fifth elongated bladder chamber, or the sixth elongated bladder chamber, the seventh elongated bladder chamber having a first end located in the first side region and a second end located in the instep region or the second side region, wherein the seventh elongated bladder chamber: (a) extends across the front-to-rear centerline of the footwear upper base in the instep region and/or (b) extends from the lateral side to the medial side of the footwear upper base across the instep region.

13. The footwear upper according to claim 12, wherein the second end of the second elongated bladder chamber is located between the first elongated bladder chamber and the third elongated bladder chamber, wherein the second end of the fourth elongated bladder chamber is located between the third elongated bladder chamber and the fifth elongated bladder chamber, and wherein the second end of the sixth elongated bladder chamber is located between the fifth elongated bladder chamber and the seventh elongated bladder chamber.

14. The footwear upper according to claim 12, further comprising:

an eighth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, or the seventh elongated bladder chamber, the eighth elongated bladder chamber having a first end located in the second side region and a second end located in the instep region or the second side region, wherein: (a) the eighth elongated bladder chamber does not extend across the front-to-rear centerline of the footwear upper base and/or (b) all portions of the eighth elongated bladder chamber are located only on the lateral side or only on the medial side of the footwear upper base in the instep region;

a ninth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, the seventh elongated bladder chamber, or the eighth elongated bladder chamber, the ninth elongated bladder chamber having a first end located in the first side region and a second end located in the instep region or the second side region, wherein the ninth elongated bladder chamber: (a) extends across the front-to-rear centerline of the footwear upper base in the instep region and/or (b) extends from the lateral side to the medial side of the footwear upper base across the instep region; and a tenth elongated bladder chamber that is not in fluid communication with any of the first elongated bladder chamber, the second elongated bladder chamber, the third elongated bladder chamber, the fourth elongated bladder chamber, the fifth elongated bladder chamber, the sixth elongated bladder chamber, the seventh elongated bladder chamber, or the ninth elongated bladder chamber, the tenth elongated bladder chamber having a first end located in the second side region and a second end located in the instep region or the second side region, wherein: (a) the tenth elongated bladder chamber does not extend across the front-to-rear centerline of the footwear upper base and/or (b) all portions of the tenth elongated bladder chamber are located only on the lateral side or only on the medial side of the footwear upper base in the instep region.

15. A footwear upper, comprising:

a footwear upper base formed from one or more component parts, the footwear upper base including: (1) an instep region, (ii) a first side region extending from the instep region and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region;

a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region;

a third elongated bladder chamber having a first end located in the first side region and a second end located in the instep region or the second side region, wherein the third elongated bladder chamber: (a) extends across the front-to-rear centerline of the footwear upper base in the instep region and/or (b) extends from the lateral side to the medial side of the footwear upper base across the instep region;

a fourth elongated bladder chamber having a first end located in the second side region and a second end located in the instep region or the second side region, wherein: (a) the fourth elongated bladder chamber does not extend across the front-to-rear centerline of the footwear upper base and/or (b) all portions of the fourth elongated bladder chamber are located only on the lateral side or only on the medial side of the footwear upper base in the instep region; and a fifth elongated bladder chamber having a first end located in the first side region and a second end located in the instep region or the second side region, wherein the fifth elongated bladder chamber: (a) extends across the front-to-rear centerline of the footwear upper base in the instep region and/or (b) extends from the lateral side to the medial side of the footwear upper base across the instep region.

16. The footwear upper according to claim 15, further comprising:

a sixth elongated bladder chamber having a first end located in the second side region and a second end located in the instep region or the second side region, wherein: (a) the sixth elongated bladder chamber does not extend across the front-to-rear centerline of the footwear upper base and/or (b) all portions of the sixth elongated bladder chamber are located only on the lateral side or only on the medial side of the footwear upper base in the instep region.

17. The footwear upper according to claim 16, further comprising:

a seventh elongated bladder chamber having a first end located in the first side region and a second end located in the instep region or the second side region, wherein the seventh elongated bladder chamber: (a) extends across the front-to-rear centerline of the footwear upper base in the instep region and/or (b) extends from the lateral side to the medial side of the footwear upper base across the instep region;

an eighth elongated bladder chamber having a first end located in the second side region and a second end located in the instep region or the second side region, and wherein: (a) the eighth elongated bladder chamber does not extend across the front-to-rear centerline of the footwear upper base and/or (b) all portions of the eighth elongated bladder chamber are located only on the lateral side or only on the medial side of the footwear upper base in the instep region;

a ninth elongated bladder chamber having a first end located in the first side region and a second end located in the instep region or the second side region, wherein the ninth elongated bladder chamber: (a) extends across the front-to-rear centerline of the footwear upper base in the instep region and/or (b) extends from the lateral side to the medial side of the footwear upper base across the instep region;

a tenth elongated bladder chamber having a first end located in the second side region and a second end located in the instep region or the second side region, wherein: (a) the tenth elongated bladder chamber does not extend across the front-to-rear centerline of the footwear upper base and/or (b) all portions of the tenth elongated bladder chamber are located only on the lateral side or only on the medial side of the footwear upper base in the instep region; and an eleventh elongated bladder chamber having a first end located in the second side region and a second end located in the instep region or the second side region, wherein the eleventh elongated bladder chamber: (a) extends across the front-to-rear centerline of the footwear upper base in the instep region and/or (b) extends from the lateral side to the medial side of the footwear upper base across the instep region.

18. A footwear upper, comprising:

a footwear upper base formed from one or more component parts, the footwear upper base including: (i) an instep region, (ii) a first side region extending from the instep region, and (iii) a second side region extending from the instep region;

a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region;

a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region;

an ankle support bladder chamber located in the second side region, wherein the ankle support bladder chamber includes a first free end, a second free end, and a substantially C-shaped chamber extending between the first free end and the second free end; and a rearward elongated bladder chamber having a first end located in the first side region and a second end located between the first free end and the second free end of the ankle support bladder chamber.

19. An article of footwear, comprising:

a footwear upper including:

(a) a footwear upper base formed from one or more component parts, the footwear upper base including: (i) an instep region, (ii) a first side region extending from the instep region, (iii) a second side region extending from the instep region, and (iv) a plantar support surface, (b) a first elongated bladder chamber having a first end located in the first side region and a second end located in the instep region or the second side region, wherein the first elongated bladder chamber: (a) extends across a front-to-rear centerline of the footwear upper base in the instep region and/or (b) extends from a lateral side to a medial side of the footwear upper base across the instep region, and (c) a second elongated bladder chamber having a first end located in the second side region and a second end located in the instep region or the second side region, wherein: (a) the second elongated bladder chamber does not extend across the front-to-rear centerline of the footwear upper base and/or (b) all portions of the second elongated bladder chamber are located only on the lateral side or only on the medial side of the footwear upper base in the instep region; and a sole structure engaged with the footwear upper, wherein the sole structure includes a first side recess and a second side recess, wherein the first elongated bladder chamber extends through the first side recess and the first end of the first elongated bladder chamber is located on the plantar support surface, and wherein the second elongated bladder chamber extends through the second side recess and the first end of the second elongated bladder chamber is located on the plantar support surface.

20. The article of footwear according to claim 19, wherein the second elongated bladder chamber is not in fluid communication with the first elongated bladder chamber.

* * * * *